US011214926B2

(12) United States Patent
Lowe et al.

(10) Patent No.: US 11,214,926 B2
(45) Date of Patent: Jan. 4, 2022

(54) DRY POLYMER APPLICATION METHOD

(71) Applicant: ECOLAB USA INC., St. Paul, MN (US)

(72) Inventors: Robert M. Lowe, Chicago, IL (US); Weiguo Cheng, Naperville, IL (US); David Jordan, Evanston, IL (US); Heqing Huang, Naperville, IL (US)

(73) Assignee: ECOLAB USA INC., St. Paul, MN (US)

( * ) Notice: Subject to any disclaimer, the term of this patent is extended or adjusted under 35 U.S.C. 154(b) by 16 days.

(21) Appl. No.: 16/635,122

(22) PCT Filed: Jul. 31, 2018

(86) PCT No.: PCT/US2018/044562
§ 371 (c)(1),
(2) Date: Jan. 29, 2020

(87) PCT Pub. No.: WO2019/027994
PCT Pub. Date: Feb. 7, 2019

(65) Prior Publication Data

US 2020/0248409 A1 Aug. 6, 2020

Related U.S. Application Data

(60) Provisional application No. 62/539,032, filed on Jul. 31, 2017.

(51) Int. Cl.

| | |
|---|---|
| ***D21H 21/20*** | (2006.01) |
| ***D21H 17/37*** | (2006.01) |
| ***D21H 21/24*** | (2006.01) |
| ***D21H 21/50*** | (2006.01) |

(52) U.S. Cl.
CPC ..... *D21H 17/375* (2013.01); *D21H 21/20* (2013.01); *D21H 21/24* (2013.01); *D21H 21/50* (2013.01)

(58) Field of Classification Search
USPC ..... 162/168.3
See application file for complete search history.

(56) References Cited

U.S. PATENT DOCUMENTS

| | | | |
|---|---|---|---|
| 3,872,039 | A | 3/1975 | Vaugh et al. |
| 3,875,098 | A | 4/1975 | Sedlak |
| 4,115,187 | A | 9/1978 | Davidson |
| 4,217,425 | A | 8/1980 | Ballweber et al. |
| 4,392,917 | A | 7/1983 | Lipowski et al. |
| 4,426,485 | A | 1/1984 | Hoy et al. |
| 4,427,821 | A | 1/1984 | Fong et al. |
| 4,535,098 | A | 8/1985 | Evani et al. |
| 4,599,390 | A | 7/1986 | Fan et al. |
| 4,713,431 | A | 12/1987 | Bhattacharyya et al. |
| 4,744,864 | A | 5/1988 | Deets et al. |
| 4,795,531 | A | 1/1989 | Sofia et al. |
| 4,835,026 | A | 5/1989 | Horiki et al. |
| 4,835,206 | A | 5/1989 | Farrar et al. |
| 4,835,234 | A | 5/1989 | Valint et al. |
| 4,874,588 | A | 10/1989 | Sortwell et al. |
| 4,921,903 | A | 5/1990 | Fong |
| 5,221,435 | A | 6/1993 | Smith, Jr. |
| 5,234,604 | A | 8/1993 | Liao et al. |
| RE34,383 | E | 10/1993 | Rohring |
| 5,252,692 | A | 10/1993 | Lovy et al. |
| 5,435,922 | A | 7/1995 | Ramesh et al. |
| 5,541,252 | A | 7/1996 | Schmitt et al. |
| 5,942,573 | A | 8/1999 | Doki et al. |
| 5,980,878 | A | 11/1999 | Torgerson et al. |
| 6,100,322 | A | 8/2000 | Persson et al. |
| 6,228,217 | B1 | 5/2001 | Dickerson et al. |
| 6,274,667 | B1 | 8/2001 | Shannon et al. |
| 6,365,667 | B1 | 4/2002 | Shannon et al. |
| 6,406,593 | B1 | 6/2002 | Heard et al. |
| 6,960,617 | B2 | 11/2005 | Omidian et al. |
| 7,442,280 | B1 | 10/2008 | Klemets et al. |
| 7,700,702 | B2 | 4/2010 | Gaillard et al. |
| 7,973,095 | B2 | 7/2011 | Herth et al. |
| 8,241,618 | B2 | 8/2012 | Brandt et al. |
| 8,425,726 | B2 | 4/2013 | Buwono et al. |
| 8,758,562 | B2 | 6/2014 | Krapsch et al. |
| RE45,383 | E | 2/2015 | St. John et al. |
| 9,279,217 | B2 | 3/2016 | Hietaniemi et al. |
| 9,567,708 | B2 | 2/2017 | Cheng et al. |
| 9,822,297 | B2 | 11/2017 | Brinkman et al. |
| 2003/0022981 | A1 | 1/2003 | Baxter et al. |

(Continued)

FOREIGN PATENT DOCUMENTS

| | | |
|---|---|---|
| CN | 101942779 | 1/2011 |
| CN | 102154943 | 8/2011 |

(Continued)

OTHER PUBLICATIONS

PCT/US2018/044562 International Search Report.
International Search Report and Written Opinion for PCT/US2018/065358, dated Mar. 21, 2019, 11 pages.
Daoud-Mahammed, S. et al. "Original tamoxifen-loaded gels containing cyclodextrins: in situ self-assembling systems for cancer treatment," Journal Drug Delivery Science Technology, vol. 14(1), pp. 51-55 (2004).
"Fixative Polymers and Hair Styling Compositions Thereof," IP.com Journal, 44 pages (May 20, 2015).
Shen, Yi-ding et al. "Study on aqueous solution properties of hydrophobically associating cationic polyacrylamides and its application," Modem Chemical Industry, vol. 27(4), pp. 38-40 + 42 (Apr. 2007), English abstract only.

(Continued)

*Primary Examiner* — Mark Halpern
(74) *Attorney, Agent, or Firm* — Eric D. Babych; Barnes & Thornburg LLP

(57) ABSTRACT

A method of incorporating a low molecular weight polymer (e.g., polymer strength aid) into an industrial process (e.g., papermaking process) is provided. The method comprises treating an industrial process (e.g., paper sheet precursor) with a powder or wetted powder, wherein the powder comprises a polymer dry polymer (e.g., polymer strength aid), wherein the polymer dry polymer (e.g., polymer strength aid) has a weight average molecular weight of from about 10 kDa to about 2,000 kDa.

16 Claims, 5 Drawing Sheets

(56) References Cited

U.S. PATENT DOCUMENTS

| | | | |
|---|---|---|---|
| 2004/0110861 | A1 | 6/2004 | Shorbu et al. |
| 2005/0124704 | A1 | 6/2005 | Rasheed et al. |
| 2005/0161183 | A1 | 7/2005 | Covarrubias |
| 2005/0230319 | A1 | 10/2005 | Mori et al. |
| 2006/0065380 | A1 | 3/2006 | Garnier et al. |
| 2006/0142432 | A1 | 6/2006 | Harrington et al. |
| 2006/0270801 | A1 | 11/2006 | Hagiopol et al. |
| 2006/0276597 | A1 | 12/2006 | Quadir et al. |
| 2006/0289136 | A1 | 12/2006 | Doherty et al. |
| 2006/0289137 | A1 | 12/2006 | Gelman et al. |
| 2008/0004405 | A1 | 1/2008 | Mori et al. |
| 2008/0058456 | A1 | 3/2008 | Chiou et al. |
| 2008/0216979 | A1 | 9/2008 | Schaffer |
| 2009/0074698 | A1 | 3/2009 | Biganska |
| 2009/0145566 | A1 | 6/2009 | Esser et al. |
| 2009/0165978 | A1 | 7/2009 | Hagiopol et al. |
| 2010/0076145 | A1 | 3/2010 | Bobsein et al. |
| 2010/0190948 | A1 | 7/2010 | Proverb et al. |
| 2010/0286434 | A1 | 11/2010 | Bobsein et al. |
| 2010/0331510 | A1 | 12/2010 | Reichenbach-Klinke et al. |
| 2011/0056640 | A1 | 3/2011 | Cyr et al. |
| 2011/0155339 | A1 | 6/2011 | Brungardt et al. |
| 2011/0281980 | A1 | 11/2011 | Bobsein et al. |
| 2012/0129734 | A1 | 5/2012 | Reichenbach-Klinke et al. |
| 2012/0132382 | A1 | 5/2012 | Hund et al. |
| 2014/0360691 | A1 | 12/2014 | Hietaniemi et al. |
| 2015/0059998 | A1 | 3/2015 | Zhao et al. |
| 2015/0087796 | A1 | 3/2015 | Millard et al. |
| 2015/0167245 | A1 | 6/2015 | Cheng et al. |
| 2015/0197893 | A1 | 7/2015 | Cheng et al. |
| 2015/0367018 | A1 | 12/2015 | Oshima et al. |
| 2016/0097160 | A1 | 4/2016 | Castro et al. |
| 2016/0097161 | A1 | 4/2016 | Benz et al. |
| 2016/0244594 | A1 | 8/2016 | Langlotz |
| 2016/0311940 | A1 | 10/2016 | Hund et al. |
| 2016/0326698 | A1 | 11/2016 | Chen et al. |
| 2017/0029546 | A1 | 2/2017 | Langlotz |
| 2017/0037298 | A1 | 2/2017 | Li et al. |
| 2017/0037299 | A1 | 2/2017 | Le et al. |
| 2017/0037574 | A1 | 2/2017 | Grimm et al. |
| 2017/0037575 | A1 | 2/2017 | Hund et al. |

FOREIGN PATENT DOCUMENTS

| | | | |
|---|---|---|---|
| CN | 102532409 | | 7/2012 |
| CN | 102660150 | | 9/2012 |
| CN | 104844760 | A | 8/2015 |
| EP | 0374478 | | 6/1990 |
| EP | 0614950 | A1 | 9/1994 |
| EP | 2933271 | | 10/2015 |
| FR | 2377447 | | 8/1978 |
| GB | 1372787 | | 11/1974 |
| JP | 5493089 | | 7/1979 |
| JP | 2002054088 | | 2/2002 |
| WO | 9835095 | | 8/1998 |
| WO | 0034582 | | 6/2000 |
| WO | 2006071633 | A1 | 7/2006 |
| WO | 2012042157 | | 4/2012 |
| WO | 2012100156 | A1 | 7/2012 |
| WO | 2013153004 | | 10/2013 |
| WO | 2014076372 | | 5/2014 |
| WO | 2015110703 | A1 | 7/2015 |
| WO | 2015158517 | A1 | 10/2015 |
| WO | 2016120524 | | 8/2016 |
| WO | 2016170230 | A1 | 10/2016 |
| WO | 2017106310 | A1 | 6/2017 |
| WO | 2017/182568 | A1 | 10/2017 |

OTHER PUBLICATIONS

Volet, Gisèle et al. "pH Sensitive supramolecular assembling system between a new linear water soluble β-cyclodextrin terpolymer and an amphiphilic poly(ethylene oxide)," European Polymer Journal, vol. 45(3), pp. 852-862 (2009).

Wang, Ying et al. "Cyclodextrins modify the properties of cationic polyacrylamides," Journal of Colloid and Interface Science, vol. 339(2), pp. 325-329 (2009).

Wenz, Gerhard et al. "Association Thickener by Host-Guest Interaction of β-Cyclodextrin Polymers and Guest Polymers," Associative Polymers in Aqueous Media, Chapter 16. Washington DC: American Chemical Society, vol. 765, pp. 271-283 (Aug. 10, 2000).

Wintgens, Véronique et al. "Aqueous Polysaccharide Associations Mediated by β-Cyclodextrin Polymers," Biomacromolecules, vol. 9(5), pp. 1434-1442 (2008).

Wintgens, Veronique et al. "Water-soluble γ-cyclodextrin polymers with high molecular weight and their complex forming properties," European Polymer Journal, vol. 46(9), pp. 1915-1922, (2010).

Wu, Weibing et al. "Preparation and Application of Hydrophobically Associating Cationic Polyacrylamide," Advanced Materials Research, vols. 284-286, pp. 1808-1814, (2011).

Mata et al., Aggregation Behavior of Quaternary Salt Based Cationic Surfactants. Thermochimica Acta 428 (2005) 147-155 (Year: 2005).

European Patent Office, International Search Repoprt in International Patent Application No. PCT/US2017036996, 4 pages, (dated Sep. 14, 2017).

European Patent Office, Written Opinion in International Patent Application No. PCT/US2017036996, pages, (Sep. 14, 2017).

Abson et al., "Wet-end Behavior or Dry Strength Additives," Tappi Journal, vol. 68, No. 1., pp. 76-78 (Jan. 1985).

Lingstrom et al., "Polyelectrolyte Multilayers on Wood Fibers: Influence of Molecular Weight on Layer Properties and Mechanical Properties of Papers From Treated Fibers," Journal of Colloid and Interface Science, vol. 328, pp. 233-242 (2008).

Ma et al., "Study on Synthesis of Cationic Water in Water Polyacrylamide Emulsion Strength Agent," Advanced Materials Research, vols. 581-582, pp. 164-167 (Oct. 22, 2012).

Marimuth et al., "Anionic Acrylamide Co-Polymer as Dry Strength Additive for Paper," IPPTA J., vol. 22, No. 3, pp. 131-135 (Jul.-Sep. 2010).

McLean et al., "Synthesis of Guar Gum-Graft-Poly (Acrylamide-Co-Diallyldimethylammonium Chloride) and its Application in the Pulp and Paper Industry," BioResources, vol. 6, No. 4, pp. 4168-4180 (2011).

Nakamura, "PAM-type Ply Bond Strength agent 'Himoloc MJ-450,'" Japan Tappi Journal, vol. 57, No. 11, pp. 1618-1621 (2003).

Nobukuni et al., "The Latest Technological Trends of PAM Based Dry Strength Resins," Kani-pa-gi-kyo-shi, vol. 70, No. 5, pp. 493-497 (Aug. 2016).

Richardson et al., "Optimisation of Neutral Paper-Making Wet End Chemistry for Pitch Free Newsprint Manufacture," APPITA Annual General Conference, pp. 219-226 (2003); Conference: Proceedings of the 57th Appita Annual General Conference and Exhibit, May 5, 2003-May 7, 2003.

Suzuki et al., "Novel PAM Based Dry Strength Resins," Japan Tappi Journal, vol. 66.5, pp. 477-480 (Jan. 1, 2013).

Vanerek, "Filler Retention in Papermaking by Polymeric ad Microparticulate Retention Aid Systems," ProQuest Dissertations and Theses Global, 2005; ISBN-13: 9780494129609; Paper No. NR12960; Publisher: ProQuest LLC, pp. 269.

Zhang et al., "Preparation of Polyacrylamide in Brine with Aqueous Two-Phase Copolymerization and Its Application as Paper Strength Agent," China Pulp & Paper, vol. 27, No. 7, pp. 32-35 (2008).

Zhu et al., "Study on Branched Polyacrylamide Preparation and Application," Advanced Materials Research, vol. 174, pp. 490-493 (2011) (English Abstract Only).

Zhu et al., "Preparation of Active Resistant-Electrolytic Amphoteric Polyacrylmide and Its Application as Paper Strength Aid," Journal of Xi'an University of Technology, vol. 26, No. 4, pp. 412-416 (2010).

DRY POLYMER APPLICATION METHOD

This application is a 371 of PCT/US2018/044562 filed 31 Jul. 2018.

This application is an international (i.e., PCT) application claiming the benefit of U.S. Provisional Patent Application Ser. No. 62/539,032, filed Jul. 31, 2017, the disclosure of which is incorporated herein by reference in its entirety.

BACKGROUND OF THE INVENTION

Polymers with relatively low molecular weight (e.g., typically lower than 2 million Daltons) are commonly used in many industrial processes (e.g., mining, textiles, or papermaking). For example, some low molecular weight polymers can be employed as strength aids in papermaking to help improve the strength of the sheet, or in textiles to impart strength and dexterity to a fabric. In addition, some low molecular weight polymers can be employed in the mining industry to improve wastewater recovery, reuse, and recycling.

To be used effectively, these low molecular weight polymers have to be dissolved before they are added to the industrial process. However, low molecular weight (e.g., 2 million Daltons or less) polymers cannot be processed into a powder in the same fashion as high molecular weight polymers. In general, the polymer wet gel of low molecular weight polymers is too soft to cut and process. Therefore, conventionally low molecular weight polymers are transported to the industrial process site as solution-based polymers which may then be diluted before adding to the industrial process.

Further, in some industrial processes, solution-based polymers cannot be added to certain aspects of the process for fear of irreparable damage to the polymer. For example, they may become damaged due to high heat and shear present at certain aspects of the process. Hence, for papermaking processes, solution polymers are not added during stock prep because they tend to become irreparably damaged, and thus, become ineffective strength, retention, and drainage aids due to the high heat and shear present as the polymer passes through the paper machine.

High and low molecular weight solution polymers have high costs associated with transportation, degradation (due to long-term storage instability), as well as costs associated with, and facilities required for, application to industrial processes (e.g., mining, textiles, papermaking, etc.). In addition, solution-based polymers are limited by their procedural application as they may become irreparably damaged from high heat and shear during certain stages of an industrial process (e.g., stock prep in a paper machine).

Thus, there remains a need for a low molecular weight polymer (e.g., a polymer strength aid), which can be processed into and transported to the application site as a powder. And can be added to the industrial process as a powder or as a solid slurry. A powder has the capacity to improve costs associated with transportation and storage, as well as improving costs associated with, and facilities required for application to an industrial process.

BRIEF SUMMARY OF THE INVENTION

A method of incorporating a low molecular weight polymer (e.g., polymer strength aid) into an industrial process (e.g., papermaking process) is provided. The method comprises treating an industrial process (e.g., paper sheet precursor) with a powder, wherein the powder comprises a polymer (e.g., polymer strength aid), wherein the polymer has a weight average molecular weight of from about 10 kDa to about 2,000 kDa. In certain aspects, the method comprises treating an industrial process (e.g., paper sheet precursor) with a wetted powder, wherein the powder comprises a polymer (e.g., polymer strength aid), wherein the polymer has a weight average molecular weight of from about 10 kDa to about 2,000 kDa, and the wetted powder is added to the industrial process (e.g., paper sheet precursor) before the wetted powder reaches complete dissolution, as measured by refractive index at 25° C. and 1 atmosphere ("atm") of pressure. In certain aspects, the wetted powder reaches complete dissolution, as measured by refractive index at 25° C. and 1 atmosphere ("atm"), to form a powder solution in an addition conduit during addition to the industrial process (e.g., paper sheet precursor).

The present disclosure provides an approach to adding polymer (e.g., polymer strength aid)s to an industrial process (e.g., paper sheet precursor) using a powder comprising a low molecular weight polymer (e.g., polymer strength aid). The powder can be added directly to the industrial process (e.g., paper sheet precursor). In addition or alternately, the powder comprising a low molecular weight polymer (e.g., polymer strength aid) can be wetted prior to addition to the industrial process (e.g., paper sheet precursor). The methods provided herein utilize the high heat and shear of the industrial process (e.g., paper machine) to facilitate dissolution of the powder, allowing the powder to function properly in the fiber slurry. In particular, the methods provided herein utilize a water soluble powder comprising a low molecular weight polymer (e.g., polymer strength aid), which can be added to an industrial process (e.g., paper sheet precursor) dry or wetted, which should fully dissolve in the aqueous slurry (e.g., pulp slurry) of the industrial process (e.g., paper machine). In some embodiments, the methods of adding the powder comprising the low molecular weight polymer (e.g., polymer strength aid) to the papermaking process generate paper strength properties similar to or better than that of conventional solution-based polymer strength aids.

DETAILED DESCRIPTION OF THE INVENTION

Generally, high and low molecular weight polymers are dissolved, diluted and then added to an industrial process (e.g., a paper sheet precursor/papermaking process) as aqueous solutions to avoid solubility issues and damage from the high heat and/or shear of the industrial process (e.g., papermaking process). A benefit of the method comprising treating an industrial process (e.g., paper sheet precursor) with the powder, provided herein, is that the powder does not require dissolution and dilution prior to addition to the industrial process (e.g., paper sheet precursor/papermaking process). Without wishing to be bound to any particular theory, it is believed that the high heat and shear of the industrial process (e.g., the papermaking process) facilitates the dissolution of the powder comprising the low molecular weight polymer (e.g., polymer strength aid) and does not damage the low molecular weight polymer. Thus, the powder can be added directly to the industrial process (e.g., papermaking system), resulting in performance properties similar to or better than that of the corresponding solution-based polymer. For example, the powder can result in paper strength properties similar to or better than that of conventional solution-based polymer strength aids.

Figure 9:
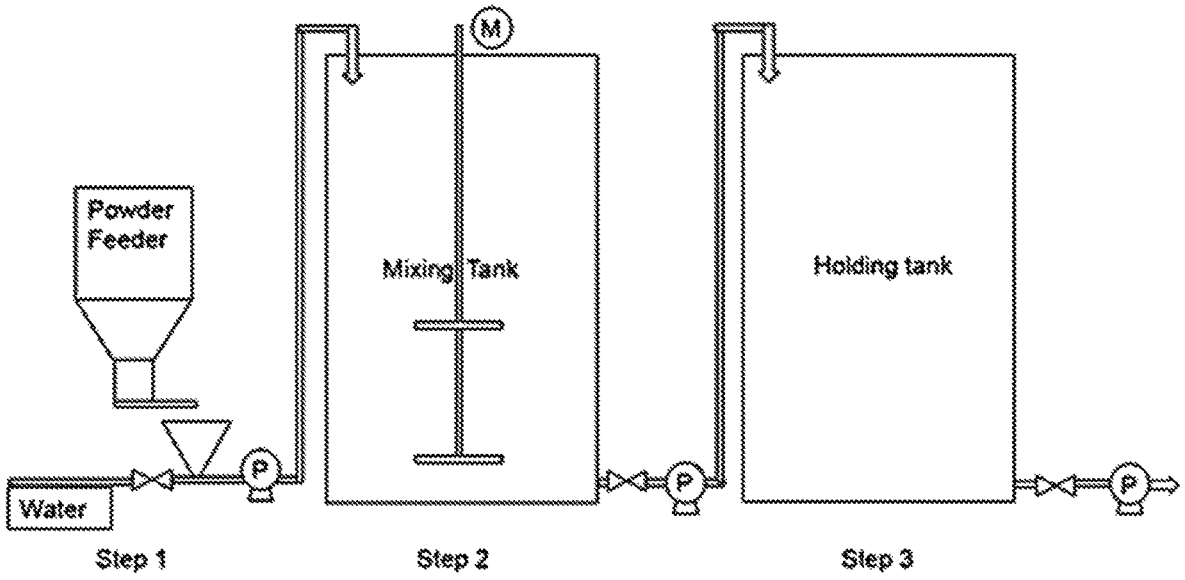
FIG. 9 shows a diagram of a conventional dry powder handling system ("P" refers to pump and "M" refers to mixer).

Conventionally, addition of a dry powder to an industrial process, such as a papermaking process, must proceed through a series of handling steps (see, for example, FIG. 9). First, the dry powder must be dispersed into water to form a powder suspension by using a powder feeder, as shown in Step 1 of FIG. 9. Then the powder suspension is transported to a mixing/aging tank to dissolve the powder to solution, as shown in Step 2 of FIG. 9. It normally takes at least 30 minutes to dissolve the polymer in the aging/mixing tank. Typical polymer concentrations are less than 2 wt. % and are limited by the viscosity of polymer solution and the capability of mixing equipment, and thus require large volumes for storage and application processes. Next the dissolved polymer solution is in-line filtered and transported from aging/mixing tank to a holding tank (Step 3) from which the gel-free polymer solution is pumped to the paper mill based on the dosage demand. The methods of treating a paper sheet precursor with a powder or wetted powder provided herein allow one to circumvent the aging/mixing tank (Step 2) and/or the holding tank (Step 3), thereby reducing times associated with application to the papermaking process and the spatial footprint associated with large mixing tanks.

A method of incorporating a low molecular weight polymer into an industrial process (e.g., mining, textiles, or papermaking, etc.) is provided. The method comprises applying a powder to the industrial process, wherein the powder comprises a low molecular weight polymer with a weight average molecular weight of from about 10 kDa to about 2,000 kDa. The low molecular weight polymer is as described herein.

The powder can be added to any suitable industrial process that utilizes a solution-based low molecular weight polymer. For example, the powder can be added to a mining application, a textile application, a paper application, or a water treatment application. It is believed that the powder described herein has the capacity to improve costs associated with transportation and storage, as well as improving costs associated with, and facilities required for application to an industrial process such as a mining application, a textile application, a paper application, or a water treatment application.

The powder can be added to the industrial process by any suitable means. In some embodiments, the powder is added directly to the industrial process (i.e., directly to an aqueous liquid or aqueous slurry used for said industrial process). In some embodiments, the powder is wetted prior to being added directly to the industrial process. In certain embodiments, the powder is added to a process stream of the industrial process. As used herein, the phrase "process stream" refers to a solvent (e.g., water) flow added to the industrial process. Thus, the powder can be added to the industrial process via the process stream without being fully solubilized first.

A method of incorporating a low molecular weight polymer strength aid into a papermaking process is also provided. The method comprises treating a paper sheet precursor with a powder, wherein the powder comprises a polymer strength aid, wherein the polymer strength aid has a weight average molecular weight of from about 10 kDa to about 2,000 kDa.

The method comprises treating a paper sheet precursor with a powder. As used herein, the term "paper sheet precursor" refers to any component of the papermaking process upstream of the point at which water removal begins (e.g., the table). As used herein, the terms "upstream" and "downstream" refer to components of the papermaking process that are procedurally towards the pulper, and procedurally towards the reel, respectively. Accordingly, the powder can be added to pulp (e.g., virgin pulp, recycled pulp, or a combination thereof), pulp slurry, cellulosic fibers, a solution used for any of the aforementioned components, and any combination thereof at any one or more of various locations during the papermaking process, up to and including a headbox. In certain embodiments, the powder can be added to the pulp slurry in a pulper, latency chest, reject refiner chest, disk filter or Decker feed or accept, whitewater system, pulp stock storage chests (either low density ("LD"), medium consistency ("MC"), or high consistency ("HC")), blend chest, machine chest, headbox, save-all chest, or combinations thereof.

In some embodiments, the powder is added to the paper sheet precursor upstream of a wet end of a paper machine (e.g., before the wet end). As used herein, the term "wet end" refers to any component of the papermaking process including the headbox and downstream thereof. Accordingly, the powder can be added to any component of the papermaking process up to but not including the headbox. In certain embodiments, the powder is added to a stock prep section of the paper machine. As used herein, "stock prep section" refers to any component of the papermaking process wherein the pulp is refined and/or blended. For example, the powder can be added to the pulp stock storage chests (either low density ("LD"), medium consistency ("MC"), or high consistency ("HC")), blend chest, machine chest, save-all chest, or a combination thereof.

In some embodiments, the pulp slurry comprises recycled fibers. The recycled fibers can be obtained from a variety of paper products or fiber containing products, such as paperboard, newsprint, printing grades, sanitary or other paper products. In some embodiments, these products can comprise, for example, old corrugated cardboard ("OCC"), old newsprint ("ONP"), mixed office waste ("MOW"), magazines, books, or a combination thereof. In some embodiments, the pulp slurry comprises virgin fibers. In embodiments comprising virgin fibers, the pulp can be derived from softwood, hardwood, or blends thereof. In certain embodiments, the virgin pulp can include bleached or unbleached Kraft, sulfite pulp or other chemical pulps, and groundwood ("GW") or other mechanical pulps such as, for example, thermomechanical pulp ("TMP").

The powder can be added to the industrial process (e.g., paper sheet precursor) in any suitable amount to achieve the desired weight percentage of polymer actives. The powder can be added to the industrial process (e.g., paper sheet precursor) in an amount to achieve about 0.01 wt. % or more of polymer actives, for example, about 0.05 wt. % or more, about 0.1 wt. % or more, about 0.2 wt. % or more, about 0.3 wt. % or more, about 0.4 wt. % or more, about 0.5 wt. % or more, about 0.6 wt. % or more, about 0.7 wt. % or more, about 0.8 wt. % or more, about 0.9 wt. % or more, or about 1.0 wt. % or more. Alternatively, or in addition to, the powder can be added to the industrial process (e.g., paper sheet precursor) in an amount to achieve about 10 wt. % or less of polymer actives, for example, about 9 wt. % or less, about 8 wt. % or less, about 7 wt. % or less, about 6 wt. % or less, about 5 wt. % or less, about 4 wt. % or less, about 3 wt. % or less, about 2 wt. % or less, or about 1 wt. % or less. Thus, the powder can be added to the industrial process (e.g., paper sheet precursor) in any suitable amount bounded by any two of the aforementioned endpoints to achieve the desired weight percentage of polymer actives. The powder can be added to the industrial process (e.g., paper sheet precursor) in an amount to achieve from about 0.01 wt. % to about 10 wt. % of polymer actives, for example, from about 0.01 wt. % to about 9 wt. %, from about 0.01 wt. % to about 8 wt. %, from about 0.01 wt. % to about 7 wt. %, from about 0.01 wt. % to about 6 wt. %, from about 0.01 wt. % to about 5 wt. %, from about 0.01 wt. % to about 4 wt. %, from about 0.01 wt. % to about 3 wt. %, from about 0.01 wt. % to about 2 wt. %, from about 0.01 wt. % to about 1 wt. %, from about 0.05 wt. % to about 1 wt. %, from about 0.1 wt. % to about 1 wt. %, from about 0.2 wt. % to about 1 wt. %, from about 0.3 wt. % to about 1 wt. %, from about 0.4 wt. % to about 1 wt. %, from about 0.5 wt. % to about 1 wt. %, from about 0.6 wt. % to about 1 wt. %, from about 0.7 wt. % to about 1 wt. %, from about 0.8 wt. % to about 1 wt. %, from about 0.9 wt. % to about 1 wt. %, from about 1 wt. % to about 15 wt. %, from about 1 wt. % to about 10 wt. %, from about 0.01 wt. % to about 2 wt. %, or from about 0.01 wt. % to about 5 wt. %.

A method of incorporating a low molecular weight polymer strength aid into a papermaking process is provided. The method comprises treating a paper sheet precursor with a wetted powder, wherein the powder comprises a polymer strength aid, wherein the polymer strength aid has a weight average molecular weight of from about 10 kDa to about 2,000 kDa.

As used herein, "wetted powder" refers to a powder that has been wetted with a solvent (e.g., water). For example, in some embodiments, the powder is wetted prior to treating the industrial process (e.g., paper sheet precursor).

In some embodiments, the powder is wetted with a solvent prior to treating the industrial process (e.g., paper sheet precursor), wherein the wetted powder is added to the industrial process (e.g., paper sheet precursor) before the wetted powder reaches complete dissolution, as measured by refractive index at 25° C. and 1 atmosphere ("atm"). In such embodiments, the wetted powder is a powder suspension that has been prepared prior to treating the industrial process (e.g., paper sheet precursor). As used herein, "powder suspension" refers to a heterogeneous system, which contains partially hydrated powder particles as well as solvent and/or partially dissolved polymer (e.g., polymer strength aid) solution. The powder suspension provided herein can be considered substantially different from a powder solution. As used herein, "powder solution" refers to a homogeneous system wherein each polymer (e.g., polymer strength aid) chain is dissolved in solvent (e.g., water). Thus, the methods provided herein can be considered substantially different from the conventional process of forming a made down powder solution in a mixing tank and/or holding tank prior to adding the powder solution to the industrial process (e.g., paper sheet precursor). In embodiments where the wetted powder is added to the industrial process (e.g., paper sheet precursor) before the wetted powder reaches complete dissolution, the wetted powder can be prepared in any suitable apparatus (e.g., a mixing tank, a holding tank, a transfer conduit, an addition conduit, or a combination thereof).

In some embodiments, the wetted powder reaches complete dissolution, as measured by refractive index at 25° C. and 1 atmosphere ("atm"), to form a powder solution in an addition conduit during addition to the industrial process (e.g., paper sheet precursor). As used herein, the term "addition conduit" refers to any apparatus used to add the wetted powder to the industrial process (e.g., paper sheet precursor). For example, the addition conduit can be a funnel, an auger, or a pipe to the industrial process (e.g., in the case of a paper machine, the pulp stock storage chests, the blend chest, the machine chest, the save-all chest, or a combination thereof) that facilitates the addition of both the powder and the solvent. In embodiments where the wetted powder reaches complete dissolution, as measured by refractive index at 25° C. and 1 atmosphere ("atm"), to form a powder solution in an addition conduit, the powder solution does not spend any time in a mixing tank and/or holding tank. Thus, the methods provided herein can be considered substantially different from the conventional process of forming a made down powder solution in a mixing tank and/or holding tank prior to adding the powder solution to the industrial process (e.g., paper sheet precursor). Without wishing to be bound by any particular theory, it is believed that the powder has a high enough dissolution rate and a small enough particle size to reach complete dissolution in the time it takes to wet the powder, pass through the addition conduit, and reach the industrial process (e.g., paper sheet precursor).

In some embodiments, the wetted powder is added to the paper sheet precursor upstream of a wet end of a paper machine (e.g., before the wet end). Accordingly, the wetted powder can be added to any component of the papermaking process up to but not including the headbox. In certain embodiments, the wetted powder is added to a stock prep section of the paper machine. For example, the wetted powder can be added to the pulp stock storage chests (either low density ("LD"), medium consistency ("MC"), or high consistency ("HC")), blend chest, machine chest, save-all chest, or a combination thereof.

The level of dissolution of the wetted powder can be determined by any suitable method. Generally, the level of dissolution as provided herein is determined using the refractive index of the wetted powder solution/suspension. A fully dissolved powder solution with known concentration can be obtained (at 25° C. and 1 atmosphere ("atm") of pressure) by mixing a predetermined amount of powder in a predetermined amount of water under shear with a cage stirrer at 400-800 rpm until the mixture of powder and water can easily pass through 100-mesh screen with a trace amount of insoluble residue (<<0.05 wt. % of original powder added) left on the screen. An aliquot of the filtered polymer solution (i.e., filtrate) can be placed in the cell of a RM50 refractometer (Mettler Toledo), and the refractive index recorded. The refractive index of a polymer solution should be linearly correlated with the concentration of dissolved polymer (e.g., polymer strength aid) in solution (see, for example, FIG. 7). Thus, a powder can be considered to have reached complete dissolution when the refractive index reaches the appropriate refractive index value, within error (e.g., about ±5%) of the expected value, on the linearly correlated polymer (e.g., polymer strength aid) concentration curved.

Similarly, the level of dissolution can be monitored as a function of time. A powder suspension can be obtained (at 25° C. and 1 atmosphere ("atm") of pressure) by dispersing a predetermined amount of powder into a predetermined amount of solvent (up to a 10 wt. % powder concentration) manually, or with a powder feeder, e.g., Norchem POWDERCAT™ (Norchem Industries, Mokena, Ill.). Upon dispersion, the powder starts to hydrate but can take time to reach complete dissolution with sufficient mixing. Generally, a stable refractive index cannot be obtained for a powder suspension due to its heterogeneous nature. However, the suspension can be filtered through a 100-mesh screen to remove any undissolved powder, and the filtered polymer (e.g., polymer strength aid) solution can be placed in the cell of a RM50 refractometer (Mettler Toledo), and the refractive index recorded. Using the refractive index of the filtrate, the concentration of the dissolved polymer (e.g., polymer strength aid) in suspension can be calculated with a linear calibration curve (e.g., FIG. 7). To monitor the change of the refractive index and the concentration of dissolved powder during mixing of the powder suspension, a small aliquot from the suspension can be removed at 1-minute intervals and filtered through a 100-mesh screen. The filtrate aliquots can be placed on the cell of a RM50 refractometer (Mettler Toledo), and the refractive index recorded. Once the refractive index reaches a plateau, for the time-dependent dissolution measurement, the powder can be considered to have reached complete dissolution (see, for example, FIG. 8).

Figure 8:
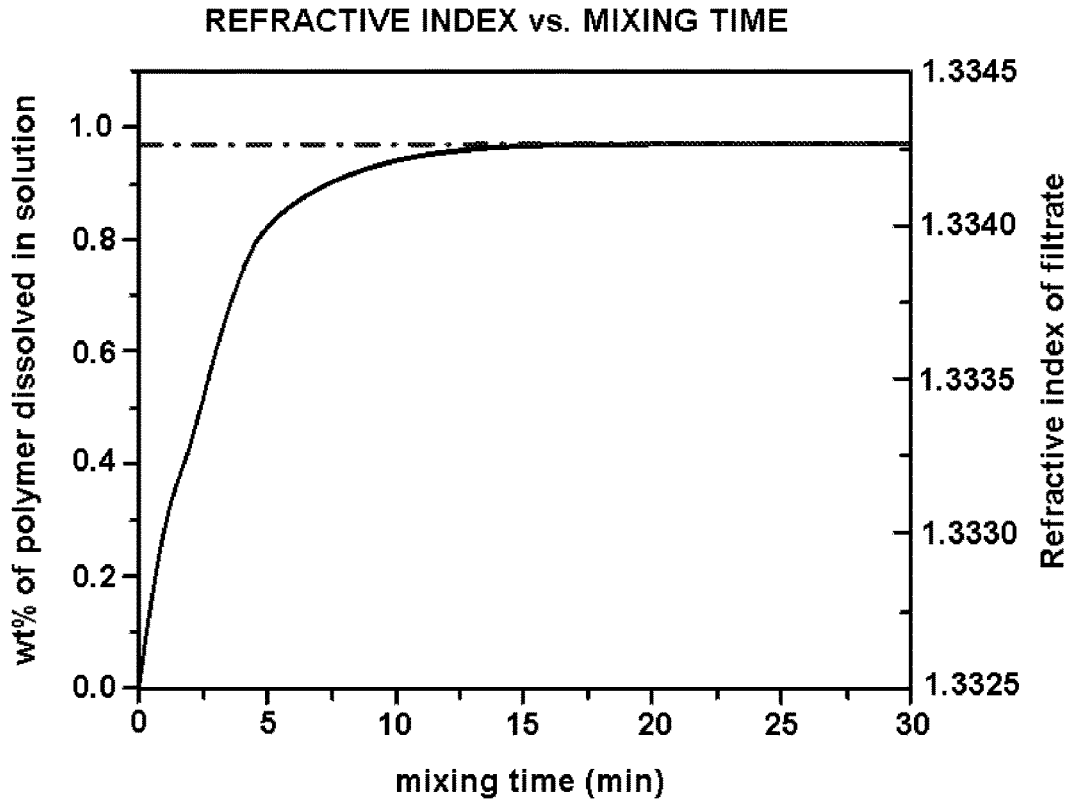
FIG. 8 graphically depicts the results of Example 14.

Without mixing or with insufficient mixing, the refractive index of the filtrate of the powder suspension should be lower than that of the powder solution, as measured by refractive index at the same powder concentration (demonstrated by the dashed line in FIG. 8). Thus, in some embodiments provided herein, the method comprises adding the wetted powder to an industrial process (e.g., paper sheet precursor) before the refractive index reaches a plateau (i.e., prior to the wetted powder reaching complete dissolution). In other words, in some embodiments, the powder is added to the industrial process (e.g., paper sheet precursor) as a powder suspension (e.g., as a heterogeneous mixture).

The solvent can be any solvent suitable for the industrial process (e.g., papermaking process) that will not interfere with the performance of the polymer. The solvent can be a single chemical or a mixture of two or more chemicals. In certain embodiments, the solvent is water. The powder can be wetted with any suitable water source (e.g., upon addition to the paper sheet precursor or prior to addition to the paper sheet). In some embodiments, the powder is wetted with fresh water. The fresh water can be surface water or ground water. In certain embodiments, the fresh water is further treated prior to use in the methods provided herein. In certain embodiments, the powder is wetted with process water. The process water can be obtained from any suitable step in the industrial process (e.g., cooling water). In some embodiments, the process water is further treated prior to use in the methods provided herein.

The wetted powder can be added to the industrial process (e.g., paper sheet precursor) in any suitable amount to achieve the desired weight percentage of polymer actives. The wetted powder can be added to the industrial process (e.g., paper sheet precursor) in an amount to achieve about 0.01 wt. % or more of polymer actives, for example, about 0.05 wt. % or more, about 0.1 wt. % or more, about 0.2 wt. % or more, about 0.3 wt. % or more, about 0.4 wt. % or more, about 0.5 wt. % or more, about 0.6 wt. % or more, about 0.7 wt. % or more, about 0.8 wt. % or more, about 0.9 wt. % or more, or about 1.0 wt. % or more. Alternatively, or in addition to, the wetted powder can be added to the industrial process (e.g., paper sheet precursor) in an amount to achieve about 10 wt. % or less of polymer actives, for example, about 9 wt. % or less, about 8 wt. % or less, about 7 wt. % or less, about 6 wt. % or less, about 5 wt. % or less, about 4 wt. % or less, about 3 wt. % or less, about 2 wt. % or less, or about 1 wt. % or less. Thus, the wetted powder can be added to the industrial process (e.g., paper sheet precursor) in any suitable amount bounded by any two of the aforementioned endpoints to achieve the desired weight percentage of polymer actives. The wetted powder can be added to the industrial process (e.g., paper sheet precursor) in an amount to achieve from about 0.01 wt. % to about 10 wt. % of polymer actives, for example, from about 0.01 wt. % to about 9 wt. %, from about 0.01 wt. % to about 8 wt. %, from about 0.01 wt. % to about 7 wt. %, from about 0.01 wt. % to about 6 wt. %, from about 0.01 wt. % to about 5 wt. %, from about 0.01 wt. % to about 4 wt. %, from about 0.01 wt. % to about 3 wt. %, from about 0.01 wt. % to about 2 wt. %, from about 0.01 wt. % to about 1 wt. %, from about 0.05 wt. % to about 1 wt. %, from about 0.1 wt. % to about 1 wt. %, from about 0.2 wt. % to about 1 wt. %, from about 0.3 wt. % to about 1 wt. %, from about 0.4 wt. % to about 1 wt. %, from about 0.5 wt. % to about 1 wt. %, from about 0.6 wt. % to about 1 wt. %, from about 0.7 wt. % to about 1 wt. %, from about 0.8 wt. % to about 1 wt. %, from about 0.9 wt. % to about 1 wt. %, from about 1 wt. % to about 15 wt. %, from about 1 wt. % to about 10 wt. %, from about 0.01 wt. % to about 2 wt. %, or from about 0.01 wt. % to about 5 wt. %.

The wetted powder can have any suitable powder content prior to treating the industrial process (e.g., paper sheet precursor). The wetted powder can have a powder content of about 10 wt. % or less prior to treating the industrial process (e.g., paper sheet precursor), for example, about 9 wt. % or less, about 8 wt. % or less, about 7 wt. % or less, about 6 wt. % or less, about 5 wt. % or less, about 4 wt. % or less, or about 3 wt. % or less. Alternatively, or in addition to, the wetted powder can have a powder content of about 0.1 wt. % or more prior to treating the industrial process (e.g., paper sheet precursor), for example, about 0.2 wt. % or more, about 0.5 wt. % or more, about 1 wt. % or more, about 2 wt. % or more, or about 3 wt. % or more. Thus, the wetted powder can have a powder content bounded by any two of the aforementioned endpoints prior to treating the industrial process (e.g., paper sheet precursor). The wetted powder can have a powder content from about 0.1 wt. % to about 10 wt. % prior to treating the industrial process (e.g., paper sheet precursor), for example, from about 0.5 wt. % to about 10 wt. %, from about 1 wt. % to about 10 wt. %, from about 2 wt. % to about 10 wt. %, from about 3 wt. % to about 10 wt. %, from about 0.1 wt. % to about 9 wt. %, from about 0.1 wt. % to about 8 wt. %, from about 0.1 wt. % to about 7 wt. %, from about 0.1 wt. % to about 6 wt. %, from about 0.1 wt. % to about 5 wt. %, from about 0.1 wt. % to about 4 wt. %, from about 0.1 wt. % to about 3 wt. %, from about 0.2 wt. % to about 3 wt. %, from about 0.2 wt. % to about 5 wt. %, from about 0.2 wt. % to about 10 wt. %, from about 0.5 wt. % to about 5 wt. %, from about 0.5 wt. % to about 3 wt. %, from about 1 wt. % to about 5 wt. %, or from about 1 wt. % to about 3 wt. %.

In some embodiments, the wetted powder can be considered a powder slurry. For these embodiments, the powder slurry can comprise any suitable powder content such that the powder is not completely dissolved. In certain embodiments, the filtrate of the powder slurry has a refractive index below a powder solution with the same powder content that has reached complete dissolution at 25° C. and 1 atmosphere ("atm") of pressure. Without wishing to be bound to any particular theory, the refractive index will increase up until the moment the powder is completely dissolved. Thus, as long as the powder slurry provides a refractive index below the plateau, the slurry is not a solution polymer. In certain embodiments, the wetted powder is any powder slurry, wherein the powder has not had substantial mixing time to achieve complete dissolution.

The powder and/or wetted powder can be added to the industrial process (e.g., paper sheet precursor) in any suitable dosage (lbs/ton actives) of the polymer (e.g., polymer strength aid). As used herein, the terms "lbs/ton actives" or "lb/ton actives" refer to the pounds of polymer actives per ton (e.g., ton of fiber). The powder and/or wetted powder can be added to the industrial process (e.g., paper sheet precursor) in a dosage of the polymer of at least about 0.1 lbs/ton actives. For example, the powder and/or wetted powder can be added to the industrial process (e.g., paper sheet precursor) in a dosage of the polymer of at least about 0.5 lbs/ton actives, at least about 1 lbs/ton actives, at least about 2 lbs/ton actives, at least about 3 lbs/ton actives, at least about 4 lbs/ton actives, at least about 5 lbs/ton actives, at least about 6 lbs/ton actives, at least about 7 lbs/ton actives, at least about 8 lbs/ton actives, at least about 9 lbs/ton actives, at least about 10 lbs/ton actives, at least about 11 lbs/ton actives, at least about 12 lbs/ton actives, at least about 13 lbs/ton actives, at least about 14 lbs/ton actives, or at least about 15 lbs/ton actives.

In some embodiments, the polymer strength aid can improve strength of the resulting paper product. Additionally, in certain embodiments, the polymer strength aid can improve one or more additional properties of the resulting paper product. For example, in addition to strength, the polymer strength aid can improve opacity, smoothness, porosity, dimensional stability, pore size distribution, linting propensity, density, stiffness, formation, compressibility, or a combination thereof. Without wishing to be bound to any particular theory, many of the aforementioned paper properties are believed to be dependent on the bonds that exist between the cellulosic fibers in the paper. It is believed that the networking of these fibers may be enhanced by certain chemical aids and additionally by the mechanical beating and/or refining step(s) of the papermaking process, during which the fibers become more flexible and the available surface area is increased.

In certain embodiments, the polymer strength aid improves dry strength of the paper sheet, wet strength or rewetted strength of the paper sheet, wet web strength of the paper sheet, or a combination thereof. Generally, dry strength is recognized as tensile strength exhibited by a dry paper sheet, typically conditioned under uniform humidity and room temperature conditions prior to testing. Wet strength, or rewetted strength, is recognized as tensile strength exhibited by a paper sheet that has been fully dried and then rewetted with water prior to testing. Wet web strength is recognized as the strength of a cellulosic fiber mat prior to drying to a paper product.

Typical polymer strength aids are solution polymers, which are added at the wet end (i.e., not before the head box) of the papermaking process to the cellulosic slurry to avoid irreparable damage to the polymer strength aid and improve strength characteristics of the paper sheet. Without wishing to be bound to any particular theory, strength resins are believed to work by supplementing the number of inter-fiber bonds. Generally, after drying, the cellulose fiber web that has been treated with a polymer strength aid possesses greater dry strength than that possessed by untreated cellulose fiber webs.

In the past, it has been necessary to use a solution-based polymer strength aid to obtain a homogeneous distribution of the polymer over the cellulose fiber web. Thus, common polymer strength aids must be dissolved prior to being added to the paper sheet precursor, and must not be added too far upstream in the papermaking process for fear of damaging the polymer strength aid polymer due to high heat and shear. In certain embodiments, the polymer strength aid described herein does not need to be solubilized prior to addition to the paper sheet precursor, and, for example, can be added to the stock preparation section of the paper machine (e.g., before the wet end).

In certain embodiments, the polymer strength aid improves the dry strength of the paper sheet. The polymer strength aid can improve any suitable dry strength property of the paper sheet. For example, the polymer can improve the tensile strength, the STFI ratio, the burst index, the ring crush, or a combination thereof.

In some embodiments, the polymer strength aid increases the tensile strength (Nm/g), on average, by at least about 0.5% per 1 lb/ton actives. For example, the polymer strength aid can increase the tensile strength (Nm/g), on average, by at least about 1% per 1 lb/ton actives, at least about 2% per 1 lb/ton actives, at least about 3% per 1 lb/ton actives, at least about 4% per 1 lb/ton actives, or at least about 5% per 1 lb/ton actives. In some embodiments, the polymer strength aid increases the tensile strength (Nm/g), on average, by about 2% per 1 lb/ton actives. In certain embodiments, the polymer strength aid increases the tensile strength (Nm/g), on average, by about 3% per 1 lb/ton actives.

In some embodiments, the polymer strength aid increases the STFI ratio, on average, by at least about 0.5% per 1 lb/ton actives. For example, the polymer strength aid can increase the STFI ratio, on average, by at least about 1% per 1 lb/ton actives, at least about 2% per 1 lb/ton actives, at least about 3% per 1 lb/ton actives, at least about 4% per 1 lb/ton actives, or at least about 5% per 1 lb/ton actives. In some embodiments, the polymer strength aid increases the STFI ratio, on average, by about 2% per 1 lb/ton actives. In certain embodiments, the polymer strength aid increases the STFI ratio, on average, by about 3% per 1 lb/ton actives.

In some embodiments, the polymer strength aid increases the burst index (PSI 1,000 $ft^2$/lb), on average, by at least about 0.5% per 1 lb/ton actives. For example, the polymer strength aid can increase the burst index (PSI 1,000 $ft^2$/lb), on average, by at least about 1% per 1 lb/ton actives, at least about 2% per 1 lb/ton actives, at least about 3% per 1 lb/ton actives, at least about 4% per 1 lb/ton actives, or at least about 5% per 1 lb/ton actives. In some embodiments, the polymer strength aid increases the burst index (PSI 1,000 $ft^2$/lb), on average, by about 2% per 1 lb/ton actives. In certain embodiments, the polymer strength aid increases the burst index (PSI 1,000 $ft^2$/lb), on average, by about 3% per 1 lb/ton actives.

In some embodiments, the polymer strength aid increases the ring crush (kN/m), on average, by at least about 0.5% per 1 lb/ton actives. For example, the polymer strength aid can increase the ring crush (kN/m), on average, by at least about 1% per 1 lb/ton actives, at least about 2% per 1 lb/ton actives, at least about 3% per 1 lb/ton actives, at least about 4% per 1 lb/ton actives, or at least about 5% per 1 lb/ton actives. In some embodiments, the polymer strength aid increases the ring crush (kN/m), on average, by about 2% per 1 lb/ton actives. In certain embodiments, the polymer strength aid increases the ring crush (kN/m), on average, by about 3% per 1 lb/ton actives.

The polymer strength aid can improve the dry strength of any suitable paper product. In some embodiments, the polymer strength aid improves the dry strength of Kraft paper, tissue paper, testliner paper, duplex topside white paper, cardboard and shaped or molded paperboard, or a combination thereof. In certain embodiments, the polymer strength aid does not require a supplemental strength aid.

In some embodiments, the powder is used with any suitable conventional papermaking product. For example, the powder may be used along with one or more inorganic filler(s), dye(s), retention aid(s), drainage aid(s), sizing agent(s), coagulant(s), or combinations thereof.

In some embodiments, the powder is used with one or more inorganic filler(s). The inorganic filler can be any suitable inorganic filler, capable of increasing opacity or smoothness, decreasing the cost per mass of the paper, or combinations thereof. For example, the powder can be used with kaolin, chalk, limestone, talc, titanium dioxide, calcined clay, urea formaldehyde, aluminates, aluminosilicates, silicates, calcium carbonate (e.g., ground and/or precipitated), or combinations thereof.

In some embodiments, the powder is used with one or more dye(s). The dye can be any suitable dye, capable of controlling the coloration of paper. For example, the dye can be a direct dye, a cationic direct dye, acidic dye, basic dye, insoluble colored pigment, or combinations thereof.

In some embodiments, the powder is used with one or more drainage and/or retention aid(s). The drainage and/or retention aids can be any suitable drainage and/or retention aids, capable of helping to maintain efficiency and drainage of the paper machine, while improving uniformity, and retaining additives. For example, the drainage and/or retention aid can be a cationic polyacrylamide ("PAM") polymer, an anionic polyacrylamide ("PAM") polymer, a cationic polyethylenimine ("PET") polymer, polyamines, ammonium-based polymers (e.g., polydiallyldimethylammonium chloride ("DADMAC"), colloidal silica, bentonite, polyethylene oxide ("PEO"), starch, polyaluminum sulfate, polyaluminum chloride, or combinations thereof.

In some embodiments, the powder is used with one or more sizing agent(s). The sizing agent can be any suitable sizing agent, capable of increasing the resistance to water and other liquids, exhibited by the paper sheet. For example, the sizing agent can be a rosin, alkenyl succinic anhydride ("ASA"), alkylylketene dimer ("AKD"), or combinations thereof.

In some embodiments, the powder is used with one or more coagulant(s). The coagulant can be any suitable coagulant. As it relates to the present application, "coagulant" refers to a water treatment chemical used in a solid-liquid separation stage to neutralize charges of suspended particles so that the particles can agglomerate. Generally, coagulants may be categorized as cationic, anionic, amphoteric, or zwitterionic. Furthermore, coagulants may be categorized as inorganic coagulants, organic coagulants, and blends thereof. Exemplary inorganic coagulants include, e.g., aluminum or iron salts, such as aluminum sulfate, aluminum chloride, ferric chloride, ferric sulfate, polyaluminum chloride, and/or aluminum chloride hydrate. Exemplary organic coagulants include, e.g., diallyldimethylammonium chloride ("DADMAC"), dialkylaminoalkyl acrylate and/or a dialkylaminoalkyl methacrylate, or their quaternary or acid salts.

The powder comprises a polymer (e.g., polymer strength aid). In some embodiments, the polymer is an associative polymer. Thus, in some embodiments, the powder comprises an associative polymer (e.g., polymer strength aid). In certain embodiments, the powder comprises one or more associative polymer(s). For example, the powder can comprise a plurality (e.g., at least two polymer molecules) of associative polymer(s), wherein the associative polymer(s) have the same molecular structure (i.e., one associative polymer), or the powder can comprise a plurality of associative polymer(s), wherein the associative polymer(s) have varying molecular structures (i.e., more than one associative polymer(s)). The one or more associative polymer(s) can be any suitable polymer. For example, the one or more associative polymer(s) can be homopolymers, copolymers, terpolymers, or greater, or a combination thereof. In certain embodiments, the one or more associative polymer(s) are terpolymers.

The associative polymer (e.g., polymer strength aid) can be cationic, anionic, amphoteric, non-ionic, or zwitterionic. In some embodiments, the associative polymer is cationic. As used herein, "cationic" polymers refer to polymers containing cationic monomer units or a combination of cationic monomer units and non-ionic monomer units. In some embodiments, the associative polymer is anionic. As used herein, "anionic" polymers refer to polymers containing anionic monomer units or a combination of anionic monomer units and non-ionic monomer units. In some embodiments, the associative polymer strength aid is amphoteric. As used herein, "amphoteric" polymers refer to polymers containing cationic monomer units and anionic monomer units, or cationic monomer units, anionic monomer units, and non-ionic monomer units. In some embodiments, the associative polymer is non-ionic. As used herein, "non-ionic" polymers refer to polymers containing non-ionic monomer units. In some embodiments, the associative polymer is zwitterionic. As used herein, "zwitterionic" polymers refer to polymers containing zwitterionic monomer units or a combination of zwitterionic monomer units and cationic monomer units, anionic monomer units, and/or non-ionic monomer units.

The associative polymer (e.g., polymer strength aid) can exist as any suitable structure type. For example, the associative polymer can exist as an alternating polymer, random polymer, block polymer, graft polymer, linear polymer, branched polymer, cyclic polymer, or a combination thereof. The associative polymer can contain a single monomer unit, or any suitable number of different monomer units. For example, the associative polymer can contain 2 different monomer units, 3 different monomer units, 4 different monomer units, 5 different monomer units, or 6 different monomer units. The associative polymer's monomer units can exist in any suitable concentration and any suitable proportion.

In certain embodiments, the powder comprises an associative polymer (e.g., polymer strength aid), wherein the associative polymer (i.e., absent of networking) has a weight average molecular weight of from about 10 kDa to about 2,000 kDa. The associative polymer can have a weight average molecular weight of about 2,000 kDa or less, for example, about 1,800 kDa or less, about 1,600 kDa or less, about 1,400 kDa or less, about 1,200 kDa or less, about 1,000 kDa or less, about 900 kDa, or less, about 800 kDa, or less, about 700 kDa or less, about 600 kDa or less, or about 500 kDa or less. Alternatively, or in addition, the associative polymer can have a weight average molecular weight of about 10 kDa or more, for example, about 50 kDa or more, about 100 kDa or more, about 200 kDa or more, about 300 kDa or more, or about 400 kDa or more. Thus, the associative polymer can have a weight average molecular weight bounded by any two of the aforementioned endpoints. For example, the associative polymer can have a weight average molecular weight of from about 10 kDa to about 500 kDa, from about 50 kDa to about 500 kDa, from about 100 kDa to about 500 kDa, from about 200 kDa to about 500 kDa, from about 300 kDa to about 500 kDa, from about 400 kDa to about 500 kDa, from about 400 kDa to about 600 kDa, from about 400 kDa to about 700 kDa, from about 400 kDa to about 800 kDa, from about 400 kDa to about 900 kDa, from about 400 kDa to about 1,000 kDa, from about 400 kDa to about 1,200 kDa, from about 400 kDa to about 1,400 kDa, from about 400 kDa to about 1,600 kDa, from about 400 kDa to about 1,800 kDa, from about 400 kDa to about 2,000 kDa, from about 200 kDa to about 2,000 kDa, from about 500 kDa to about 2,000 kDa, or from about 800 kDa to about 2,000 kDa.

Weight average molecular weight can be determined by any suitable technique. While alternate techniques are envisioned, in some embodiments, the weight average molecular weight is determined using size exclusion chromatography (SEC) equipped with a set of TSKgel PW columns (TSKgel Guard+GMPW+GMPW+G1000PW), Tosoh Bioscience LLC, Cincinnati, Ohio) and a Waters 2414 (Waters Corporation, Milford, Mass.) refractive index detector or a DAWN HELEOS II multi-angle light scattering (MALS) detector (Wyatt Technology, Santa Barbara, Calif.). Moreover, the weight average molecular weight is determined from either calibration with polyethylene oxide/polyethylene glycol standards ranging from 150-875,000 Daltons or directly using light scattering data with known refractive index increment ("dn/dc").

In certain embodiments, the weight average molecular weight is determined by hydrolysis of the associative polymer (e.g., polymer strength aid) to remove the hydrolysable side chains and then further analyzed with size exclusion chromatography (SEC). The associative polymer can be hydrolyzed by any suitable technique. For example, the associative polymer can be hydrolyzed by treatment with a 0.1 wt. % solution of NaOH at pH 12 with a cage stirrer at 400 rpm for one hour. As used herein, "hydrolysable side chains" refer to any side chain on an associative monomer unit or an additional monomer unit that can be cleaved through hydrolysis. Without wishing to be bound to any particular theory, the associative polymer, comprising an associative monomer unit, may need to be hydrolyzed prior to size exclusion chromatography due to low recovery rate from the column. Generally, hydrolysis of the associative polymer does not cleave the polymer backbone and preserves the degree of polymerization of the associative polymer(s).

In certain embodiments, the associative monomer unit does not contain a hydrolysable side chain. In embodiments where the associative monomer unit does not contain a hydrolysable side chain, the weight average molecular weight can be determined by analyzing a surrogate of the associative polymer (e.g., polymer strength aid). For example, the weight average molecular weight can be determined by synthesizing a polymer using the exact same formulation in the absence of the associative monomer unit. Without wishing to be bound to any particular theory, the polymer synthesized with the same formulation maintains a similar degree of polymerization and results in a weight average molecular weight similar to an associative polymer wherein the associative monomer unit is present.

Illustrative embodiments of the associative polymer (e.g., polymer strength aid) generally include one or more associative monomer unit(s) and one or more additional monomer unit(s). As used herein, "additional monomer unit" refers to any monomer unit other than the associative monomer unit. In certain embodiments, the one or more additional monomer units are derived from a water-soluble monomer (e.g., acrylamide, diallyldimethylammonium chloride ("DADMAC"), 2-(acryloyloxy)-N,N,N-trimethylethanaminium chloride ("DMAEA.MCQ"), etc.). As used herein, "derived" when referring to a monomer unit, means that the monomer unit has substantially the same structure of a monomer from which it was made, wherein the terminal olefin has been transformed during the process of polymerization. In some embodiments, the associative polymer includes one or more associative monomer unit(s), a monomer unit derived from a monomer of Formula I, and one or more additional monomer unit(s). In certain embodiments, the associative polymer includes an associative monomer unit, a monomer unit derived from a monomer of Formula I, and an additional monomer unit.

In some embodiments, the one or more associative monomer unit(s), and the one or more additional monomer unit(s) can be incorporated into the associative polymer (e.g., polymer strength aid) using monomers, dimers, trimers, oligomers, adducts, or a combination thereof of the monomers structures from which they are derived. For example, the one or more associative monomer unit(s), or the one or more additional monomer unit(s) can exist as a dimer, trimer, oligomer, or adduct prior to incorporation into the associative polymer.

The associative polymer (e.g., polymer strength aid) can comprise any one or more suitable additional monomer unit(s) selected from a cationic monomer unit, an anionic monomer unit, a nonionic monomer unit, a zwitterionic monomer unit, and a combination of two or more thereof. For example, the associative polymer can comprise a cationic monomer unit and an anionic monomer unit, an anionic monomer unit and a nonionic monomer unit, a cationic monomer unit and a nonionic monomer unit, or a cationic monomer unit, an anionic monomer unit, and a nonionic monomer unit. In certain embodiments, the associative polymer comprises and/or further comprises a zwitterionic monomer unit. The associative polymer can be synthesized by any suitable polymerization method. For example, the associative polymer can be made through free radical polymerization, addition polymerization, free radical addition polymerization, cationic addition polymerization, anionic addition polymerization, emulsion polymerization, solution polymerization, suspension polymerization, precipitation polymerization, or a combination thereof. In certain embodiments, polymerization occurs through free radical polymerization.

Thus, a suitable additional monomer unit can be derived from any one or more suitable monomers capable of participating in free radical polymerization. For example, the associative polymer (e.g., polymer strength aid) can comprise one or more additional monomer units derived from a monomer selected from a monomer of Formula I, 2-(dimethylamino)ethyl acrylate ("DMAEA"), 2-(dimethylamino) ethyl methacrylate ("DMAEM"), 3-(dimethylamino)propyl methacrylamide ("DMAPMA"), 3-(dimethylamino)propyl acrylamide ("DMAPA"), 3-methacrylamidopropyl-trimethyl-ammonium chloride ("MAPTAC"), 3-acrylamidopropyl-trimethyl-ammonium chloride ("APTAC"), N-vinyl pyrrolidone ("NVP"), N-vinyl acetamide, hydroxyethyl methacrylate, hydroxyethyl acrylate, diallyldimethylammonium chloride ("DADMAC"), diallylamine, vinylformamide, 2-(acryloyloxy)-N,N,N-trimethylethanaminium chloride ("DMAEA.MCQ"), 2-(methacryloyloxy)-N,N,N-trimethylethanaminium chloride ("DMAEM.MCQ"), N,N-dimethylaminoethyl acrylate benzyl chloride ("DMAEA.BCQ"), N,N-dimethylaminoethyl methacrylate benzyl chloride ("DMAEM.BCQ"), 2-acrylamido-2-methylpropane sulfonic acid ("AMPS"), 2-acrylamido-2-methylbutane sulfonic acid ("AMBS"), [2-methyl-2-[(1-oxo-2-propenyl)amino]propyl]-phosphonic acid, methacrylic acid, acrylic acid, salts thereof, and combinations thereof.

In some embodiments, the associative polymer (e.g., polymer strength aid) comprises a monomer unit derived from a monomer of Formula I:

I

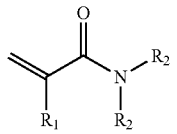

wherein $R_1$ is H or $C_1$-$C_4$ alkyl (e.g., methyl, ethyl, n-propyl, iso-propyl, n-butyl, sec-butyl, or tert-butyl) and each $R_2$ is independently H or an organic group. As used herein, the term "organic group" refers to an alkyl group, an aryl group, a fluoroalkyl group, or a fluoroaryl group. In certain embodiments, the monomer unit derived from a monomer of Formula I is considered an additional monomer unit.

In certain embodiments of the substituent $R_2$, the organic group is a $C_1$-$C_6$ alkyl group (i.e., 1, 2, 3, 4, 5, or 6 carbon units in length). In some embodiments, the $C_1$-$C_6$ alkyl group is saturated, unsaturated, branched, straight-chained, cyclic, or a combination thereof. An exemplary list of $C_1$-$C_6$ alkyl groups is methyl, ethyl, n-propyl, iso-propyl, n-butyl, sec-butyl, tert-butyl, n-pentyl, sec-pentyl, neo-pentyl, or hexyl. In certain embodiments, the $C_1$-$C_6$ alkyl group is substituted with one or more alkyl substituents, aryl substituents, heteroatoms, or combinations thereof (e.g., benzyl, phenylethyl, phenylpropyl, etc.). In some embodiments, the $C_1$-$C_6$ alkyl group can be a $C_1$-$C_6$ heteroalkyl group (i.e., 1, 2, 3, 4, 5, or 6 carbon units in length). As used herein, "heteroalkyl group" refers to a saturated or unsaturated, substituted or unsubstituted, straight-chained, branched, or cyclic aliphatic group that contains at least 1 heteroatom (e.g., O, S, N, and/or P) in the core of the molecule (i.e., the carbon backbone).

In certain embodiments of the substituent $R_2$, the organic group is an aryl group. The aryl group can be any substituted or unsubstituted aryl or heteroaryl group, wherein the heteroaryl group is an aromatic 5- or 6-membered monocyclic group that has at least one heteroatom (e.g., O, S, or N) in at least one of the rings. The heteroaryl group can contain one or two oxygen or sulfur atoms and/or from one to four nitrogen atoms, provided that the total number of heteroatoms in the ring is four or less and the ring has at least one carbon atom. Optionally, the nitrogen, oxygen, and sulfur atoms can be oxidized (i.e., has undergone a process of losing electrons), and the nitrogen atoms optionally can be quaternized. In some embodiments, the aryl compound is phenyl, pyrrolyl, furanyl, thiophenyl, pyridyl, isoxazolyl, oxazolyl, isothiazolyl, thiazolyl, imidazolyl, thiadiazolyl, tetrazolyl, triazolyl, oxadiazolyl, pyrazolyl, pyrazinyl, triazinyl, pyrimidinyl, or pyridazinyl.

In certain embodiments of the substituent $R_2$, the organic group is a $C_1$-$C_6$ fluoroalkyl group or a $C_1$-$C_6$ fluoroaryl group. As used herein, the terms "fluoroalkyl" and "fluoroaryl" refer to any alkyl group or aryl group, respectively, with one or more fluorine atoms.

In certain embodiments, the monomer of Formula I is acrylamide or methacrylamide.

The associative polymer (e.g., polymer strength aid) can comprise the one or more additional monomer unit(s) in any suitable concentration, so long as the associative polymer includes a suitable portion of one or more associative monomer unit(s) as provided herein. The associative polymer can comprise a sum total of about 90 mol % or more of the one or more additional monomer unit(s), for example, about 91 mol % or more, about 92 mol % or more, about 93 mol % or more, about 94 mol % or more, about 95 mol % or more, about 96 mol % or more, about 97 mol % or more, about 98 mol % or more, or about 99 mol % or more. Alternatively, or in addition to, the associative polymer can comprise a sum total of about 99.995 mol % or less of the one or more additional monomer unit(s), for example, about 99.99 mol % or less, about 99.9 mol % or less, about 99.75 mol % or less, about 99.5 mol % or less, about 99.4 mol % or less, about 99.3 mol % or less, about 99.2 mol % or less, or about 99.1 mol % or less. Thus, the associative polymer can comprise the one or more additional monomer unit(s) in a sum total concentration bounded by any two of the aforementioned endpoints. The associative polymer can comprise a sum total from about 90 mol % to about 99.995 mol % of the one or more additional monomer unit(s), for example, from about 91 mol % to about 99.995 mol %, from about 92 mol % to about 99.995 mol %, from about 93 mol % to about 99.995 mol %, from about 94 mol % to about 99.995 mol %, from about 95 mol % to about 99.995 mol %, from about 97 mol % to about 99.995 mol %, from about 98 mol % to about 99.995 mol %, from about 99 mol % to about 99.995 mol %, from about 99 mol % to about 99.99 mol %, from about 99 mol % to about 99.9 mol %, from about 99 mol % to about 99.75 mol %, from about 99 mol % to about 99.5 mol %, from about 99 mol % to about 99.4 mol %, from about 99 mol % to about 99.3 mol %, from about 99 mol % to about 99.2 mol %, from about 99 mol % to about 99.1 mol %, from about 99.5 mol % to about 99.99 mol %, from about 99.5 mol % to about 99.995 mol %, from about 99.75 mol % to about 99.99 mol %, or from about 99.75 mol % to about 99.995 mol %.

The associative polymer (e.g., polymer strength aid) can comprise one or more associative monomer unit(s) of any suitable type(s). As described herein, "associative monomer unit" refers to any monomer unit capable of coordinating with itself, other associative monomer units, surfactants, or a combination thereof. The coordination can occur through any suitable interaction. For example, the coordination can occur through ionic bonding, hydrogen bonding, hydrophobic interactions, dipolar interactions, Van der Waals forces, or a combination of two or more such coordination types.

In some embodiments, the associative monomer unit is formed post polymerization by attaching an associative moiety to a polymer. As used herein, "associative moiety" refers to any pendant chemical structure capable of coordinating with itself, other associative monomer units, surfactants, or a combination thereof. The coordination can occur through any suitable interaction. For example, the coordination can occur through ionic bonding, hydrogen bonding, hydrophobic interactions, dipolar interactions, Van der Waals forces, or a combination of two or more such coordination types. In some embodiments, the associative moiety is attached directly to the terminal end of a polymer, attached through a linker to the terminal end of a polymer, attached directly to the polymer backbone, attached to the polymer backbone through a linker, or a combination thereof.

In certain embodiments, the one or more associative monomer unit(s) of the one or more associative polymer (e.g., polymer strength aid) are structurally similar. As used herein, "structurally similar" means that the associative monomer unit(s) have similar chemical functional groups. In some embodiments, the associative monomer unit(s) each comprise at least one hydroxyl substituent. In some embodiments, the associative monomer unit(s) each comprise at least one amine substituent. In some embodiments, the associative monomer unit(s) each comprise a polyether chain. In some embodiments, the associative monomer unit(s) each comprise a polyether chain, wherein the length of the polyether chains are separated by six carbon units or less (i.e., 6, 5, 4, 3, 2, 1, or 0). For example, if an associative monomer unit has a polyether chain length of 16 carbon units, then a structurally similar associative monomer unit will have a polyether chain length from 10-22 carbon units (i.e., 10, 11, 12, 13, 14, 15, 16, 17, 18, 19, 20, 21, or 22). In certain embodiments, the polyether chains each comprise the same number of carbon units. In some embodiments, the associative monomer unit(s) each comprise an alkyl chain. In some embodiments, the associative monomer unit(s) each comprise alkyl chains, wherein the length of the alkyl chains are separated by six carbon units or less (i.e., 6, 5, 4, 3, 2, 1, or 0). For example, if an associative monomer unit has an alkyl chain length of 16 carbon units, then a structurally similar associative monomer unit will have an alkyl chain length from 10-22 carbon units (i.e., 10, 11, 12, 13, 14, 15, 16, 17, 18, 19, 20, 21, or 22). In certain embodiments, the alkyl chains each comprise the same number of carbon units. In certain embodiments, the associative monomer unit(s) are the same.

In certain embodiments, the one or more associative monomer unit(s) are incorporated into the polymer through polymerization with one or more associative monomer(s). Thus, the one or more associative monomer unit(s) can be derived from any one or more suitable associative monomer(s) selected from a nonionic associative monomer, a cationic associative monomer, an anionic associative monomer, a zwitterionic associative monomer, and a combination thereof. The one or more associative monomer(s) are capable of participating in polymerization. In certain embodiments, the one or more associative monomer(s) comprise an unsaturated subunit (e.g., acrylate, acrylamide, etc.), separate from the associative moiety, capable of participating in free radical polymerization. Generally, the one or more associative monomer(s) are selected from an acrylate, an acrylamide, or a combination thereof.

In an embodiment, the associative monomer unit is a nonionic associative monomer unit. Generally, the nonionic associative monomer unit is derived from an acrylate and/or an acrylamide monomer of Formula II:

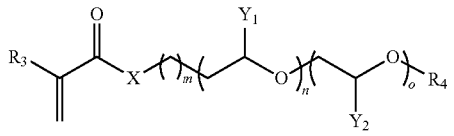

II wherein $R_3$ is H or $C_1$-$C_{10}$ alkyl (e.g., $(CH_2)_kCH_3$), wherein k is an integer from 0 to 9 (i.e., 0, 1, 2, 3, 4, 5, 6, 7, 8, or 9), X is O or NH, m, n, and o are independently integers from 0 to 100, wherein when (n+o)≤3, m is at least 7, each $Y_1$ and $Y_2$ are independently H or $C_1$-$C_4$ alkyl (e.g., methyl, ethyl, n-propyl, iso-propyl, n-butyl, sec-butyl, or tert-butyl), and $R_4$ is H or a hydrophobic group. In some embodiments, "$C_1$-$C_{10}$ alkyl" refers to a branched $C_1$-$C_{10}$ alkyl group. In certain embodiments, each $Y_1$ and $Y_2$ is independently chosen to produce block or random copolymers of ethylene oxide ("EO"), propylene oxide ("PO"), or a combination thereof. In some embodiments, m, n, and o refer to an average (rounded to the nearest integer) chain length of the designated subunits (i.e., average carbon chain length or average EO/PO chain length). As used herein, the term "hydrophobic group" refers to an alkyl group, an aryl group, a fluoroalkyl group, or a fluoroaryl group.

In certain embodiments of the substituent $R_4$, the hydrophobic group is a $C_1$-$C_{32}$ alkyl group (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32 carbon units in length). In some embodiments, the $C_1$-$C_{32}$ alkyl group is saturated, unsaturated, branched, straight-chained, cyclic, or a combination thereof. An exemplary list of $C_1$-$C_{32}$ alkyl groups is methyl, ethyl, n-propyl, iso-propyl, n-butyl, sec-butyl, tert-butyl, n-pentyl, sec-pentyl, neo-pentyl, hexyl, heptyl, octyl, nonyl, lauryl, stearyl, cetyl, behenyl, cyclopentyl, cyclohexyl, propenyl, 2-butenyl, 3-butenyl, 2-pentenyl, 3-pentenyl, or 4-pentenyl. In certain embodiments, the $C_1$-$C_{32}$ alkyl carbon group is further substituted with one or more alkyl substituents, aryl substituents, heteroatoms, or combinations thereof. In some embodiments, the $C_1$-$C_{32}$ alkyl group can be a $C_1$-$C_{32}$ heteroalkyl group (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32 carbon units in length). As used herein, "heteroalkyl group" refers to a saturated or unsaturated, substituted or unsubstituted, straight-chained, branched, or cyclic aliphatic group that contains at least 1 heteroatom (e.g., O, S, N, and/or P) in the core of the molecule (i.e., the carbon backbone).

As used herein, the term "substituted" means that one or more hydrogens on the designated atom or group are replaced with another group provided that the designated atom's normal valence is not exceeded. For example, when the substituent is oxo (i.e., =O), then two hydrogens on the carbon atom are replaced. Combinations of substituents are permissible provided that the substitutions do not significantly adversely affect synthesis or use of the associative polymer (e.g., polymer strength aid).

In certain embodiments of the substituent $R_4$, the hydrophobic group is an aryl group. The aryl group can be any substituted or unsubstituted aryl or heteroaryl group, wherein the heteroaryl group is an aromatic 5- or 6-membered monocyclic group, 9- or 10-membered bicyclic group, or an 11- to 14-membered tricyclic group, which has at least one heteroatom (e.g., O, S, or N) in at least one of the rings. Each ring of the heteroaryl group containing a heteroatom can contain one or two oxygen or sulfur atoms and/or from one to four nitrogen atoms, provided that the total number of heteroatoms in each ring is four or less and each ring has at least one carbon atom. The fused rings completing the bicyclic and tricyclic groups may contain only carbon atoms and may be saturated, partially saturated, or unsaturated. The nitrogen, oxygen, and sulfur atoms optionally can be oxidized, and the nitrogen atoms optionally can be quaternized. Heteroaryl groups that are bicyclic or tricyclic must include at least one fully aromatic ring, but the other fused ring or rings can be aromatic or non-aromatic. In some embodiments, the aryl group is phenyl, naphthyl, pyrrolyl, isoindolyl, indolizinyl, indolyl, furanyl, benzofuranyl, benzothiophenyl, thiophenyl, pyridyl, acridinyl, naphthyridinyl, quinolinyl, isoquinolinyl, isoxazolyl, oxazolyl, benzoxazolyl, isothiazolyl, thiazolyl, benzthiazolyl, imidazolyl, thiadiazolyl, tetrazolyl, triazolyl, oxadiazolyl, benzimidazolyl, purinyl, pyrazolyl, pyrazinyl, pteridinyl, quinoxalinyl, phthalazinyl, quinazolinyl, triazinyl, phenazinyl, cinnolinyl, pyrimidinyl, or pyridazinyl.

In certain embodiments of the substituent $R_4$, the hydrophobic group is a $C_1$-$C_{32}$ fluoroalkyl group or a $C_1$-$C_{32}$ fluoroaryl group. As used herein, the terms "fluoroalkyl" and "fluoroaryl" refer to any alkyl group or aryl group, respectively, with one or more fluorine atoms.

In certain embodiments, the nonionic associative monomer unit is derived from an acrylate monomer comprising an acrylate head group of Formula III:

III

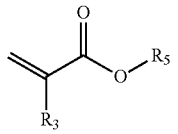

wherein $R_5$ is —$CH_2(CH_2)_pCH_3$, $R_3$ is H or $C_1$-$C_{10}$ alkyl (e.g., $(CH_2)_kCH_3$), wherein k is an integer from 0 to 9 (i.e., 0, 1, 2, 3, 4, 5, 6, 7, 8, or 9)), and p is an integer from 3 to 100 (e.g., from 4 to 50, from 6 to 50, from 8 to 50, from 10 to 50, from 12 to 50, from 16 to 50, or from 18 to 50. In some embodiments, the acrylate monomer of Formula III is a mixture of two or more such acrylates, such that the average (rounded to the nearest integer) value of p is an integer from 3 to 100 (e.g., from 4 to 50, from 6 to 50, from 8 to 50, from 10 to 50, from 12 to 50, from 16 to 50, or from 18 to 50). In some embodiments, "$C_1$-$C_{10}$ alkyl" refers to a branched $C_1$-$C_{10}$ alkyl group. In certain embodiments, $R_5$ is a branched alkyl group from 3 to 100 carbon units in length. Generally, the nonionic associative monomer is selected from laurylacrylate, cetylacrylate, stearylacrylate, behenylacrylate, or a combination thereof. In certain embodiments, the nonionic associative monomer unit is laurylacrylate, i.e., $R_3$=H and p=10.

In certain embodiments, the nonionic associative monomer unit is derived from an acrylate monomer comprising an acrylate head group of Formula IV:

IV

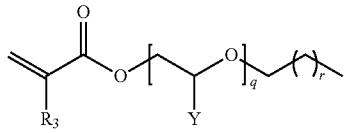

wherein $R_3$ is H or $C_1$-$C_{10}$ alkyl (e.g., $(CH_2)_kCH_3$), wherein k is an integer from 0 to 9 (i.e., 0, 1, 2, 3, 4, 5, 6, 7, 8, or 9), q is an integer from 2 to 100 (e.g., from 4 to 50, from 6 to 50, from 8 to 50, from 10 to 50, from 12 to 50, from 16 to 50, from 18 to 50, from 16 to 100, from 18 to 100, or from 50 to 100), r is an integer from 0 to 30 (e.g., from 2 to 30, from 4 to 30, from 6 to 30, from 8 to 30, from 10 to 30, from 12 to 30, from 16 to 30, from 18 to 30, from 20 to 30, from 22 to 30, or from 24 to 30), and each Y is independently H or $CH_3$. In some embodiments, "$C_1$-$C_{10}$ alkyl" refers to a branched $C_1$-$C_{10}$ alkyl group. In certain embodiments, each Y is independently selected to produce block or random copolymers of ethylene oxide ("EO"), propylene oxide ("PO"), or a combination thereof. In some embodiments, the acrylate monomer of Formula IV is a mixture of two or more such acrylates, such that the average (rounded to the nearest integer) value of q is an integer from 2 to 100, (e.g., from 4 to 50, from 6 to 50, from 8 to 50, from 10 to 50, from 12 to 50, from 16 to 50, from 18 to 50, from 16 to 100, from 18 to 100, or from 50 to 100), and the average (rounded to the nearest integer) value of r is an integer from 0 to 30 (e.g., from 2 to 30, from 4 to 30, from 6 to 30, from 8 to 30, from 10 to 30, from 12 to 30, from 16 to 30, from 18 to 30, from 20 to 30, from 22 to 30, or from 24 to 30). In some embodiments, the acrylate monomer of Formula IV is lauryl polyethoxy (25) methacrylate, cetyl polyethoxy (25) methacrylate, stearyl polyethoxy (25) methacrylate, behenyl polyethoxy (25) methacrylate, or a combination thereof. In certain embodiments, the nonionic associative monomer unit is a VISIOMER® ether methacrylate commercially available from Evonik Industries (Essen, Germany). In some embodiments, the nonionic associative monomer unit is cetyl and/or stearyl polyethoxy (25) methacrylic ester, marketed under the product name methacrylic ester (25 EO) C16-C18 fatty alcohol ("C18PEG1105MA"), commercially available from Evonik Industries (Essen, Germany).

In certain embodiments, the nonionic associative monomer unit is derived from an acrylate monomer comprising an acrylate head group of Formula V:

V

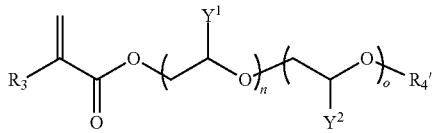

wherein $R_3$ is H or $C_1$-$C_{10}$ alkyl (e.g., $(CH_2)_kCH_3$), wherein k is an integer from 0 to 9 (i.e., 0, 1, 2, 3, 4, 5, 6, 7, 8, or 9), each $Y_1$ and $Y_2$ are independently H or $C_1$-$C_4$ alkyl (e.g., methyl, ethyl, n-propyl, iso-propyl, n-butyl, sec-butyl, or tert-butyl), and n and o are independently integers ranging from 0 to about 100 (e.g., from about 0 to about 90, from about 0 to about 80, from about 0 to about 70, from about 0 to about 60, from about 0 to about 50, from about 10 to about 100, or from about 10 to about 50), $R_4'$ is $C_8$-$C_{30}$ alkyl group (i.e., 8, 9, 10, 11, 12, 13, 14, 15, 16, 17, 18, 19, 20, 21, 22, 23, 24, 25, 26, 27, 28, 29, or 30 carbon units in length), wherein n and o cannot both be 0. In some embodiments, "$C_1$-$C_{10}$ alkyl" refers to a branched $C_1$-$C_{10}$ alkyl group. In certain embodiments, each $Y_1$ and $Y_2$ are independently selected to produce block or random copolymers of ethylene oxide ("EO"), propylene oxide ("PO"), or a combination thereof. In some embodiments, the acrylate monomer of Formula V is a mixture of two or more such acrylates, such that the average (rounded to the nearest integer) values of n and o are independently integers from 0 to 100, (e.g., from 0 to 50, from 6 to 50, from 8 to 50, from 10 to 50, from 12 to 50, from 16 to 50, from 18 to 50, from 16 to 100, from 18 to 100, or from 50 to 100). In certain embodiments, the acrylate monomer of Formula V contains a side chain derived from a Plurafac® surfactant, commercially available from BASF Corporation (Florham Park, N.J.).

In another embodiment, the associative monomer unit is a cationic associative monomer unit. Generally, the cationic associative monomer unit is derived from an acrylate salt monomer and/or an acrylamide salt monomer of Formula VI:

VI

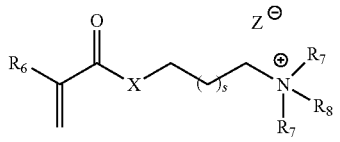

wherein $R_6$ and $R_7$ are each independently H or $C_1$-$C_{10}$ to alkyl (e.g., $(CH_2)_tCH_3$) wherein t is an integer from 0 to 9 (i.e., 0, 1, 2, 3, 4, 5, 6, 7, 8, or 9), X is O or NH, s is an integer from 0 to 20 (e.g., from 2 to 20, from 4 to 20, from 6 to 20, from 8 to 20, from 5 to 10, from 10 to 20, from 5 to 15, from 12 to 20, from 0 to 10, from 0 to 8, from 0 to 6, or from 0 to 4), Z is any anion, and $R_8$ is a hydrophobic group. In some embodiments, the acrylate and/or acrylamide salt of Formula VI is a mixture of two or more such acrylates and/or acrylamides, such that the average (rounded to the nearest integer) value of s is an integer from 0 to 20 (e.g., from 2 to 20, from 4 to 20, from 6 to 20, from 8 to 20, from 5 to 10, from 10 to 20, from 5 to 15, from 12 to 20, from 0 to 10, from 0 to 8, from 0 to 6, or from 0 to 4). In some embodiments, "$C_1$-$C_{10}$ alkyl" refers to a branched $C_1$-$C_{10}$ alkyl group. As used herein, the term "hydrophobic group" refers to an alkyl group, an aryl group, a fluoroalkyl group, or a fluoroaryl group.

In certain embodiments of the substituent $R_8$, the hydrophobic group is a $C_1$-$C_{32}$ alkyl group (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32 carbon units in length). In some embodiments, the $C_1$-$C_{32}$ alkyl group is saturated, unsaturated, branched, straight-chained, cyclic, or a combination thereof. An exemplary list of $C_1$-$C_{32}$ alkyl groups is methyl, ethyl, n-propyl, iso-propyl, n-butyl, sec-butyl, tert-butyl, n-pentyl, sec-pentyl, neo-pentyl, hexyl, heptyl, octyl, nonyl, lauryl, stearyl, cetyl, behenyl, cyclopentyl, cyclohexyl, propenyl, 2-butenyl, 3-butenyl, 2-pentenyl, 3-pentenyl, or 4-pentenyl. In certain embodiments, the $C_1$-$C_{32}$ alkyl group is further substituted with one or more alkyl substituents, aryl substituents, heteroatoms, or combinations thereof. In some embodiments, the $C_1$-$C_{32}$ alkyl group can be a $C_1$-$C_{32}$ heteroalkyl group (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32 carbon units in length). As used herein, "heteroalkyl group" refers to a saturated or unsaturated, substituted or unsubstituted, straight-chained, branched, or cyclic aliphatic chain that contains at least 1 heteroatom (e.g., O, S, N, and/or P) in the core of the molecule (i.e., the carbon backbone).

In certain embodiments of the substituent $R_8$, the hydrophobic group is an aryl group. The aryl group can be any substituted or unsubstituted aryl or heteroaryl group, wherein the heteroaryl group is an aromatic 5- or 6-membered monocyclic group, 9- or 10-membered bicyclic group, and 11- to 14-membered tricyclic group, which has at least one heteroatom (e.g., O, S, or N) in at least one of the rings. Each ring of the heteroaryl group containing a heteroatom can contain one or two oxygen or sulfur atoms and/or from one to four nitrogen atoms, provided that the total number of heteroatoms in each ring is four or less and each ring has at least one carbon atom. The fused rings completing the bicyclic and tricyclic groups may contain only carbon atoms and may be saturated, partially saturated, or unsaturated. The nitrogen, oxygen, and sulfur atoms optionally can be oxidized, and the nitrogen atoms optionally can be quaternized. Heteroaryl groups that are bicyclic or tricyclic must include at least one fully aromatic ring, but the other fused ring or rings can be aromatic or non-aromatic. In some embodiments, the aryl compound is phenyl, naphthyl, pyrrolyl, isoindolyl, indolizinyl, indolyl, furanyl, benzofuranyl, benzothiophenyl, thiophenyl, pyridyl, acridinyl, naphthyridinyl, quinolinyl, isoquinolinyl, isoxazolyl, oxazolyl, benzoxazolyl, isothiazolyl, thiazolyl, benzthiazolyl, imidazolyl, thiadiazolyl, tetrazolyl, triazolyl, oxadiazolyl, benzimidazolyl, purinyl, pyrazolyl, pyrazinyl, pteridinyl, quinoxalinyl, phthalazinyl, quinazolinyl, triazinyl, phenazinyl, cinnolinyl, pyrimidinyl, or pyridazinyl.

In certain embodiments of the substituent $R_8$, the hydrophobic group is a $C_1$-$C_{32}$ fluoroalkyl group or a $C_1$-$C_{32}$ fluoroaryl group. As used herein, the terms "fluoroalkyl" and "fluoroaryl" refer to any alkyl group or aryl group, respectively, with one or more fluorine atoms.

The ammonium salt of Formula VI can have any suitable anion counter ion (i.e., "Z"). In some embodiments, the anion counter ion ("Z") comprises an element selected from a halogen (e.g., fluoride, chloride, bromide, or iodide), sulfur, carbon, nitrogen, phosphorous, and a combination thereof. An exemplary list of anions comprises fluoride, chloride, bromide, iodide, sulfide, sulfite, sulfate, sulfonated, bisulfate, bisulfite, thiosulfate, carbonate, bicarbonate, nitrate, nitrite, phosphate, hydrogen phosphate, dihydrogen phosphate, phosphite, hydrogen phosphite, dihydrogen phosphite, hexafluorophosphate, carboxylate, acetate, mesylate, tosylate, or triflate. In certain embodiments, Z is selected from fluoride, chloride, bromide, mesylate, tosylate, or a combination thereof.

In certain embodiments, the cationic associative monomer unit is derived from an acrylamide salt monomer of Formula VII:

VII

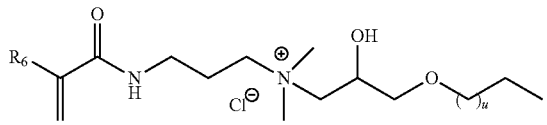

wherein $R_6$ is H or $C_1$-$C_{10}$ to alkyl (e.g., $(CH_2)_tCH_3$) wherein t is an integer from 0 to 9 (i.e., 0, 1, 2, 3, 4, 5, 6, 7, 8, or 9), and u is an integer from 0 to 30 (e.g., from 2 to 30, from 4 to 30, from 6 to 30, from 8 to 30, from 5 to 25, from 10 to 30, from 12 to 30, from 15 to 25, from 16 to 30, from 18 to 30, from 20 to 30, from 22 to 30, or from 24 to 30). In some embodiments, "$C_1$-$C_{10}$ alkyl" refers to a branched $C_1$-$C_{10}$ alkyl group. In some embodiments, the acrylamide salt of Formula VII is a mixture of two or more such acrylamides, such that the average (rounded to the nearest integer) value of u is an integer from 0 to 30 (e.g., from 2 to 30, from 4 to 30, from 6 to 30, from 8 to 30, from 5 to 25, from 10 to 30, from 12 to 30, from 15 to 25, from 16 to 30, from 18 to 30, from 20 to 30, from 22 to 30, or from 24 to 30). In certain embodiments, the acrylamide salt of Formula VII is "MAPTAC-C12 derivative" (i.e., where $R_6$ is $CH_3$ and u is 10).

In another embodiment, the associative monomer unit is an anionic associative monomer unit. Generally, the anionic associative monomer unit is derived from an acrylate and/or an acrylamide monomer of Formula VIII:

VIII

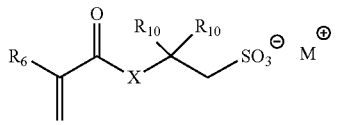

wherein $R_9$ is H or $C_1$-$C_{10}$ alkyl (e.g., $(CH_2)_vCH_3$) wherein v is an integer from 0 to 9 (i.e., 0, 1, 2, 3, 4, 5, 6, 7, 8, or 9), X is O or NH, M is any cation, and each $R_{10}$ is independently H or a hydrophobic group. In some embodiments, "$C_1$-$C_{10}$ alkyl" refers to a branched $C_1$-$C_{10}$ alkyl group. As used herein, the term "hydrophobic group" refers to an alkyl group, an aryl group, a fluoroalkyl group, or a fluoroaryl group.

In certain embodiments of the substituent $R_{10}$, the hydrophobic group is a $C_1$-$C_{32}$ alkyl group (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32 carbon units in length). In some embodiments, the $C_1$-$C_{32}$ alkyl group is saturated, unsaturated, branched, straight-chained, cyclic, or a combination thereof. An exemplary list of $C_1$-$C_{32}$ alkyl groups is methyl, ethyl, n-propyl, iso-propyl, n-butyl, sec-butyl, tert-butyl, n-pentyl, sec-pentyl, neo-pentyl, hexyl, heptyl, octyl, nonyl, lauryl, stearyl, cetyl, behenyl, cyclopentyl, cyclohexyl, propenyl, 2-butenyl, 3-butenyl, 2-pentenyl, 3-pentenyl, or 4-pentenyl. In certain embodiments, the $C_1$-$C_{32}$ alkyl group is further substituted with one or more alkyl substituents, aryl substituents, heteroatoms, or combinations thereof. In some embodiments, the $C_1$-$C_{32}$ alkyl group can be a $C_1$-$C_{32}$ heteroalkyl group (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, or 32 carbon units in length). As used herein, "heteroalkyl group" refers to a saturated or unsaturated, substituted or unsubstituted, straight-chained, branched, or cyclic aliphatic group that contains at least 1 heteroatom (e.g., O, S, N, and/or P) in the core of the molecule (i.e., the carbon backbone).

In certain embodiments of the substituent $R_{10}$, the hydrophobic group is an aryl group. The aryl group can be any substituted or unsubstituted aryl or heteroaryl group, wherein the heteroaryl group is an aromatic 5- or 6-membered monocyclic group, 9- or 10-membered bicyclic group, and 11- to 14-membered tricyclic group, which has at least one heteroatom (e.g., O, S, or N) in at least one of the rings. Each ring of the heteroaryl group containing a heteroatom can contain one or two oxygen or sulfur atoms and/or from one to four nitrogen atoms, provided that the total number of heteroatoms in each ring is four or less and each ring has at least one carbon atom. The fused rings completing the bicyclic and tricyclic groups may contain only carbon atoms and may be saturated, partially saturated, or unsaturated. The nitrogen, oxygen, and sulfur atoms optionally can be oxidized, and the nitrogen atoms optionally can be quaternized. Heteroaryl groups that are bicyclic or tricyclic must include at least one fully aromatic ring, but the other fused ring or rings can be aromatic or non-aromatic. In some embodiments, the aryl compound is phenyl, naphthyl, pyrrolyl, isoindolyl, indolizinyl, indolyl, furanyl, benzofuranyl, benzothiophenyl, thiophenyl, pyridyl, acridinyl, naphthyridinyl, quinolinyl, isoquinolinyl, isoxazolyl, oxazolyl, benzoxazolyl, isothiazolyl, thiazolyl, benzthiazolyl, imidazolyl, thiadiazolyl, tetrazolyl, triazolyl, oxadiazolyl, benzimidazolyl, purinyl, pyrazolyl, pyrazinyl, pteridinyl, quinoxalinyl, phthalazinyl, quinazolinyl, triazinyl, phenazinyl, cinnolinyl, pyrimidinyl, or pyridazinyl.

In certain embodiments of the substituent $R_{10}$, the hydrophobic group is a $C_1$-$C_{32}$ fluoroalkyl group or a $C_1$-$C_{32}$ fluoroaryl group. As used herein, the terms "fluoroalkyl" and "fluoroaryl" refer to any alkyl group or aryl group, respectively, with one or more fluorine atoms.

The sulfonate salt can have any suitable cation counter ion (i.e., "M"). For example, the cation counter ion ("M") can be a proton, ammonium, a quaternary amine, a cation of an alkali metal, a cation of an alkaline earth metal, a cation of a transition metal, a cation of a rare-earth metal, a main group element cation, or a combination thereof. In some embodiments, the cation counter ion is a proton or a cation of lithium, sodium, potassium, magnesium, calcium, manganese, iron, zinc, or a combination thereof. In certain embodiments, M is selected from hydrogen, lithium, sodium, potassium, or a combination thereof.

The one or more associative monomer unit(s) can be present in the associative polymer (e.g., polymer strength aid) in any suitable amount. The associative polymer can comprise a sum total of about 10 mol % or less of the one or more associative monomer unit(s), for example, about 9 mol % or less, about 8 mol % or less, about 7 mol % or less, about 6 mol % or less, about 5 mol % or less, about 4 mol % or less, about 3 mol % or less, about 2 mol % or less, or about 1 mol % or less. Alternatively, or in addition to, the associative polymer can comprise about 0.005 mol % or more of the one or more associative monomer unit(s), for example, about 0.01 mol % or more, about 0.1 mol % or more, about 0.25 mol % or more, about 0.3 mol % or more, about 0.4 mol % or more, or about 0.5 mol % or more. Thus, the associative polymer can comprise the one or more associative monomer unit(s) in a concentration bounded by any two of the aforementioned endpoints. The associative polymer can comprise from about 0.005 mol % to about 10 mol % of the one or more associative monomer unit(s), for example, from about 0.005 mol % to about 9 mol %, from about 0.005 mol % to about 8 mol %, from about 0.005 mol % to about 7 mol %, from about 0.005 mol % to about 6 mol %, from about 0.005 mol % to about 5 mol %, from about 0.005 mol % to about 4 mol %, from about 0.005 mol % to about 3 mol %, from about 0.005 mol % to about 2 mol %, from about 0.005 mol % to about 1 mol %, from about 0.01 mol % to about 1 mol %, from about 0.1 mol % to about 1 mol %, from about 0.25 mol % to about 1 mol %, from about 0.3 mol % to about 1 mol %, from about 0.4 mol % to about 1 mol %, from about 0.5 mol % to about 1.0 mol %, from about 0.01 mol % to about 0.5 mol %, or from about 0.01 mol % to about 0.25 mol %.

In some embodiments, the associative polymer (e.g., polymer strength aid) comprises an associative monomer unit derived from a monomer of Formula II, a monomer unit derived from a monomer of Formula I, and an additional cationic monomer unit. In some embodiments, the associative polymer (e.g., polymer strength aid)(s) comprises an associative monomer unit derived from a monomer of Formula II, a monomer unit derived from a monomer of Formula I, and an additional monomer unit derived from DMAEA.MCQ. In some embodiments, the associative polymer (e.g., polymer strength aid) comprises an associative monomer unit derived from a monomer of Formula II, an additional monomer unit derived from acrylamide, and an additional monomer unit derived from DMAEA.MCQ. In certain embodiments, the associative polymer (e.g., polymer strength aid) comprises an associative monomer unit derived from VISIOMER® monomer C18PEG1105MA, an additional monomer unit derived from acrylamide, and an additional monomer unit derived from DMAEA.MCQ.

In some embodiments, the associative polymer (e.g., polymer strength aid) comprises an associative monomer unit derived from a monomer of Formula II, a monomer unit derived from a monomer of Formula I, and an additional anionic monomer unit. In some embodiments, the associative polymer (e.g., polymer strength aid) comprises an associative monomer unit derived from a monomer of Formula II, a monomer unit derived from a monomer of Formula I, and an additional monomer unit derived from sodium acrylate. In some embodiments, the associative polymer (e.g., polymer strength aid) comprises an associative monomer unit derived from a monomer of Formula II, an additional monomer unit derived from acrylamide, and an additional monomer unit derived from sodium acrylate. In certain embodiments, the associative polymer (e.g., polymer strength aid) comprises an associative monomer unit derived from VISIOMER® monomer C18PEG1105MA, an additional monomer unit derived from acrylamide, and an additional monomer unit derived from sodium acrylate.

In some embodiments, the associative polymer (e.g., polymer strength aid) comprises an associative monomer unit derived from a monomer of Formula VI, a monomer unit derived from a monomer of Formula I, and an additional cationic monomer unit. In some embodiments, the associative polymer (e.g., polymer strength aid) comprises an associative monomer unit derived from a monomer of Formula VI, a monomer unit derived from a monomer of Formula I, and an additional monomer unit derived from DMAEA.MCQ. In some embodiments, the associative polymer (e.g., polymer strength aid) comprises an associative monomer unit derived from a monomer of Formula VI, an additional monomer unit derived from acrylamide, and an additional monomer unit derived from DMAEA.MCQ. In certain embodiments, the associative polymer (e.g., polymer strength aid) comprises an associative monomer unit derived from MAPTAC-C12 derivative of Formula VII, an additional monomer unit derived from acrylamide, and an additional monomer unit derived from DMAEA.MCQ.

In some embodiments, the associative polymer (e.g., polymer strength aid) comprises an associative monomer unit derived from a monomer of Formula VI, a monomer unit derived from a monomer of Formula I, and an additional anionic monomer unit. In some embodiments, the associative polymer (e.g., polymer strength aid) comprises an associative monomer unit derived from a monomer of Formula VI, a monomer unit derived from a monomer of Formula I, and an additional monomer unit derived from sodium acrylate. In some embodiments, the associative polymer (e.g., polymer strength aid) comprises an associative monomer unit derived from a monomer of Formula VI, an additional monomer unit derived from acrylamide, and an additional monomer unit derived from sodium acrylate. In certain embodiments, the associative polymer (e.g., polymer strength aid) comprises an associative monomer unit derived from MAPTAC-C12 derivative of Formula VII, an additional monomer unit derived from acrylamide, and an additional monomer unit derived from sodium acrylate.

In some embodiments, the associative polymer (e.g., polymer strength aid) comprises an associative monomer unit derived from a monomer of Formula VIII, a monomer unit derived from a monomer of Formula I, and an additional cationic monomer unit. In some embodiments, the associative polymer (e.g., polymer strength aid) comprises an associative monomer unit derived from a monomer of Formula VIII, a monomer unit derived from a monomer of Formula I, and an additional monomer unit derived from DMAEA.MCQ.

In some embodiments, the associative polymer (e.g., polymer strength aid) comprises an associative monomer unit derived from a monomer of Formula VIII, a monomer unit derived from a monomer of Formula I, and an additional anionic monomer unit. In some embodiments, the associative polymer (e.g., polymer strength aid) comprises an associative monomer unit derived from a monomer of Formula VIII, a monomer unit derived from a monomer of Formula I, and an additional monomer unit derived from sodium acrylate.

In some embodiments, the associative polymer (e.g., polymer strength aid) is of Formula $AP_1$:

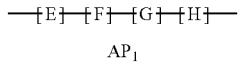

$AP_1$ wherein E is one or more associative monomer unit(s), F is one or more additional monomer unit(s), G is one or more monomer unit(s) derived from a monomer of Formula I, H is optionally present and is one or more piperidine-2,6-dione unit(s), wherein the one or more piperidine-2,6-dione(s) are formed upon cyclization of an acrylamide nitrogen of the monomer unit derived from the monomer of Formula I ("G") on a carbonyl of the additional monomer unit ("F"), wherein the associative polymer has a weight average molecular weight of from about 10 kDa to about 2,000 kDa.

In some embodiments, the associative polymer (e.g., polymer strength aid) is of formula $AP_2$:

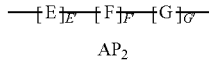

$AP_2$ wherein E is one or more associative monomer unit(s), E' is a mole percentage value of from about 0.005 to about 10, F is one or more additional monomer unit(s), F' is a mole percentage value of from about 0.005 to about 90, G is one or more monomer unit(s) derived from a monomer of Formula I, and G' is a mole percentage value of from about 10 to about 99.99. Monomer unit E is defined by the associative monomer units described herein. Monomer units F and G are defined by the additional monomer units and monomer units derived from the monomer of Formula I, respectively, described herein.

As described herein, the associative polymer (e.g., polymer strength aid) of formula $AP_2$ can exist as an alternating polymer, random polymer, block polymer, graft polymer, linear polymer, branched polymer, cyclic polymer, or a combination thereof. Thus, E, F, and G can exist in any suitable order (e.g., EGF, EFG, GEF, GFE, FEG, or FGE), including repeating individual units (e.g., EEFFFGG, EFGGEFEE, EFGEEE, EEEEFG, etc.).

The amount of one or more associative monomer unit(s) ("E'"), and the sum total of one or more additional monomer unit(s) ("F'"+"G'") are as described previously for the one or more associative monomer unit(s) and the sum total of one or more additional monomer unit(s).

In some embodiments, the associative polymer (e.g., polymer strength aid) of formula $AP_2$ undergoes charge degradation to provide an associative polymer (e.g., polymer strength aid) of formula $AP_3$:

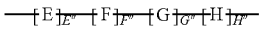

$AP_3$ wherein E is one or more associative monomer unit(s), E" is a mole percentage value of from about 0.005 to about 10, F is one or more additional monomer unit(s), F" is a mole percentage value of from about 0.005 to about 90, G is one or more monomer unit(s) derived from a monomer of Formula I, G" is a mole percentage value of from about 10 to about 99.99, H is one or more piperidine-2,6-dione unit(s), wherein the one or more piperidine-2,6-dione(s) are formed upon cyclization of an acrylamide nitrogen of the monomer unit derived from a monomer of Formula I ("G") on a carbonyl of the additional monomer unit ("F"), and H" is a mole percentage value of from about 0 (i.e., trace amounts) to about 10. As used herein, "charge degradation" refers to the process of a monomer unit derived from a monomer of Formula I cyclizing on a charged additional monomer unit (i.e., a cationic and/or anionic monomer unit), such that the charged substituent of the additional monomer unit is displaced, and thus, the polymer has less cationic monomer units and/or less anionic monomer units. Without wishing to be bound by any particular theory, it is believed that the charge degradation can occur spontaneously, or can be facilitated by one or more components in the polymer solution.

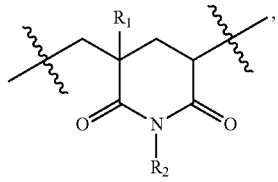

wherein $R_1$ is H or $C_1$-$C_4$ alkyl (e.g., methyl, ethyl, n-propyl, iso-propyl, n-butyl, sec-butyl, or tert-butyl) and $R_2$ is H or an organic group, and H" is a mole percentage value of from about 0 (i.e., trace amounts) to about 10. In certain embodiments, $R_1$ and $R_2$ are hydrogen.

As described herein, the associative polymer (e.g., polymer strength aid) of formula $AP_3$ can exist as an alternating polymer, random polymer, block polymer, graft polymer, linear polymer, branched polymer, cyclic polymer, or a combination thereof. Thus, E, F, G, and H can exist in any suitable order (e.g., EGFH, EGHF, EHFG, EHGF, EFGH, EFHG, FEGH, FEHG, FHEG, FHGE, FGEH, FGHE, GHFE, GHEF, GEFH, GEHF, GFHE, GFEH, HEFG, HEGF, HGEF, HGFE, HFEG, or HFGE), including repeating individual units (e.g., EEFFFGGHHH, EFGGEFEEH, EFGEEEHH, HHHEEEEFG, etc.).

In certain embodiments, the associative polymer (e.g., polymer strength aid) is of formula $AP_4$:

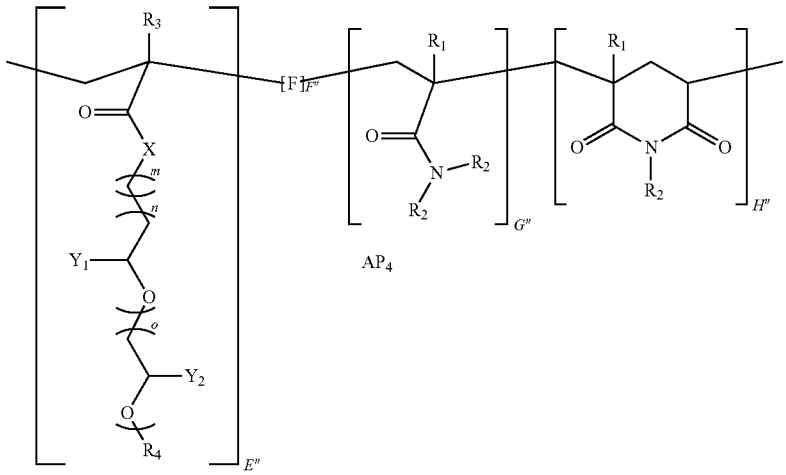

$AP_4$

In certain embodiments, the associative polymer (e.g., polymer strength aid) is of formula $AP_3$:

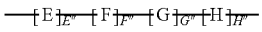

$AP_3$ wherein E is one or more associative monomer unit(s), E" is a mole percentage value of from about 0.005 to about 10, F is one or more additional monomer unit(s), F" is a mole percentage value of from about 0.005 to about 90, G is one or more monomer unit(s) derived from a monomer of Formula I, G" is a mole percentage value of from about 10 to about 99.99, H is one or more units of the formula wherein each $R_1$ is independently H or $C_1$-$C_4$ alkyl (e.g., methyl, ethyl, n-propyl, iso-propyl, n-butyl, sec-butyl, or tert-butyl), each $R_2$ is independently H or an organic group, $R_3$ is H or $C_1$-$C_{10}$ alkyl (e.g., $(CH_2)_kCH_3$), wherein k is an integer from 0 to 9 (i.e., 0, 1, 2, 3, 4, 5, 6, 7, 8, or 9), X is O or NH, m, n, and o are independently integers from 0 to 100, wherein when $(n+o)\leq 3$, m is at least 7, each $Y_1$ and $Y_2$ are independently H or $C_1$-$C_4$ alkyl (e.g., methyl, ethyl, n-propyl, iso-propyl, n-butyl, sec-butyl, or tert-butyl), and $R_4$ is H or a hydrophobic group, E" is a mole percentage value of from about 0.005 to about 10, F is one or more additional monomer unit(s), F" is a mole percentage value of from about 0.005 to about 90, G" is a mole percentage value of from about 10 to about 99.99, and H" is a mole percentage value of from about 0 (i.e., trace amounts) to about 10. In some embodiments, "$C_1$-$C_{10}$ alkyl" refers to a branched $C_1$-$C_{10}$ alkyl group.

In certain embodiments of the associative polymer (e.g., polymer strength aid) of formula $AP_4$, F is derived from a diallyldimethylammonium chloride ("DADMAC") monomer. In certain embodiments of the associative polymer of formula $AP_4$, F is derived from a 2-(acryloyloxy)-N,N,N-trimethylethanaminium chloride ("DMAEA.MCQ") monomer.

In certain embodiments, the associative polymer (e.g., polymer strength aid) is of formula $AP_5$:

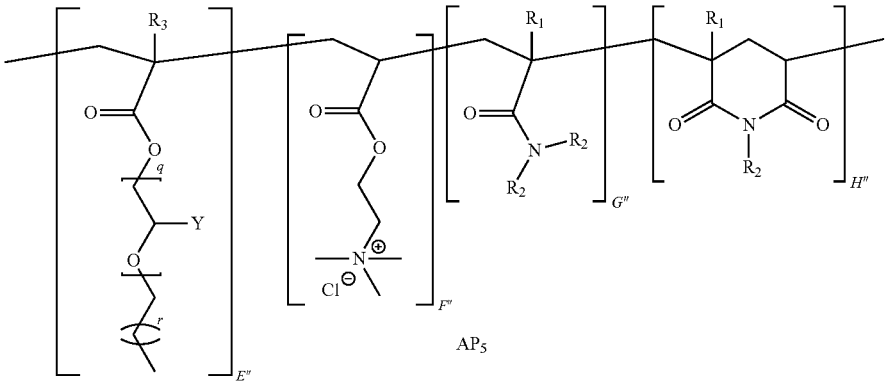

$AP_5$ wherein each $R_1$ is independently H or $C_1$-$C_4$ alkyl (e.g., methyl, ethyl, n-propyl, iso-propyl, n-butyl, sec-butyl, or tert-butyl), each $R_2$ is independently H or an organic group, $R_3$ is H or $C_1$-$C_{10}$ alkyl (e.g., $(CH_2)_kCH_3$), wherein k is an integer from 0 to 9, q is an integer from 2 to 100, r is an integer from 0 to 30, each Y is independently H or $CH_3$, E" is a mole percentage value of from about 0.005 to about 10, F" is a mole percentage value of from about 0.005 to about 90, G" is a mole percentage value of from about 10 to about 99.99, and H" is a mole percentage value of from about 0 (i.e., trace amounts) to about 10. In some embodiments, "$C_1$-$C_{10}$ alkyl" refers to a branched $C_1$-$C_{10}$ alkyl group.

In certain embodiments, the associative polymer (e.g., polymer strength aid) is of formula $AP_6$:

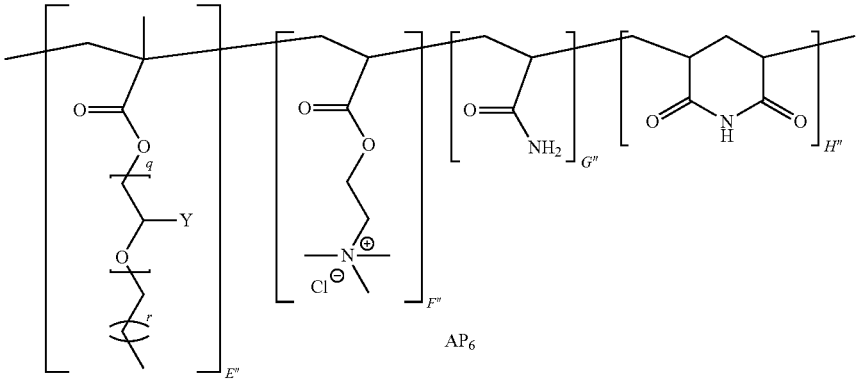

$AP_6$ wherein r is an integer from 0 to 30 (e.g., from 2 to 30, from 4 to 30, from 6 to 30, from 8 to 30, from 10 to 30, from 12 to 30, from 16 to 30, from 18 to 30, from 20 to 30, from 22 to 30, or from 24 to 30), each Y is independently H or $CH_3$, E" is a mole percentage value of from about 0.005 to about 10, F" is a mole percentage value of from about 0.005 to about 90, G" is a mole percentage value of from about 10 to about 99.99, and H" is a mole percentage value of from about 0 (i.e., trace amounts) to about 10. In certain embodiments, r is an integer from 14 to 16.

In certain embodiments, the associative polymer (e.g., polymer strength aid) is of formula $AP_7$:

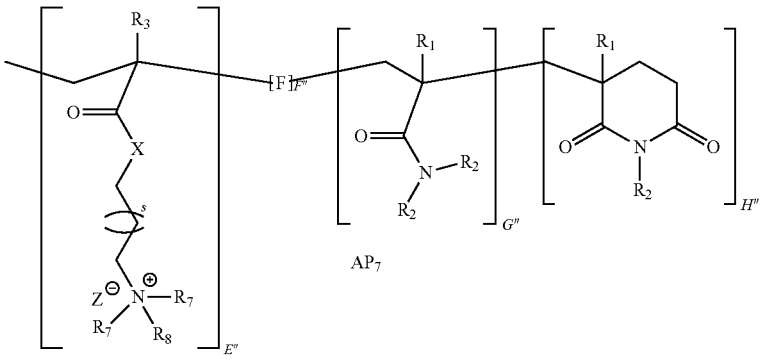

$AP_7$ wherein each $R_1$ is independently H or $C_1$-$C_4$ alkyl (e.g., methyl, ethyl, n-propyl, iso-propyl, n-butyl, sec-butyl, or tert-butyl), each $R_2$ is independently H or an organic group, $R_6$ and $R_7$ are each independently H or $C_1$-$C_{10}$ alkyl (e.g., $(CH_2)_tCH_3$) wherein t is an integer from 0 to 9, X is O or NH, s is an integer from 0 to 20, Z is any anion, and $R_8$ is a hydrophobic group, E" is a mole percentage value of from about 0.005 to about 10, F is one or more additional monomer unit(s), F" is a mole percentage value of from about 0.005 to about 90, G" is a mole percentage value of from about 10 to about 99.99, and H" is a mole percentage value of from about 0 (i.e., trace amounts) to about 10. In some embodiments, "$C_1$-$C_{10}$ alkyl" refers to a branched $C_1$-$C_{10}$ to alkyl group.

In certain embodiments, the associative polymer (e.g., polymer strength aid) is of formula $AP_8$:

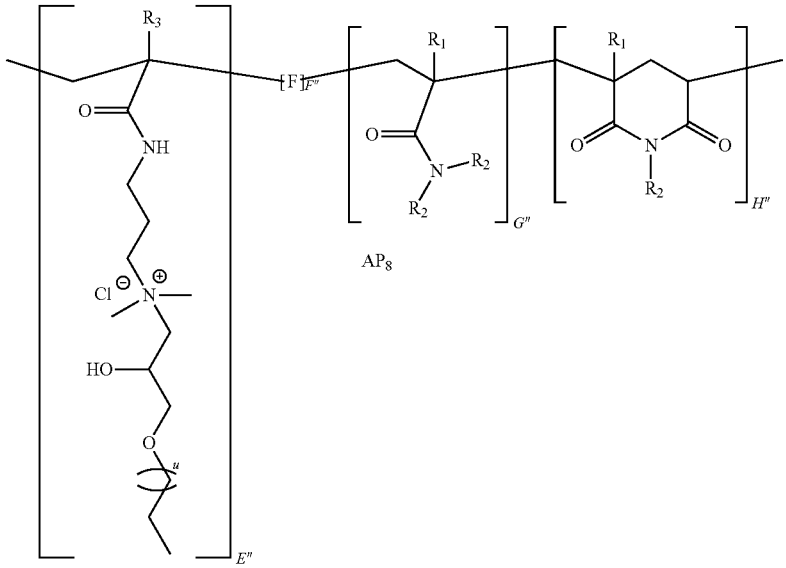

$AP_8$ wherein each $R_1$ is independently H or $C_1$-$C_4$ alkyl (e.g., methyl, ethyl, n-propyl, iso-propyl, n-butyl, sec-butyl, or tert-butyl), each $R_2$ is independently H or an organic group, $R_6$ is H or $C_1$-$C_{10}$ alkyl (e.g., $(CH_2)_tCH_3$) wherein t is an integer from 0 to 9, and u is an integer from 0 to 30, E" is a mole percentage value of from about 0.005 to about 10, F" is a mole percentage value of from about 0.005 to about 90, G" is a mole percentage value of from about 10 to about 99.99, and H" is a mole percentage value of from about 0 (i.e., trace amounts) to about 10. In some embodiments, "$C_1$-$C_{10}$ alkyl" refers to a branched $C_1$-$C_{10}$ alkyl group.

In certain embodiments, the associative polymer (e.g., polymer strength aid) is of formula $AP_9$:

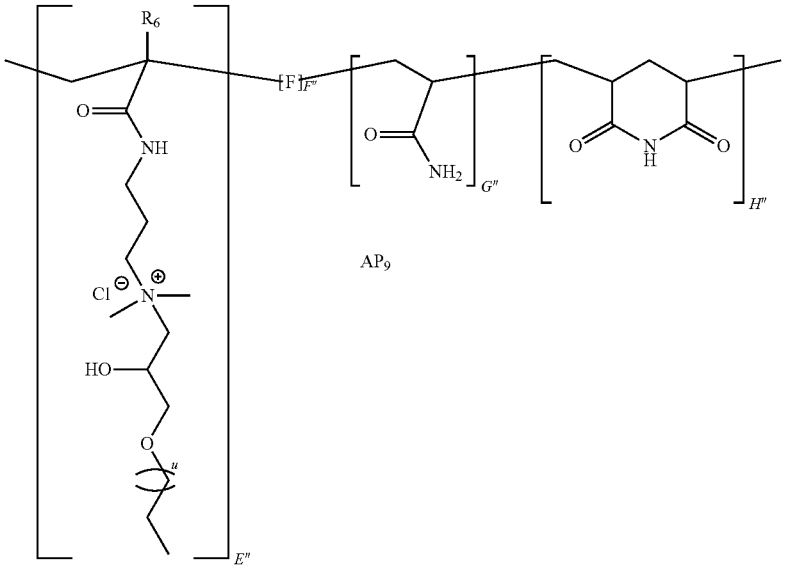

$AP_9$ wherein $R_6$ is H or $C_1$-$C_{10}$ to alkyl (e.g., $(CH_2)_tCH_3$) wherein t is an integer from 0 to 9, and u is an integer from 0 to 30, E" is a mole percentage value of from about 0.005 to about 10, F" is a mole percentage value of from about 0.005 to about 90, G" is a mole percentage value of from about 10 to about 99.99, and H" is a mole percentage value of from about 0 (i.e., trace amounts) to about 10. In some embodiments, "$C_1$-$C_{10}$ alkyl" refers to a branched $C_1$-$C_{10}$ alkyl group.

In certain embodiments of the associative polymer (e.g., polymer strength aid)s of formula $AP_{7-9}$ (i.e., $AP_7$, $AP_8$, or $AP_9$), F is derived from one or more monomers selected from acrylic acid, methacrylic acid, or salts thereof.

In certain embodiments, the associative polymer (e.g., polymer strength aid) is of formula $AP_{10}$:

$AP_{10}$

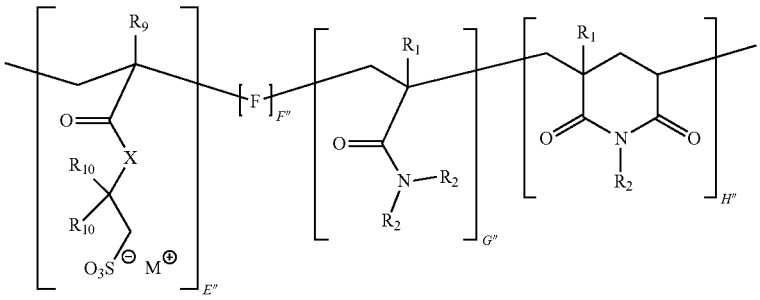

wherein each $R_1$ is independently H or $C_1$-$C_4$ alkyl (e.g., methyl, ethyl, n-propyl, iso-propyl, n-butyl, sec-butyl, or tert-butyl), each $R_2$ is independently H or an organic group, $R_9$ is H or $C_1$-$C_{10}$ alkyl (e.g., $(CH_2)_vCH_3$) wherein v is an integer from 0 to 9, X is O or NH, M is any cation, and each $R_{10}$ is independently H or a hydrophobic group, E" is a mole percentage value of from about 0.005 to about 10, F is one or more additional monomer unit(s), F" is a mole percentage value of from about 0.005 to about 90, G" is a mole percentage value of from about 10 to about 99.99, and H" is a mole percentage value of from about 0 (i.e., trace amounts) to about 10. In some embodiments, "$C_1$-$C_{10}$ alkyl" refers to a branched $C_1$-$C_{10}$ alkyl group.

In certain embodiments, the associative polymer (e.g., polymer strength aid) is of formula $AP_{11}$:

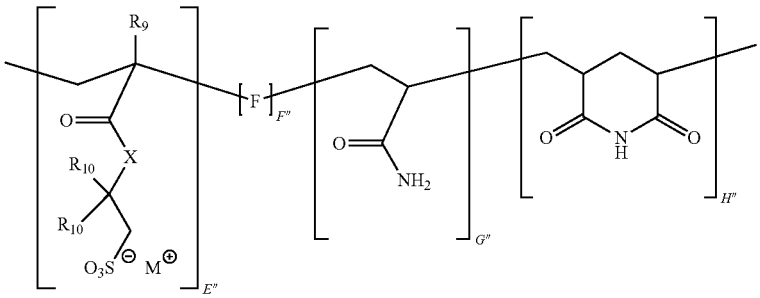

$AP_{11}$ wherein $R_9$ is H or $C_1$-$C_{10}$ alkyl (e.g., $(CH_2)_vCH_3$) wherein v is an integer from 0 to 9, X is O or NH, M is any cation, and each $R_{10}$ is independently H or a hydrophobic group, E" is a mole percentage value of from about 0.005 to about 10, F is one or more additional monomer unit(s), F" is a mole percentage value of from about 0.005 to about 90, G" is a mole percentage value of from about 10 to about 99.99, and H" is a mole percentage value of from about 0 (i.e., trace amounts) to about 10. In some embodiments, "$C_1$-$C_{10}$ alkyl" refers to a branched $C_1$-$C_{10}$ alkyl group.

As described herein, the associative polymer (e.g., polymer strength aid)s of formula $AP_4$-$AP_{11}$ (i.e., $AP_4$, $AP_5$, $AP_6$, $AP_7$, $AP_8$, $AP_9$, $AP_{10}$, or $AP_{11}$) can exist as an alternating polymer, random polymer, block polymer, graft polymer, linear polymer, branched polymer, cyclic polymer, or a combination thereof. Thus, the monomer units can exist in any suitable order, including repeating individual units.

The presence of the monomer unit H can be detected by any suitable method. In some embodiments, monomer H is detected by $^{13}$CNMR, $^{1}$HNMR, IR spectroscopy, or a combination thereof.

The abundance of the monomer unit H can be determined by any suitable method. In some embodiments, the abundance of the monomer unit H can be determined by relative comparison of the peak integrations of a $^{13}$CNMR spectrum, $^{1}$HNMR spectrum, IR spectrum, or a combination thereof.

In some embodiments of the associative polymer (e.g., polymer strength aid)s of formula $AP_{3-11}$ (i.e., $AP_3$, $AP_4$, $AP_5$, $AP_6$, $AP_7$, $AP_8$, $AP_9$, $AP_{10}$, or $AP_{11}$), E" is from about 0.005 mol % to about 10 mol % (e.g., from about 0.005 mol % to about 9 mol %, from about 0.005 mol % to about 8 mol %, from about 0.005 mol % to about 7 mol %, from about 0.005 mol % to about 6 mol %, from about 0.005 mol % to about 5 mol %, from about 0.005 mol % to about 4 mol %, from about 0.005 mol % to about 3 mol %, or from about 0.005 mol % to about 2 mol %), F" is from about 0.005 mol % to about 90 mol % (e.g., from about 0.005 mol % to about 80 mol %, from about 0.005 mol % to about 70 mol %, from about 0.005 mol % to about 60 mol %, from about 0.005 mol % to about 50 mol %, from about 0.005 mol % to about 40 mol %, from about 0.005 mol % to about 35 mol %, from about 0.005 mol % to about 30 mol %, from about 0.005 mol % to about 25 mol %, from about 0.005 mol % to about 20 mol %, from about 0.005 mol % to about 16 mol %, from about 0.005 mol % to about 12 mol %, from about 0.005 mol % to about 10 mol %, from about 2 mol % to about 20 mol %, from about 4 mol % to about 20 mol %, from about 6 mol % to about 20 mol %, from about 4 mol % to about 16 mol %, from about 4 mol % to about 12 mol %, or from about 4 mol % to about 10 mol %), G" is from about 10 mol % to about 99.99 mol % (e.g., from about 10 mol % to about 99.99 mol %, from about 20 mol % to about 99.99 mol %, from about 30 mol % to about 99.99 mol %, from about 40 mol % to about 99.99 mol %, from about 50 mol % to about 99.99 mol %, from about 60 mol % to about 99.99 mol %, from about 70 mol % to about 99.99 mol %, from about 80 mol % to about 99.99 mol %, from about 80 mol % to about 99.95 mol %, from about 80 mol % to about 99.9 mol %, from about 80 mol % to about 99.5 mol %, from about 80 mol % to about 99 mol %, from about 80 mol % to about 97 mol %, from about 80 mol % to about 95 mol %, from about 80 mol % to about 92 mol %, from about 80 mol % to about 90 mol %, from about 84 mol % to about 99 mol %, from about 84 mol % to about 94 mol %, from about 84 mol % to about 95 mol %, from about 84 mol % to about 92 mol %, or from about 84 mol % to about 90 mol %), and H" is from about 0 mol % (i.e., trace amounts) to about 10 mol % (e.g., from about 0.001 mol % to about 10 mol %, from about 0.001 mol % to about 9 mol %, from about 0.001 mol % to about 8 mol %, from about 0.001 mol % to about 7 mol %, from about 0.001 mol % to about 6 mol %, from about 0.001 mol % to about 5 mol %, from about 0.001 mol % to about 4 mol %, from about 0.001 mol % to about 3 mol %, or from about 0.001 mol % to about 2 mol %).

In certain embodiments of the associative polymer (e.g., polymer strength aid)s of formula ($AP_{3-11}$) (i.e., $AP_3$, $AP_4$, $AP_5$, $AP_6$, $AP_7$, $AP_8$, $AP_9$, $AP_{10}$, or $AP_{11}$), E" is from about 0.005 mol % to about 1 mol % (e.g., from about 0.01 mol % to about 1 mol %, from about 0.1 mol % to about 1 mol %, from about 0.25 mol % to about 1 mol %, from about 0.3 mol % to about 1 mol %, from about 0.4 mol % to about 1 mol %, from about 0.5 mol % to about 1.0 mol %, from about 0.01 mol % to about 0.5 mol %, or from about 0.01 mol % to about 0.25 mol %), F" is from about 4 mol % to about 10 mol % (e.g., from about 4 mol % to about 9 mol %, from about 4 mol % to about 8 mol %, from about 4 mol % to about 7 mol %, from about 4 mol % to about 6 mol %, from about 4 mol % to about 5 mol %, from about 5 mol % to about 10 mol %, from about 6 mol % to about 10 mol %, from about 7 mol % to about 10 mol %, from about 8 mol % to about 10 mol %, from about 9 mol % to about 10 mol %, or from about 6 mol % to about 8 mol %), G" is from about 84 mol % to about 90 mol % (e.g., from about 85 mol % to about 90 mol %, from about 86 mol % to about 90 mol %, from about 87 mol % to about 90 mol %, from about 88 mol % to about 90 mol %, from about 89 mol % to about 90 mol %, from about 84 mol % to about 89 mol %, from about 84 mol % to about 88 mol %, from about 84 mol % to about 87 mol %, from about 84 mol % to about 86 mol %, from about 84 mol % to about 85 mol %, or from about 86 mol % to about 88 mol %), and H" is from about 0 mol % (i.e., trace amounts) to about 6 mol % (e.g., from about 0.001 mol % to about 5 mol %, from about 0.001 mol % to about 4 mol %, from about 0.001 mol % to about 3 mol %, or from about 0.001 mol % to about 2 mol %, from about 0.001 mol % to about 1 mol %, from about 0.01 mol % to about 1 mol %, from about 0.1 mol % to about 1 mol %, from about 0.25 mol % to about 1 mol %, from about 0.3 mol % to about 1 mol %, from about 0.4 mol % to about 1 mol %, from about 0.5 mol % to about 1.0 mol %, from about 0.01 mol % to about 0.5 mol %, or from about 0.01 mol % to about 0.25 mol %).

In some embodiments, the process for making the powder comprises networking one or more associative polymer (e.g., polymer strength aid)(s). As used herein, "networking" refers to chemical coordination of one polymer chain to an adjacent polymer chain to promote a different physical property. The networking technique can comprise any suitable chemical coordination. Generally, the networking of one or more associative polymer(s) does not comprise covalently linking adjacent polymer chains. For example, the chemical coordination can occur through ionic bonding, hydrogen bonding, hydrophobic interactions, dipolar interactions, Van der Waals forces, or a combination thereof.

In an embodiment, at least a portion of the networking occurs between the associative monomer units of different polymer chains (i.e., intermolecular interactions). Without wishing to be bound by any particular theory, it is believed that associative monomer units interact momentarily through weak chemical interactions (i.e., ionic bonding, hydrogen bonding, hydrophobic interactions, dipolar interactions, Van der Waals forces, or a combination thereof), resulting in networking adjacent associative polymer (e.g., polymer strength aid)(s) temporarily. As used herein, "networking adjacent associative polymer(s) temporarily" refers to an interaction, which can be controlled by the level of dilution, the presence of a surfactant, or a combination thereof. Thus, the networking of associative polymer(s) is reversible, thereby allowing for powders, gels, or low viscosity liquid media to be prepared and/or subsequently dispersed in a solvent.

In another embodiment, at least a portion of the networking occurs between the associative monomer units and one or more surfactant(s). Without wishing to be bound by any particular theory, it is believed that associative monomer units can interact momentarily through weak chemical interactions (i.e., ionic bonding, hydrogen bonding, hydrophobic interactions, dipolar interactions, Van der Waals forces, or a combination thereof) with the one or more surfactant(s), resulting in networking the associative polymer (e.g., polymer strength aid)(s) and surfactant(s) temporarily. As used herein, "networking adjacent associative polymer(s) and surfactant(s) temporarily" refers to an interaction, which can be controlled by the level of dilution, the amount of a surfactant, or a combination thereof. Thus, the networking of associative polymer(s) and surfactant(s) is reversible, and allows for powder, gels, or low viscosity liquid media to be prepared and/or subsequently dispersed in a solvent.

In some embodiments, at least a portion of the networking occurs through micellar copolymerization. As used herein, "micellar copolymerization" refers to concurrent formation of micelles comprising associative monomers and/or surfactant(s), and associative polymer(s) comprising associative monomer units. Without wishing to be bound by any particular theory, it is believed that associative monomer units of adjacent polymers can become incorporated into micelles formed from associative monomers and/or surfactant(s), thereby networking the adjacent associative polymer (e.g., polymer strength aid)(s) temporarily.

As used herein, "temporary networking" refers to an associative interaction (e.g., within the solution of associative polymer (e.g., polymer strength aid)(s), the wet gel, and the powder) which can be controlled by the level of dilution, the presence of a surfactant, or a combination thereof. Contrary to more permanent cross-linking practice known in the art, e.g., cross-linking via covalent bonds, temporary networking can be momentary. As used herein, "temporary" can refer to any length of time extending from the initial formation of the solution of associative polymer(s) to dispersion of the powder in solution. For example, temporary networking provides sufficient structure of the wet gel to allow for machine processing and conversion into a powder. In addition, temporary networking helps to produce a powder that is stable yet maintains reasonable levels of water solubility. Upon dilution in water, the associative interactions (i.e., the temporary networking) decrease, and the powder becomes dispersed in the water or other solvent.

In certain embodiments, the process for making the powder comprises networking one or more associative polymer (e.g., polymer strength aid)(s) and one or more surfactant(s) wherein the one or more associative monomer unit(s) and the one or more surfactant(s) are structurally similar. As used herein, "structurally similar" means that the associative monomer unit(s) and the surfactant(s) have the same or similar chemical functional groups. In some embodiments, the associative monomer unit(s) and the surfactant(s) each comprise at least one hydroxyl substituent. In some embodiments, the associative monomer unit(s) and the surfactant(s) each comprise at least one amine substituent. In some embodiments, the associative monomer unit(s) and the surfactant(s) each comprise a polyether ether chain. In some embodiments, the associative monomer unit(s) and the surfactant(s) each comprise a polyether chain, wherein the length of the polyether chains are separated by six carbon units or less (i.e., 6, 5, 4, 3, 2, 1, or 0). For example, if an associative monomer unit has a polyether chain length of 16 carbon units, then a structurally similar surfactant will have a polyether chain length from 10-22 carbon units (i.e., 10, 11, 12, 13, 14, 15, 16, 17, 18, 19, 20, 21, or 22). In certain embodiments, the polyether chains comprise the same number of carbon units. In some embodiments, the associative monomer unit(s) and the surfactant(s) each comprise an alkyl chain. In some embodiments, the associative monomer unit(s) and the surfactant(s) each comprise alkyl chains, wherein the length of the alkyl chains are separated by six carbon units or less (i.e., 6, 5, 4, 3, 2, 1, or 0). For example, if an associative monomer unit has an alkyl chain length of 16 carbon units, then a structurally similar surfactant will have an alkyl chain length from 10-22 carbon units (i.e., 10, 11, 12, 13, 14, 15, 16, 17, 18, 19, 20, 21, or 22). In certain embodiments, the alkyl chains each comprise the same number of carbons. In certain embodiments, the associative monomer unit(s) and the surfactant(s) comprise the same structural subunit.

In some embodiments, the process for making the powder further comprises one or more surfactant(s). The surfactant can be any suitable surfactant selected from an anionic surfactant, a cationic surfactant, a nonionic surfactant, and a combination thereof. In some embodiments, the one or more surfactant(s) may exist as a dimer. For example, the surfactant can have one polar head group and two non-polar tails, or two polar head groups and one non-polar tail, or two polar head groups and two non-polar tails. Without wishing to be bound to any particular theory, it is believed that the surfactant helps to provide structure to the wet gel and increases solubility of the resulting powder upon dilution in water or other solvent.

In an embodiment, the surfactant is a cationic surfactant. In certain embodiments, the cationic surfactant is an ammonium salt of Formula IX:

IX

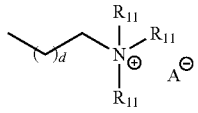

wherein each $R_{11}$ is independently H or $C_1$-$C_{10}$ alkyl (e.g., $(CH_2)_eCH_3$) wherein e is an integer from 0 to 9 (i.e., 0, 1, 2, 3, 4, 5, 6, 7, 8, or 9), A is any anion, and d is an integer from 6 to 34 (e.g., from 6 to 30, from 6 to 24, from 6 to 20, from 6 to 16, from 6 to 12, from 5 to 25, from 10 to 20, from 15 to 25, from 10 to 24, or from 10 to 30). In some embodiments, "$C_1$-$C_{10}$ alkyl" refers to a branched $C_1$-$C_{10}$ alkyl group. In some embodiments, the ammonium salt of Formula IX is a mixture of two or more such ammonium salts, such that the average (rounded to the nearest integer) value of d is an integer from 6 to 34 (e.g., from 6 to 30, from 6 to 24, from 6 to 20, from 6 to 16, from 6 to 12, from 5 to 25, from 10 to 20, from 15 to 25, from 10 to 24, or from 10 to 30). In certain embodiments, the cationic surfactant is hexadecyltrimethylammonium p-toluenesulfonate or hexadecyltrimethylammonium chloride.

The ammonium salt can have any suitable anion counter ion (i.e., "A"). In some embodiments, the anion counter ion ("A") comprises an element selected from a halogen (i.e., fluoride, chloride, bromide, or iodide), sulfur, carbon, nitrogen, phosphorous, and a combination thereof. An exemplary list of anions comprises fluoride, chloride, bromide, iodide, sulfide, sulfite, sulfate, bisulfate, bisulfite, thiosulfate, carbonate, bicarbonate, nitrate, nitrite, phosphate, hydrogen phosphate, dihydrogen phosphate, phosphite, hydrogen phosphite, dihydrogen phosphite, hexafluorophosphate, carboxylate, acetate, mesylate, tosylate, or triflate. In certain embodiments, A is selected from fluoride, chloride, bromide, mesylate, tosylate, or a combination thereof.

In some embodiments, the surfactant is an anionic surfactant. In certain embodiments, the anionic surfactant is a sulfate salt of Formula X:

X

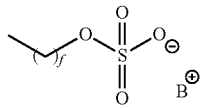

wherein B is any cation, and f is an integer from 7 to 35 (e.g., from 7 to 29, from 7 to 23, from 7 to 19, from 7 to 15, from 7 to 11, from 11 to 19, from 11 to 23, or from 11 to 29). In some embodiments, the sulfate salt of Formula X is a mixture of two or more such sulfate salts, such that the average (rounded to the nearest integer) value off is an integer from 7 to 35 (e.g., from 7 to 29, from 7 to 23, from 7 to 19, from 7 to 15, from 7 to 11, from 11 to 19, from 11 to 23, or from 11 to 29). In certain embodiments, the anionic surfactant is sodium dodecylsulfate (i.e., f is 11).

The sulfate salt can have any suitable cation counter ion (i.e., "B"). For example, the cation counter ion ("B") can be a proton, ammonium, a quaternary amine, a cation of an alkali metal, a cation of an alkaline earth metal, a cation of a transition metal, a cation of a rare-earth metal, a main group element cation, or a combination thereof. In some embodiments, the cation counter ion is hydrogen or a cation of lithium, sodium, potassium, magnesium, calcium, manganese, iron, zinc, or a combination thereof. In certain embodiments, B is selected from hydrogen, lithium, sodium, potassium, or a combination thereof.

In some embodiments, the surfactant is a nonionic surfactant. The nonionic surfactant can be any suitable nonionic surfactant. In some embodiments, the nonionic surfactant comprises repeating units of ethylene oxide, propylene oxide, or ethylene oxide and propylene oxide. In certain embodiments, the surfactant comprises block or random copolymers of ethylene oxide ("EO"), propylene oxide ("PO"), or a combination thereof.

In certain embodiments, the nonionic surfactant is of Formula XI:

$$HO(C_2H_4O)_a(C_3H_6O)_b(C_2H_4O)_cH \quad \text{XI}$$

wherein a, b, and c are independently integers ranging from about 2 to about 200 (e.g., from about 2 to about 175, from about 2 to about 150, from about 2 to about 125, from about 2 to about 100, from about 50 to about 200, from about 50 to about 150, or from about 50 to about 100), and a, b, and c are the same or different. In some embodiments, the nonionic surfactant of Formula X is a mixture of two or more such surfactants, such that a, b, and c refer to an average (rounded to the nearest integer) chain length of the designated subunits (i.e., average chain length of EO and PO) wherein a, b, and c are independently integers from about 2 to about 200 (e.g., from about 2 to about 175, from about 2 to about 150, from about 2 to about 125, from about 2 to about 100, from about 50 to about 200, from about 50 to about 150, or from about 50 to about 100). In certain embodiments, the nonionic surfactant is PLURONIC®

F-127 surfactant, i.e., $HO(C_2H_4O)_{101}(C_3H_6O)_{56}(C_2H_4O)_{101}H$, marketed by BASF Corporation (Florham Park, N.J.).

In some embodiments, the nonionic surfactant is of Formula XII:

XII

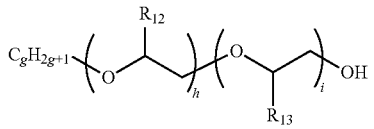

wherein g is an integer ranging from about 6 to about 50 (e.g., from about 6 to about 42, from about 6 to about 36, from about 6 to about 30, from about 6 to about 24, from about 6 to about 18, from about 6 to about 12, from about 8 to about 30, from about 12 to about 50, from about 12 to about 36, or from about 12 to about 24), each $R_{12}$ and $R_{13}$ are independently H or $C_1$-$C_4$ alkyl (e.g., methyl, ethyl, n-propyl, iso-propyl, n-butyl, sec-butyl, or tert-butyl), and h and i are independently integers ranging from 0 to about 100 (e.g., from about 0 to about 90, from about 0 to about 80, from about 0 to about 70, from about 0 to about 60, from about 0 to about 50, from about 10 to about 100, or from about 10 to about 50). In some embodiments, the surfactant of Formula XII is a mixture of two or more such surfactants, such that g, h, and i refer to an average (rounded to the nearest integer) chain length of the designated subunits (i.e., average carbon chain length or average EO (or substituted EO) chain length), wherein g is an integer from about 6 to about 50 (e.g., from about 6 to about 42, from about 6 to about 36, from about 6 to about 30, from about 6 to about 24, from about 6 to about 18, from about 6 to about 12, from about 8 to about 30, from about 12 to about 50, from about 12 to about 36, or from about 12 to about 24), and h and i are independently integers ranging from 0 to about 100 (e.g., from about 0 to about 90, from about 0 to about 80, from about 0 to about 70, from about 0 to about 60, from about 0 to about 50, from about 10 to about 100, or from about 10 to about 50).

In certain embodiments, the nonionic surfactant is of Formula XII:

XII

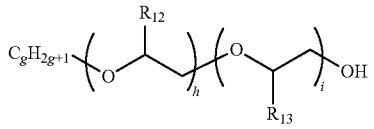

wherein g is an integer ranging from about 6 to about 50 (e.g., from about 6 to about 42, from about 6 to about 36, from about 6 to about 30, from about 6 to about 24, from about 6 to about 18, from about 6 to about 12, from about 12 to about 50, from about 12 to about 36, or from about 12 to about 24), $R_{12}$ and $R_{13}$ are H, and h and i are independently integers ranging from 0 to about 100 (e.g., from about 0 to about 90, from about 0 to about 80, from about 0 to about 70, from about 0 to about 60, from about 0 to about 50, from about 10 to about 100, or from about 10 to about 50). In certain embodiments, the surfactant is BRIJ® S20, i.e., a polyethylene glycol octadecyl ether of the formula $C_{18}H_{37}(OC_2H_4)_{h'}OH$, wherein h' is an integer ranging from about 2 to about 200, marketed by Croda International PLC (East Yorkshire, United Kingdom).

In certain embodiments, the nonionic surfactant is of Formula XII:

XII

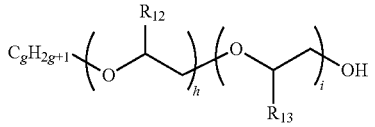

wherein g is an integer ranging from about 6 to about 50 (e.g., from about 6 to about 42, from about 6 to about 36, from about 6 to about 30, from about 6 to about 24, from about 6 to about 18, from about 6 to about 12, from about 12 to about 50, from about 12 to about 36, or from about 12 to about 24), i is 0, $R_{12}$ is H, and h is an integer ranging from about 2 to about 30 (e.g., from 2 to 30, from 4 to 30, from 6 to 30, from 8 to 30, from 10 to 30, from 12 to 30, from 16 to 30, from 18 to 30, from 20 to 30, from 22 to 30, or from 24 to 30). In certain embodiments, the surfactant is a Lutensol® fatty alcohol ethoxylate commercially available from BASF Corporation (Florham Park, N.J.). More preferably, the surfactant is polyethoxy (25) cetyl and/or stearyl alcohol, marketed under the product name (25 EO) C16-C18 fatty alcohol ("LutensolAT® 25"), commercially available from BASF Corporation (Florham Park, N.J.).

In certain embodiments, the nonionic surfactant is of Formula XII:

XII

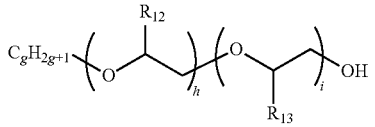

wherein g is an integer ranging from about 8 to about 30 (e.g., from 10 to 30, from 12 to 30, from 16 to 30, from 18 to 30, from 20 to 30, from 22 to 30, or from 24 to 30), each $R_{12}$ and $R_{13}$ are independently H or $C_1$-$C_4$ alkyl (e.g., methyl, ethyl, n-propyl, iso-propyl, n-butyl, sec-butyl, or tert-butyl), and h and i are independently integers ranging from 0 to about 50 (e.g., from about 0 to about 40, from about 0 to about 30, from about 0 to about 20, from about 10 to about 50, from about 10 to about 40, from about 10 to about 30, or from about 10 to about 20). In certain embodiments, the surfactant is a Plurafac® surfactant, commercially available from BASF Corporation (Florham Park, N.J.).

In certain embodiments, the nonionic surfactant is of Formula XIII:

XIII

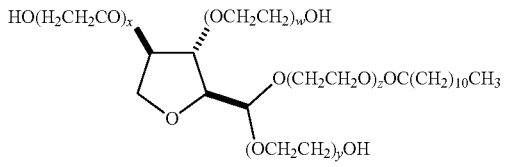

wherein w, x, y, and z are integers from about 0 to about 50 (e.g., from about 0 to about 40, from about 0 to about 30, from about 0 to about 20, from about 0 to about 16, from about 0 to about 12, or from about 0 to about 8), and w, x, y, and z are the same or different. In some embodiments, the nonionic surfactant of Formula XIII is a mixture of two or more such surfactants, such that w, x, y, and z refer to an average (rounded to the nearest integer) chain length of the designated subunits (i.e., average chain length of EO) wherein w, x, y, and z are integers from about 0 to about 50 (e.g., from about 0 to about 40, from about 0 to about 30, from about 0 to about 20, from about 0 to about 16, from about 0 to about 12, or from about 0 to about 8). In certain embodiments, the nonionic surfactant is TWEEN® 20 surfactant, i.e., w+x+y+z=20, marketed by Croda International PLC (East Yorkshire, United Kingdom).

When the one or more surfactant(s) is present in the powder, the one or more surfactant(s) can be present in the powder at any suitable concentration. The powder can comprise a sum total of about 20 wt. % or less of the surfactant(s), for example, about 15 wt. % or less, about 10 wt. % or less, about 9 wt. % or less, about 8 wt. % or less, about 7 wt. % or less, about 6 wt. % or less, or about 5 wt. % or less. Alternatively, or in addition to, the powder can comprise a sum total of about 0.001 wt. % or more of the surfactant(s), for example, about 0.01 wt. %, about 0.1 wt. %, about 0.25 wt. % or more, about 0.5 wt. % or more, about 1 wt. % or more, about 2 wt. % or more, about 3 wt. % or more, or about 4 wt. % or more. Thus, the powder can comprise the one or more surfactant(s) in a concentration bounded by any two of the aforementioned endpoints. The powder can comprise a sum total of from about 0.001 wt. % to about 5 wt. %, from about 0.01 wt. % to about 5 wt. %, from about 0.1 wt. % to about 5 wt. % surfactant, for example, from about 0.25 wt. % to about 5 wt. %, from about 0.5 wt. % to about 5 wt. %, from about 1 wt. % to about 5 wt. %, from about 2 wt. % to about 5 wt. %, from about 3 wt. % to about 5 wt. %, from about 4 wt. % to about 5 wt. %, from about 4 wt. % to about 10 wt. %, from about 4 wt. % to about 9 wt. %, from about 4 wt. % to about 8 wt. %, from about 4 wt. % to about 7 wt. %, from about 4 wt. % to about 6 wt. %, from about 0.001 wt. % to about 10 wt. %, from about 0.01 wt. % to about 10 wt. %, from about 0.1 wt. % to about 10 wt. %, from about 0.001 wt. % to about 15 wt. %, from about 0.01 wt. % to about 15 wt. %, from about 0.1 wt. % to about 15 wt. %, from about 0.001 wt. % to about 20 wt. %, from about 0.01 wt. % to about 20 wt. %, from about 0.1 wt. % to about 20 wt. %, or from about 0.001 wt. % to about 1 wt. %.

In an embodiment, the one or more surfactant(s) are added before the formation of the powder (e.g., to the polymer solution, before or after polymerization, or to the wet gel). When the surfactant(s) are added before the formation of the powder, the surfactant(s) are incorporated into the wet gel, and thereby the powder. Generally, the surfactant(s) improve the processability of the wet gel into a powder. Typically the surfactant(s) further improve the solubility or dispersibility of the resulting powder in aqueous media or other solvent.

In some embodiments, the one or more surfactant(s) is added to the powder after being processed from the wet gel. In some embodiments, the one or more surfactant(s) are not necessary for the wet gel to be processed. In particular, the chemical interactions of the associative monomer units may be strong enough to network the associative polymer (e.g., polymer strength aid)(s) in the absence of surfactant(s). While the surfactant is not always necessary for the formation of the powder, the resulting powder (absent of one or more surfactant(s)) is generally less soluble in an aqueous medium. For example, the one or more surfactant(s) tend to facilitate re-wetting of the associative polymer(s) and speed up the process of forming a solution in water. Thus, a surfactant can be added after formation of the powder in order to improve solubility and dispersibility of the resulting powder in an aqueous medium or other solvent.

The polymerization to form the associative polymer (e.g., polymer strength aid) can be carried out according to any suitable polymerization known in the art. For example, the associative polymer can be made by emulsion polymerization, dispersion polymerization, solution polymerization, gel polymerization, or a combination thereof. The polymerization to form the associative polymer can occur through any suitable mechanism. For example, the polymerization can occur through cationic polymerization, anionic polymerization, free-radical polymerization, coordination polymerization, or combinations thereof. Typically, polymerization occurs through free radical polymerization.

In some embodiments, the polymerization to form the associative polymer (e.g., polymer strength aid) comprises one or more polymerization component(s). In certain embodiments, the one or more polymerization component(s) are not removed from the reaction mixture such that one or more of the polymerization component(s) remains in the polymer solution, the polymer wet gel, and/or the powder. In other embodiments, the one or more polymerization component(s) are removed such that the one or more polymerization component(s) are not present in the polymer solution, the polymer wet gel, and/or the powder. In some embodiments, the one or more polymerization component(s) are transformed such that one or more transformed polymerization components are present in the polymer solution, the polymer wet gel, and/or the powder. An exemplary list of polymerization components is an initiator, a chain transfer agent, a chelant, a redox agent, a buffer, and a combination thereof.

In some embodiments, the polymerization comprises one or more initiator(s). The initiator can be any suitable initiator. In some embodiments, the initiator is a free radical initiator. In certain embodiments, the initiator is selected from the group of azobis compounds. An exemplary list of initiators is 2,2'-azobis(2,4-dimethyl valeronitrile), 2,2'-azobis(4-methoxy-2,4-dimethyl valeronitrile), 1,1'-azobis(cyclohexane-1-carbonitrile), 2,2'-azobis(2-methylbutyronitrile), 2,2'-azobis(2-methylpropionamidine)dihydrochloride, 2,2'-azobis[2-(2-imidazolin-2-yl)propane]dihydrochloride, 2,2'-azobis[N-(2-carboxyethyl)-2-methylpropionamidine] hydrate (anhydride), and 2,2'-azobis[2-(2-imidazolin-2-yl) propane].

In some embodiments, the polymerization comprises one or more chain transfer agent(s). The chain transfer agent can be any suitable chain transfer agent. An exemplary list of chain transfer agents is carbon tetrachloride, carbon tetrabromide, bromotrichloromethane, pentaphenylethane, sodium formate, sodium hypophosphite, thiophenol, 4,4'-thiobisbenzenethiol, 4-methylbenzenethiol, and aliphatic thiols such as isooctyl 3-mercaptopropionate, tert-nonyl mercaptan, and N-acetyl-L-cysteine, N-2-mercaptoethyl)acetamide, glutathione, N-(2-mercaptopropionyl)glycine, and 2-mercaptoethanol.

In some embodiments, the polymerization comprises one or more chelant(s). The chelant can be any suitable chelant. In certain embodiments, the chelant is a polydentate organic compound. An exemplary list of chelating agents is diethylenetriaminepentaacetic acid ("DTPA"), ethylenediaminetetraacetic acid ("EDTA"), nitrilotriacetic acid ("NTA"), diethylenetriaminepentaacetic acid, N,N-bis(carboxymethyl)-L-glutamic acid, trisodium N-(hydroxyethyl)-ethylenediaminetriacetate, adipic acid, and salts thereof.

In some embodiments, the polymerization comprises one or more redox agent(s). The redox agent can be any suitable redox agent. In some embodiments, the redox agent aids in terminating the polymerization. In certain embodiments, the redox reagent is an organic peroxide, an inorganic peroxide, or a combination thereof. An exemplary list of redox agents is sodium bisulfate; a thiosulfate, ferrous ammonium sulfate; ascorbic acid, an amine, a hypophosphite, sodium bromate, a chlorate, a permanganate, ammonium persulfate, potassium persulfate, sodium persulfate, t-butyl hydrogen peroxide, hydrogen peroxide, ozone, and salts thereof. In some embodiments, the redox agent is added as a redox pair such that one agent participates in reduction and one agent participates in oxidation. In certain embodiments, the redox agent is the initiator.

In some embodiments, the polymerization comprises a buffer system. The buffer system can be any suitable organic and/or inorganic buffer system. In certain embodiments, the buffer system comprises an organic and/or inorganic acid and/or base capable of controlling the pH lower than about 6 (e.g., from about 0 to about 6, from about 1 to about 6, from about 2 to about 6, from about 3 to about 6, from about 4 to about 6, from about 5 to about 6, from about 0 to about 1, from about 0 to about 2, from about 0 to about 3, from about 0 to about 4, or from about 0 to about 5). An exemplary list of buffers is adipic acid, pimelic acid, glutaric acid, citric acid, acetic acid, an inorganic acid (e.g., phosphoric acid), an amine, and salts thereof.

The solution of the associative polymer (e.g., polymer strength aid) and optionally one or more surfactant(s) can be converted to a wet gel by any suitable technique. In some embodiments, the solution of the associative polymer and optionally one or more surfactant(s) spontaneously becomes a wet gel. For example, the solution-based monomers can polymerize in the presence of the one or more surfactant(s) and polymerization results in a transition from solution-based monomers to solution-based polymers which spontaneously begin to solidify to form the polymer wet gel. In some embodiments, the solution of the associative polymer and optionally one or more surfactant(s) may need to be dried prior to formation of a wet gel. For example, the solution of the associative polymer and optionally one or more surfactant(s) can be converted to a wet gel through drying (e.g., placing in an oven and/or ambient temperature evaporation), cooling, change in pressure, or a combination thereof. As used herein, "wet gel" refers to any material produced when a solution of the associative polymer and optionally one or more surfactant(s) transitions from a fluid-like to solid-like state. In certain embodiments, the wet gel maintains a taffy-like consistency and is not sticky.

The wet gel comprises the resulting associative polymer (e.g., polymer strength aid), optionally one or more surfactant(s), and a solvent. Generally, the wet gel contains about 20 wt. % to about 80 wt. % of the associative polymer. In an embodiment, the polymer wet gel comprises from about 25 wt. % to about 50 wt. % polymer. In certain embodiments, the polymer wet gel comprises from about 30 wt. % to about 40 wt. % polymer.

The wet gel can be processed to a powder by any suitable process. In some embodiments, the wet gel is processed to a powder by cutting the wet gel to form granules, drying the granules, and converting the dried granules to form a powder. In some embodiments, the wet gel is processed to a powder by drying the wet gel, cutting the dried wet gel into granules, and converting the granules to a powder. In some embodiments, the wet gel is process to a powder by drying the wet gel, cutting the dried wet gel to granules, drying the granules, and converting the dried granules to form a powder. The wet gel can be cut by any suitable method. In certain embodiments, the wet gel is machine processed (for example, using a Retsch Mill Cutter) to form wet gel granules. In certain embodiments, the wet gel is cut with the aid of a lubricant. The lubricant can be any suitable lubricant (e.g., a petroleum oil based lubricant). The wet gel granules can be converted to a powder by any suitable method. In some embodiments, "converting the granules to form a powder" refers to the process of, for example, optionally drying the granules further, grinding the granules, or drying and grinding the granules to produce a powder, though the converting may include other processing steps. For example, converting the granules to a powder can further comprise sifting.

The powder can have any suitable moisture content. Generally, the moisture content is from about 0 wt. % to about 30 wt. % (e.g., from about 0.01 wt. % to about 30 wt. %, from about 0.1 wt. % to about 30 wt. %, or from about 1 wt. % to about 30 wt. %). In certain embodiments of the powder, the moisture content is from about 0 wt. % to about 25 wt. % (e.g., from about 0.01 wt. % to about 25 wt. %, from about 0.1 wt. % to about 25 wt. %, or from about 1 wt. % to about 25 wt. %). In certain embodiments of the powder, the moisture content is from about 0 wt. % to about 20 wt. % (e.g., from about 0.01 wt. % to about 20 wt. %, from about 0.1 wt. % to about 20 wt. %, from about 1 wt. % to about 20 wt. %, from about 0.01 wt. % to about 15 wt. %, from about 0.1 wt. % to about 15 wt. %, from about 1 wt. % to about 15 wt. %, from about 0.01 wt. % to about 12 wt. %, from about 0.1 wt. % to about 12 wt. %, from about 1 wt. % to about 12 wt. %, from about 0.01 wt. % to about 10 wt. %, from about 0.1 wt. % to about 10 wt. %, or from about 1 wt. % to about 10 wt. %). In certain embodiments, the moisture content is about 10 wt. %.

The powder can have any suitable mean particle size (i.e., mean particle diameter). The mean particle size can be determined by any suitable method known in the art. Generally, the mean particle size is determined by a Horiba Laser Scattering Particle Size Distribution Analyzer LA-950. The powder can have a mean particle size of about 1 micron or more, for example, about 10 microns or more, about 20 microns or more, about 50 microns or more, about 100 microns or more, about 200 microns or more, or about 500 microns or more. Alternatively, or in addition, the powder can have a mean particle size of about 10,000 microns or less, for example, about 8,000 microns or less, about 6,000 microns or less, about 4,000 microns or less, or about 2,000 microns or less. Thus, the powder can have a mean particle size bounded by any two of the aforementioned endpoints. The powder can have a mean particle size of from about 1 micron to about 10,000 microns, for example, from about 1 micron to about 8,000 microns, from about 1 micron to about 6,000 microns, from about 1 micron to about 4,000 microns, from about 1 micron to about 2,000 microns, from about 10 microns to about 2,000 microns, from about 20 microns to about 2,000 microns, from about 50 microns to about 2,000 microns, from about 100 microns to about 2,000 microns, from about 200 microns to about 2,000 microns, or from about 500 microns to about 2,000 microns.

The powder can have any suitable particle shape. In some embodiments, the powder particles are non-spherical. Without wishing to be bound to any particular theory, it is believed that non-spherical particles are generally formed when the powder has been manufactured by a gel-, spray-, or drum-based process (e.g., via cutting and drying). In some embodiments, the powder particles are spherical. Without wishing to be bound to any particular theory, it is believed that spherical particles are generally formed when the powder has been manufactured by a bead-based process.

In some embodiments, the powder, at a median particle size of at least 300 microns, is soluble as up to a 20 wt. % solution in water with stirring by a cage stirrer at 400 rpm within one hour at 25° C. In some embodiments, the powder, at a median particle size of at least 300 microns, is soluble as up to a 10 wt. % solution in water with stirring by a cage stirrer at 400 rpm within one hour at 25° C. In certain embodiments, the powder, at a median particle size of at least 300 microns, is soluble as up to a 5 wt. % solution in water with stirring by a cage stirrer at 400 rpm within one hour at 25° C. In certain embodiments, the powder, at a median particle size of at least 300 microns, is soluble as up to a 1 wt. % solution in water with stirring by a cage stirrer at 400 rpm within one hour at 25° C. In some embodiments, generally, when the powder does not comprise one or more surfactant(s), the powder, at a median particle size of at least 300 microns, does not completely dissolve, or is sparingly soluble in water (i.e., did not completely dissolve as a 1 wt. % solution in water within one hour at 25° C.). Without wishing to be bound by any particular theory, it is believed that the chemical interactions (e.g., networking) diminish as the concentrations of associative polymer (e.g., polymer strength aid) and optional surfactant(s) are reduced below their critical concentration, thereby releasing the active polymer (i.e., associative polymer) and further improving solubility. As used herein, "critical concentration" refers to the concentration at which the associative polymer and surfactant(s) transition from being solution-based to maintaining an organized network structure.

The resulting powder can have any suitable intrinsic viscosity. For example, the powder can have an intrinsic viscosity of from about 0.05 dL/g to about 7 dL/g (e.g., from about 0.05 dL/g to about 6 dL/g, from about 0.05 dL/g to about 5 dL/g, from about 0.05 dL/g to about 4 dL/g, from about 0.05 dL/g to about 3 dL/g, from about 0.05 dL/g to about 2 dL/g, from about 0.05 dL/g to about 1 dL/g, from about 0.05 dL/g to about 0.5 dL/g, from about 0.1 dL/g to about 7 dL/g, from about 0.1 dL/g to about 6 dL/g, or from about 0.5 dL/g to about 5 dL/g). In some embodiments, the powder has an intrinsic viscosity from about 0.1 dL/g to about 6. In certain embodiments, the powder has an intrinsic viscosity of from about 0.5 dL/g to about 5 dL/g.

Intrinsic viscosity ("IV") is defined by a series of reduced specific viscosity ("RSV") measurements extrapolated to the limit of infinite dilution, i.e., when the concentration of powder is equal to zero. The RSV is measured at a given powder concentration and temperature and calculated as follows:

$$RSV = \frac{\left(\frac{\eta}{\eta_0} - 1\right)}{c} = \frac{\left(\frac{t}{t_0} - 1\right)}{c}$$

wherein $\eta$ is viscosity of the powder solution, $\eta_0$ is viscosity of the solvent at the same temperature, an t is elution time of powder solution, $t_0$ is elution time of solvent, and c is concentration (g/dL) of the powder in solution. Thus, intrinsic viscosity is defined by dL/g. Variables t and $t_0$ are measured using powder solution and solvent that is in 1.0 N sodium nitrate solution with a Cannon Ubbelohde semimicro dilution viscometer (size 75) at 30±0.02° C.

The resulting powder can have any suitable Huggins constant. For example, the resulting powder can have a Huggins constant from about 0.1 to about 20 (e.g., from about 0.1 to about 15, from about 0.1 to about 10, from about 0.3 to about 10, from about 0.1 to about 5, from about 0.5 to about 20, from about 0.5 to about 10, from about 1 to about 20, from about 1 to about 10, or from about 1 to about 5). In some embodiments, the powder can have a Huggins constant of from about 0.3 to about 10 as determined by varying concentrations of the powder, wherein the concentrations have been chosen such that they produce a value of $(t/t_0)$ between about 1.2 and 2.2, in a 1.0 N sodium nitrate solution. In some embodiments, the powder can have a Huggins constant of from about 0.3 to about 5 as determined by varying concentrations of the powder, wherein the concentrations have been chosen such that they produce a value of $(t/t_0)$ between about 1.2 and 2.2, in a 1.0 N sodium nitrate solution. In certain embodiments, the powder has a Huggins constant of from about 0.6 to about 3 as determined by varying concentrations of the powder, wherein the concentrations have been chosen such that they produce a value of $$\left(\frac{t}{t_0}\right)$$

between about 1.2 and 2.2, in a 1.0 N sodium nitrate solution. The Huggins constant is calculated as follows:

$$\text{Huggins constant} = \frac{\text{slope of } (RSV \sim c)}{IV^2}$$

In some embodiments, the powder comprises an associative polymer (e.g., polymer strength aid) comprising one or more associative monomer unit(s) and one or more monomer units selected from at least one of a cationic monomer unit, an anionic monomer unit, a nonionic monomer unit, a zwitterionic monomer unit, or a combination thereof, and optionally one or more surfactant(s), wherein the associative polymer has a weight average molecular weight of from about 10 kDa to about 2,000 kDa. In some embodiments, the powder comprises one or more low molecular weight associative polymer(s) that are reversibly associated in a polymer network, wherein the association is controllable via degree of dilution in aqueous media, or amount of surfactant present.

In some embodiments, the powder comprises a nonionic surfactant and an associative polymer (e.g., polymer strength aid) comprising an associative monomer unit derived from a monomer of Formula II, a monomer unit derived from a monomer of Formula I, and an additional cationic monomer unit. In some embodiments, the powder comprises a nonionic surfactant and an associative polymer (e.g., polymer strength aid) comprising an associative monomer unit derived from a monomer of Formula II, a monomer unit derived from a monomer of Formula I, and an additional monomer unit derived from DMAEA.MCQ. In some embodiments, the powder comprises a nonionic surfactant and an associative polymer (e.g., polymer strength aid) comprising an associative monomer unit derived from a monomer of Formula II, an additional monomer unit derived from acrylamide, and an additional monomer unit derived from DMAEA.MCQ. In certain embodiments, the powder comprises a nonionic surfactant and an associative polymer (e.g., polymer strength aid) comprising an associative monomer unit derived from VISIOMER® monomer C18PEG1105MA, an additional monomer unit derived from acrylamide, and an additional monomer unit derived from DMAEA.MCQ. In certain embodiments, the powder comprises a nonionic surfactant of Formula XII, and an associative polymer (e.g., polymer strength aid) comprising an associative monomer unit derived from VISIOMER® monomer C18PEG1105MA, an additional monomer unit derived from acrylamide, and an additional monomer unit derived from DMAEA.MCQ. In certain embodiments, the powder comprises PLURONIC® F-127 surfactant and/or LutensolAT® 25 surfactant, and an associative polymer (e.g., polymer strength aid) comprising an associative monomer unit derived from VISIOMER® monomer C18PEG1105MA, an additional monomer unit derived from acrylamide, and an additional monomer unit derived from DMAEA.MCQ.

In some embodiments, the powder comprises a nonionic surfactant and an associative polymer (e.g., polymer strength aid) comprising an associative monomer unit derived from a monomer of Formula II, a monomer unit derived from a monomer of Formula I, and an additional anionic monomer unit. In some embodiments, the powder comprises a nonionic surfactant and an associative polymer (e.g., polymer strength aid) comprising an associative monomer unit derived from a monomer of Formula II, a monomer unit derived from a monomer of Formula I, and an additional monomer unit derived from sodium acrylate. In some embodiments, the powder comprises a nonionic surfactant and an associative polymer (e.g., polymer strength aid) comprising an associative monomer unit derived from a monomer of Formula II, an additional monomer unit derived from acrylamide, and an additional monomer unit derived from sodium acrylate. In certain embodiments, the powder comprises a nonionic surfactant and an associative polymer (e.g., polymer strength aid) comprising an associative monomer unit derived from VISIOMER® monomer C18PEG1105MA, an additional monomer unit derived from acrylamide, and an additional monomer unit derived from sodium acrylate. In certain embodiments, the powder comprises a nonionic surfactant of Formula XII, and an associative polymer (e.g., polymer strength aid) comprising an associative monomer unit derived from VISIOMER® monomer C18PEG1105MA, an additional monomer unit derived from acrylamide, and an additional monomer unit derived from sodium acrylate. In certain embodiments, the powder comprises PLURONIC® F-127 surfactant and/or LutensolAT® 25 surfactant, and an associative polymer (e.g., polymer strength aid) comprising an associative monomer unit derived from VISIOMER® monomer C18PEG1105MA, an additional monomer unit derived from acrylamide, and an additional monomer unit derived from sodium acrylate.

In some embodiments, the powder comprises a cationic surfactant and an associative polymer (e.g., polymer strength aid) comprising an associative monomer unit derived from a monomer of Formula VI, a monomer unit derived from a monomer of Formula I, and an additional cationic monomer unit. In some embodiments, the powder comprises a cationic surfactant and an associative polymer (e.g., polymer strength aid) comprising an associative monomer unit derived from a monomer of Formula VI, a monomer unit derived from a monomer of Formula I, and an additional monomer unit derived from DMAEA.MCQ. In some embodiments, the powder comprises a cationic surfactant and an associative polymer (e.g., polymer strength aid) comprising an associative monomer unit derived from a monomer of Formula VI, an additional monomer unit derived from acrylamide, and an additional monomer unit derived from DMAEA.MCQ. In certain embodiments, the powder comprises a cationic surfactant and an associative polymer (e.g., polymer strength aid) comprising an associative monomer unit derived from MAPTAC-C12 derivative of Formula VII, an additional monomer unit derived from acrylamide, and an additional monomer unit derived from DMAEA.MCQ. In certain embodiments, the powder comprises a cationic surfactant of Formula IX, and an associative polymer (e.g., polymer strength aid) comprising an associative monomer unit derived from MAPTAC-C12 derivative of Formula VII, an additional monomer unit derived from acrylamide, and an additional monomer unit derived from DMAEA.MCQ. In certain embodiments, the powder comprises cetyltrimethylammonium chloride and/or hexadecyltrimethylammonium p-toluenesulfonate, and an associative polymer (e.g., polymer strength aid) comprising an associative monomer unit derived from MAPTAC-C12 derivative of Formula VII, an additional monomer unit derived from acrylamide, and an additional monomer unit derived from DMAEA.MCQ.

In some embodiments, the powder comprises a cationic surfactant and an associative polymer (e.g., polymer strength aid) comprising an associative monomer unit derived from a monomer of Formula VI, a monomer unit derived from a monomer of Formula I, and an additional anionic monomer unit. In some embodiments, the powder comprises a cationic surfactant and an associative polymer (e.g., polymer strength aid) comprising an associative monomer unit derived from a monomer of Formula VI, a monomer unit derived from a monomer of Formula I, and an additional monomer unit derived from sodium acrylate. In some embodiments, the powder comprises a cationic surfactant and an associative polymer (e.g., polymer strength aid) comprising an associative monomer unit derived from a monomer of Formula VI, an additional monomer unit derived from acrylamide, and an additional monomer unit derived from sodium acrylate. In certain embodiments, the powder comprises a cationic surfactant and an associative polymer (e.g., polymer strength aid) comprising an associative monomer unit derived from MAPTAC-C12 derivative of Formula VII, an additional monomer unit derived from acrylamide, and an additional monomer unit derived from sodium acrylate. In certain embodiments, the powder comprises a cationic surfactant of Formula IX, and an associative polymer (e.g., polymer strength aid) comprising an associative monomer unit derived from MAPTAC-C12 derivative of Formula VII, an additional monomer unit derived from acrylamide, and an additional monomer unit derived from sodium acrylate. In certain embodiments, the powder comprises cetyltrimethylammonium chloride and/or hexadecyltrimethylammonium p-toluenesulfonate, and an associative polymer (e.g., polymer strength aid) comprising an associative monomer unit derived from MAPTAC-C12 derivative of Formula VII, an additional monomer unit derived from acrylamide, and an additional monomer unit derived from sodium acrylate.

In some embodiments, the powder comprises an anionic surfactant and an associative polymer (e.g., polymer strength aid) comprising an associative monomer unit derived from a monomer of Formula VIII, a monomer unit derived from a monomer of Formula I, and an additional cationic monomer unit. In some embodiments, the powder comprises an anionic surfactant and an associative polymer (e.g., polymer strength aid) comprising an associative monomer unit derived from a monomer of Formula VIII, a monomer unit derived from a monomer of Formula I, and an additional monomer unit derived from DMAEA.MCQ. In some embodiments, the powder comprises an anionic surfactant and an associative polymer (e.g., polymer strength aid) comprising an associative monomer unit derived from a monomer of Formula VIII, an additional monomer unit derived from acrylamide, and an additional monomer unit derived from DMAEA.MCQ. In certain embodiments, the powder comprises an anionic surfactant of formula X, and an associative polymer (e.g., polymer strength aid) comprising an associative monomer unit derived from a monomer of Formula VIII, an additional monomer unit derived from acrylamide, and an additional monomer unit derived from DMAEA.MCQ. In certain embodiments, the powder comprises sodium dodecyl sulfate, and an associative polymer (e.g., polymer strength aid) comprising an associative monomer unit derived from a monomer of Formula VIII, an additional monomer unit derived from acrylamide, and an additional monomer unit derived from DMAEA.MCQ.

In some embodiments, the powder comprises an anionic surfactant and an associative polymer (e.g., polymer strength aid) comprising an associative monomer unit derived from a monomer of Formula VIII, a monomer unit derived from a monomer of Formula I, and an additional anionic monomer unit. In some embodiments, the powder comprises an anionic surfactant and an associative polymer (e.g., polymer strength aid) comprising an associative monomer unit derived from a monomer of Formula VIII, a monomer unit derived from a monomer of Formula I, and an additional monomer unit derived from sodium acrylate. In some embodiments, the powder comprises an anionic surfactant and an associative polymer (e.g., polymer strength aid) comprising an associative monomer unit derived from a monomer of Formula VIII, an additional monomer unit derived from acrylamide, and an additional monomer unit derived from sodium acrylate. In certain embodiments, the powder comprises an anionic surfactant of formula X, and an associative polymer (e.g., polymer strength aid) comprising an associative monomer unit derived from a monomer of Formula VIII, an additional monomer unit derived from acrylamide, and an additional monomer unit derived from sodium acrylate. In certain embodiments, the powder comprises sodium dodecyl sulfate, and an associative polymer (e.g., polymer strength aid) comprising an associative monomer unit derived from a monomer of Formula VIII, an additional monomer unit derived from acrylamide, and an additional monomer unit derived from sodium acrylate.

The individual components of the powder, for example, the associative polymer (e.g., polymer strength aid) and one or more optional surfactant(s), are as defined by the parameters set forth herein.

The individual structures of the associative polymer (e.g., polymer strength aid), for example, the associative polymer and one or more monomer unit(s) selected from at least one of a cationic monomer unit, an anionic monomer unit, a nonionic monomer unit, a zwitterionic monomer unit, or a combination thereof, are as defined by the parameters set forth herein.

The individual structures of the one or more surfactant(s) are as defined by the parameters set forth herein.

The quantities of the individual components of the powder, for example, the amount of the associative polymer (e.g., polymer strength aid) and optionally one or more surfactant(s), are as defined by the parameters set forth herein.

The quantities of the individual monomer units of the associative polymer (e.g., polymer strength aid), for example, the amount of the one or more associative monomer unit(s) and one or more monomer unit(s) selected from at least one of a cationic monomer unit, an anionic monomer unit, a nonionic monomer unit, a zwitterionic monomer unit, or a combination thereof, are as defined by the parameters set forth herein.

In certain embodiments, the physical characteristics of the powder are as defined by the parameters set forth herein.

The invention is further illustrated by the following embodiments.

(1) A method of incorporating a low molecular weight polymer strength aid into a papermaking process, comprising treating a paper sheet precursor with a powder, wherein the powder comprises a polymer strength aid, wherein the polymer strength aid has a weight average molecular weight of from about 10 kDa to about 2,000 kDa.

(2) The method of embodiment (1), wherein the powder is added to the paper sheet precursor upstream of a wet end of a paper machine.

(3) The method of embodiment (2), wherein the powder is added to a stock prep section of the paper machine.

(4) The method of any one of embodiments (1)-(3), wherein the powder has an average particle size of about 1 micron to about 10,000 microns.

(5) The method of embodiment (4), wherein the powder has an average particle size of about 100 microns to about 1,000 microns.

(6) The method of any one of embodiments (1)-(5), wherein the powder has a water content of from about 0.1 wt. % to about 20 wt. % prior to treating the paper sheet precursor.

(7) The method of embodiment (6), wherein the powder has a water content of about 0.1 wt. % to about 12 wt. % prior to treating the paper sheet precursor.

(8) The method of any one of embodiments (1)-(7), wherein the powder further comprises one or more surfactant(s).

(9) The method of any one of embodiments (1)-(8), wherein the polymer strength aid is an associative polymer strength aid of formula $AP_1$:

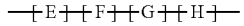

$AP_1$ wherein E is one or more associative monomer units(s), F is one or more additional monomer unit(s), G is one or more additional monomer unit(s) of Formula I:

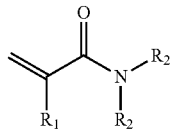

I wherein $R_1$ is H or $C_1$-$C_4$ alkyl and each $R_2$ is independently H or an alkyl group, an aryl group, a fluoroalkyl group, or a fluoroaryl group, and H is optionally present and is one or more piperidine-2,6-dione unit(s), wherein the one or more piperidine-2,6-dione(s) are formed upon cyclization of an acrylamide nitrogen of the additional monomer unit of Formula I ("G") on a carbonyl of the additional monomer unit ("F").

(10) The method of any one of embodiments (1)-(9), wherein the powder comprises a polymer strength aid and one or more surfactant(s) that are associatively networked.

(11) The method of embodiment (10), wherein the polymer strength aid has one or more monomer unit(s) that are structurally similar to the surfactant(s).

(12) The method of any one of embodiments (1)-(11), wherein the polymer strength aid has a weight average molecular weight of from about 500 kDa to about 2,000 kDa.

(13) The method of any one of embodiments (1)-(12), wherein the powder has an intrinsic viscosity of from about 0.05 dL/g to about 7 dL/g.

(14) The method of embodiment (13), wherein the powder has an intrinsic viscosity of from about 0.5 dL/g to about 5 dL/g.

(15) The method of any one of embodiments (1)-(14), wherein the powder has a Huggins constant of from about 0.3 to about 10.

(16) The method of embodiment (15), wherein the powder has a Huggins constant of from about 0.3 to about 5.

(17) A method of any one of embodiments (1)-(16), wherein the powder is wetted with a solvent to form a a wetted powder.

(18) The method of embodiment (17), wherein the wetted powder is added to the paper sheet precursor before the wetted powder reaches complete dissolution, as measured by refractive index at 25° C. and 1 atmosphere ("atm") of pressure.

(19) The method of embodiment (17), wherein the wetted powder reaches complete dissolution, as measured by refractive index at 25° C. and 1 atmosphere ("atm"), to form a powder solution in an addition conduit during addition to the paper sheet precursor.

(20) The method of any one of embodiments (17)-(19), wherein the solvent is water.

(21) The method of any one of embodiments (17)-(20), wherein the wetted powder has a powder content of from about 0.1 wt. % to about 10 wt. % prior to treating the paper sheet precursor.

(22) The method of embodiment (21), wherein the wetted powder has a powder content of from about 0.2 wt. % to about 3 wt. % prior to treating the paper sheet precursor.

(23) A method of incorporating a low molecular weight polymer into an industrial process, comprising treating an aqueous slurry of the industrial process with a powder, wherein the powder comprises a polymer, wherein the polymer has a weight average molecular weight of from about 10 kDa to about 2,000 kDa.

(24) The method of embodiment (23), wherein the powder is added to a process stream of the industrial process.

(25) The method of embodiment (23) or (24), wherein the powder has an average particle size of about 1 micron to about 10,000 microns.

(26) The method of embodiment (25), wherein the powder has an average particle size of about 100 microns to about 1,000 microns.

(27) The method of any one of embodiments (23)-(26), wherein the powder has a water content of from about 0.1 wt. % to about 20 wt. % prior to treating the paper sheet precursor.

(28) The method of embodiment (27), wherein the powder has a water content of about 0.1 wt. % to about 12 wt. % prior to treating the paper sheet precursor.

(29) The method of any one of embodiments (23)-(28), wherein the powder further comprises one or more surfactant(s).

(30) The method of any one of embodiments (23)-(29), wherein the polymer is an associative polymer of formula $AP_1$:

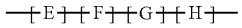

$AP_1$ wherein E is one or more associative monomer units(s), F is one or more additional monomer unit(s), G is one or more additional monomer unit(s) of Formula I:

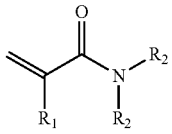

I wherein $R_1$ is H or $C_1$-$C_4$ alkyl and each $R_2$ is independently H or an alkyl group, an aryl group, a fluoroalkyl group, or a fluoroaryl group, H is optionally present and is one or more piperidine-2,6-dione unit(s), wherein the one or more piperidine-2,6-dione(s) are formed upon cyclization of an acrylamide nitrogen of the additional monomer unit of Formula I ("G") on a carbonyl of the additional monomer unit ("F").

(31) The method of any one of embodiments (23)-(30), wherein the powder comprises a polymer and one or more surfactant(s) that are associatively networked.

(32) The method of embodiment (31), wherein the polymer has one or more monomer unit(s) that are structurally similar to the surfactant(s).

(33) The method of any one of embodiments (23)-(32), wherein the polymer has a weight average molecular weight of from about 500 kDa to about 2,000 kDa.

(34) The method of any one of embodiments (23)-(33), wherein the powder has an intrinsic viscosity of from about 0.05 dL/g to about 7 dL/g.

(35) The method of embodiment (34), wherein the powder has an intrinsic viscosity of from about 0.5 dL/g to about 5 dL/g.

(36) The method of any one of embodiments (23)-(35), wherein the powder has a Huggins constant of from about 0.3 to about 10.

(37) The method of embodiment (36), wherein the powder has a Huggins constant of from about 0.3 to about 5.

(38) A method of any one of embodiments (23)-(37), wherein the powder is wetted with a solvent to form a wetted powder.

(39) The method of embodiment (38), wherein the wetted powder is added to the industrial process before the wetted powder reaches complete dissolution, as measured by refractive index at 25° C. and 1 atmosphere ("atm") of pressure.

(40) The method of embodiment (38), wherein the wetted powder reaches complete dissolution, as measured by refractive index at 25° C. and 1 atmosphere ("atm"), to form a powder solution in an addition conduit during addition to the paper sheet precursor.

(41) The method of any one of embodiments (38)-(40), wherein the solvent is water.

(42) The method of any one of embodiments (38)-(41), wherein the wetted powder has a powder content of from about 0.1 wt. % to about 10 wt. % prior to treating the aqueous slurry.

(43) The method of embodiment (42), wherein the wetted powder has a powder content of from about 0.2 wt. % to about 3 wt. % prior to treating the aqueous slurry.

(44) The method of any one of embodiments (23)-(43), wherein the industrial process is in a mining industry.

(45) The method of embodiment (44), wherein the polymer improves wastewater recovery.

(46) The method of any one of embodiments (23)-(43), wherein the industrial process is in a textile industry.

(47) The method of embodiment (46), wherein the polymer improves the strength of a fabric.

(48) The method of any one of embodiments (23)-(43), wherein the industrial process is in a paper industry.

(49) The method of embodiment (48), wherein polymer improves the strength of a paper sheet.

The following examples further illustrate the invention but, of course, should not be construed as in any way limiting its scope.

Example 1

This example, provided as a control, demonstrates the effect on the inability to be machine processed into a powder, exhibited by a low molecular weight polymer without networking via an associative monomer unit or a surfactant.

Polymer 1 (control) comprising 95/5 mol % acrylamide/DMAEA.MCQ was synthesized in the following manner:

An 1,000 g aqueous solution at pH 2-5 containing 34 wt. % monomer mixture of 95/5 mol % acrylamide/DMAEA.MCQ, azo initiator, chain transfer agent, buffer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1\times10^6$ g/mol. The resulting polymer gel was too soft and sticky to be processed with the aid of 1 wt. % (relative to weight of polymer gel) petroleum oil based lubricant in a cutting mill (Restch Mill Cutter) at 1500 rpm. The resulting polymer gel was manually divided into small pieces on a tray and dried in an oven at 85° C. to remove the moisture and then ground to powder with an intrinsic viscosity of 3.20 dg/L and Huggins constant of 0.31 in 1.0 N $NaNO_3$ solution at 30° C. The weight average molecular weight was determined by hydrolysis (using 0.1 wt. % solution of NaOH at pH 12 with a cage stirrer at 400 rpm for one hour) of the resulting polymer, followed by size exclusion chromatography.

As is apparent from the results set forth in Table 1, low molecular weight Polymer 1, lacking temporary networking via an associative monomer, was incapable of being machine processed to form a powder. This was further evidenced by the procedure requiring manual division of the soft and sticky polymer.

TABLE 1

| Polymer | Intrinsic Viscosity (dg/L) | Huggins Constant | Weight Average Molecular Weight (kDa) | Wet Gel Processable |
|---|---|---|---|---|
| 1 | 3.20 | 0.31 | 930 | No |
| 2 | 2.91 | 1.05 | 820 | Yes |
| 3 | 1.96 | 1.36 | 490 | Yes |

Example 2

This example demonstrates the effect on the ability to be machine processed into a powder, exhibited by a low molecular weight polymer comprising temporary networking via an associative monomer unit and a surfactant.

Polymer 2 comprising 94.94/5/0.06 mol % acrylamide/DMAEA.MCQ/C18PEG1105MA was synthesized in the following manner:

An 1,000 g aqueous solution at pH 2-5 containing 34 wt. % monomer mixture of 94.94/5/0.06 mol % acrylamide/DMAEA.MCQ/C18PEG1105MA (VISIOMER® monomer; 55% active; Evonik Industries, Essen, Germany), 1 wt. % of PLURONIC® F127 surfactant (BASF Corporation, Florham Park, N.J.), azo initiator, chain transfer agent, buffer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1\times10^6$ g/mol. The resulting wet gel, which maintained a taffy like consistency and was not sticky, was processed with the aid of 1 wt. % (relative to weight of polymer gel) petroleum oil based lubricant in a cutting mill (Retsch Mill Cutter) at 1500 rpm to form granules. The wet gel granules were dried in a mesh tray in an oven at 85° C. to decrease the moisture content to about 10 wt. % and then ground to powder having an intrinsic viscosity of 2.91 dg/L and Huggins constant of 1.05 in 1 N $NaNO_3$ solution at 30° C. The weight average molecular weight was determined by hydrolysis (using 0.1 wt. % solution of NaOH at pH 12 with a cage stirrer at 400 rpm for one hour) of the resulting polymer, followed by size exclusion chromatography.

As is apparent from the results set forth in Table 1, low molecular weight Polymer 2, comprising temporary networking, was capable of being machine processed to form a powder. This was further evidenced by the procedure allowing for use of a cutting mill to process the wet gel.

Example 3

This example demonstrates the effect on the ability to be processed into a powder, exhibited by a low molecular weight polymer comprising temporary networking via an associative monomer unit and surfactant.

Polymer 3 comprising 94.84/5/0.12 mol % acrylamide/DMAEA.MCQ/C18PEG1105MA was synthesized in the following manner:

An 1,000 g aqueous solution at pH 2-5 containing 34 wt. % monomer mixture of 94.8/5/0.12 mol % acrylamide/DMAEA.MCQ/C18PEG1105MA (VISIOMER® monomer; 55% active; Evonik Industries, Essen, Germany), 1 wt. % of PLURONIC® F127 surfactant (BASF Corporation, Florham Park, N.J.), azo initiator, chain transfer agent, buffer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $0.5\times10^6$ g/mol. The resulting wet gel, which maintained a taffy like consistency and was not sticky, was processed with the aid of 1 wt. % (relative to weight of polymer gel) petroleum oil based lubricant in a cutting mill (Retsch Mill Cutter) at 1500 rpm to form granules. The wet gel granules were dried in a mesh tray in an oven at 85° C. to decrease the moisture content to about 10 wt. % and then ground to powder having an intrinsic viscosity of 1.96 dg/L and Huggins constant of 1.36 in 1 N $NaNO_3$ solution at 30° C. The weight average molecular weight was determined by hydrolysis (using 0.1 wt. % solution of NaOH at pH 12 with a cage stirrer at 400 rpm for one hour) of the resulting polymer, followed by size exclusion chromatography.

As is apparent from the results set forth in Table 1, low molecular weight Polymer 3, comprising temporary networking, was capable of being machine processed to form a powder. This was further evidenced by the procedure allowing for use of a cutting mill to process the wet gel.

Example 4

This example demonstrates the effect on the ability to be machine processed into a powder, exhibited by a low molecular weight polymer comprising temporary networking via an associative monomer unit only (i.e., not further comprising a surfactant in the monomer phase).

Polymer 4 comprising 89.965/10/0.035 mol % acrylamide/DMAEA.MCQ/C18PEG1105MA was synthesized in the following manner:

An 1,000 g aqueous solution at pH 2-5 containing 37 wt. % monomer mixture of 89.965/10/0.035 mol % acrylamide/DMAEA.MCQ/C18PEG1105MA (VISIOMER® monomer; 55% active; Evonik Industries, Essen, Germany), azo initiator, chain transfer agent, buffer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1.0\times10^6$ g/mol. The resulting wet gel, which maintained a taffy like consistency and was not sticky, was marginally processed with the aid of 1 wt. % (relative to weight of polymer gel) petroleum oil based lubricant in a cutting mill (Retsch Mill Cutter) at 1500 rpm to form granules. The wet gel granules were dried in a mesh tray in an oven at 85° C. to decrease the moisture content to about 10 wt. % and then ground to powder. The resulting powder had a median particle size of 568.9 microns (the mean particle size was 634.4), as determined using a Horiba Laser Scattering Particle Size Distribution Analyzer LA-950 with the setting of refractive index of powder at 1.5000. The powder did not completely dissolve as a 1 wt. % solution in synthetic tap water with stirring of cage stirrer at 400 rpm within one hour. The powder, as a 1 wt. % solution in synthetic tap water, had a viscosity of 744 cps, as measured on a Brookfield Model DV-E Viscometer with Spindle 62 at 30 rpm. The weight average molecular weight was determined by hydrolysis (using 0.1 wt. % solution of NaOH at pH 12 with a cage stirrer at 400 rpm for one hour) of the resulting polymer, followed by size exclusion chromatography.

As is apparent from the results set forth in Table 2, low molecular weight Polymer 4, not comprising a surfactant, was marginally capable of being machine processed to form a powder. The resulting powder was sparingly soluble in water (i.e., did not completely dissolve as a 1 wt. % solution in local tap water with stirring of cage stirrer at 400 rpm within one hour).

TABLE 2

| Polymer | Weight Average MW (kDa) | Surfactant in powder (wt. %) | Wet Gel Processable | Solubility | Viscosity of 1 wt. % solution in water (cps) |
|---|---|---|---|---|---|
| 4 | 840 | 0 | Yes (marginal) | Poor | 744 |
| 5 | 930 | 2.2 | Yes | Good | 317 |

Example 5

This example demonstrates the effect on the ability to be machine processed into a powder, exhibited by a low molecular weight polymer comprising temporary networking via an associative monomer unit and surfactant.

Polymer 5 comprising 89.965/10/0.035 mol % acrylamide/DMAEA.MCQ/C18PEG1105MA was synthesized in the following manner:

An 1,000 g aqueous solution at pH 2-5 containing 37 wt. % monomer mixture of 89.965/10/0.035 mol % acrylamide/DMAEA.MCQ/C18PEG1105MA (VISIOMER® monomer; 55% active; Evonik Industries, Essen, Germany), 1 wt. % LutensolAT® 25 surfactant, or ethoxylated (25 mol EO) C16-18 fatty alcohol (BASF Corporation, Florham Park, N.J.), azo initiator, chain transfer agent, buffer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1.0\times10^6$ g/mol. The resulting wet gel, which maintained a taffy like consistency and was not sticky, was processed with the aid of 1 wt. % (relative to weight of polymer gel) petroleum oil based lubricant in a cutting mill (Retsch Mill Cutter) at 1500 rpm to form granules. The wet gel granules were dried in a mesh tray in an oven at 85° C. to decrease the moisture content to about 10 wt. % and then ground to powder. The resulting powder had a median particle size of 559.7 microns (the mean particle size was 609.3), as determined using a Horiba Laser Scattering Particle Size Distribution Analyzer LA-950 with the setting of refractive index of powder at 1.5000. The powder completely dissolved as a 1 wt. % solution in synthetic tap water with stirring of cage stirrer at 400 rpm within one hour. The powder polymer, as a 1 wt. % solution in synthetic tap water, had a viscosity of 317 cps, as measured on a Brookfield Model DV-E Viscometer with Spindle 62 at 30 rpm. The weight average molecular weight was determined by hydrolysis (using 0.1 wt. % solution of NaOH at pH 12 with a cage stirrer at 400 rpm for one hour) of the resulting polymer, followed by size exclusion chromatography. The structure of Polymer 5 was further analyzed by $^{13}C$ NMR spectroscopy (FIG. 1) to quantify the amount of piperidine-2,6-dione present in the polymer. The $^{13}C$ NMR sample was prepared in deuterated water and the carbon spectrum was acquired using an Agilent Inova 500 Mhz spectrometer equipped with a Z-gradient and broadband 10 mm probe.

As is apparent from the results set forth in Table 2, low molecular weight Polymer 5, comprising a surfactant, was easily machine processed to form a powder. In addition, the resulting powder, comprising 2.2 wt. % surfactant, was completely soluble as a 1 wt. % solution in local tap water with stirring of cage stirrer at 400 rpm within one hour.

Figure 1:
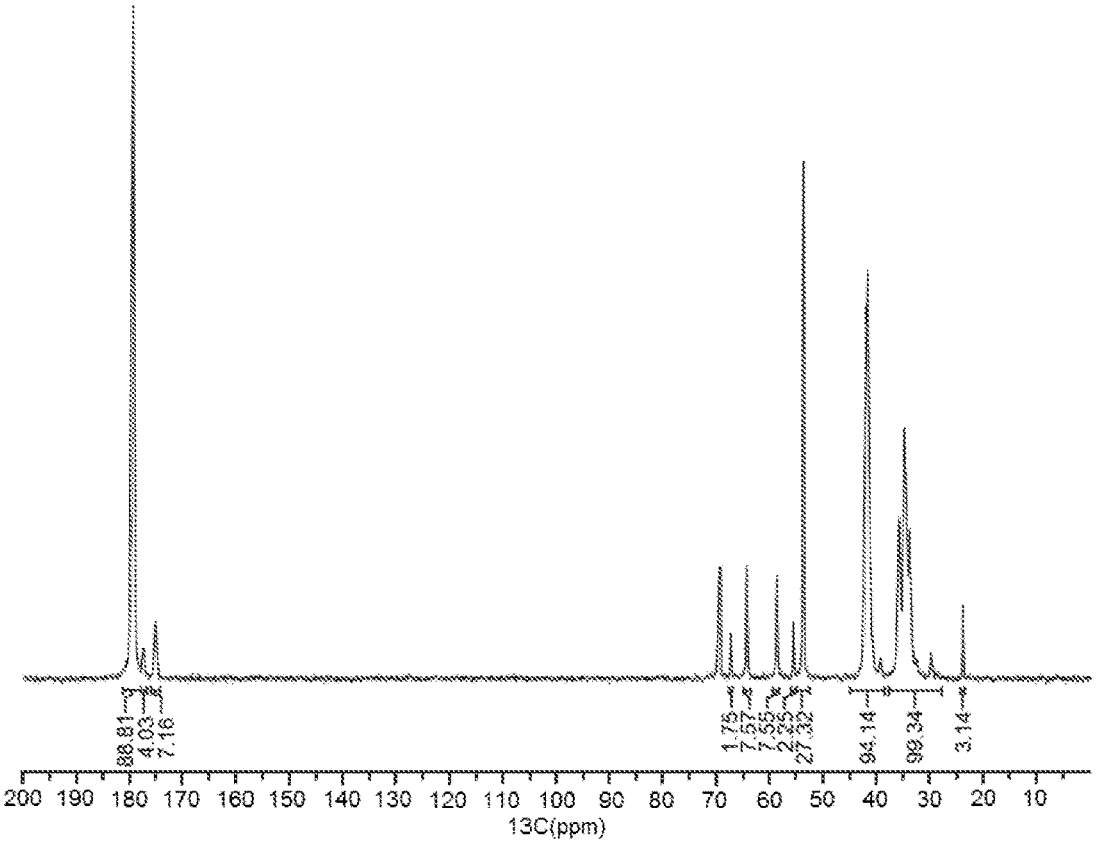
FIG. 1 is an exemplary $^{13}C$ NMR spectrum of the associative polymer described in Example 5.

In addition, the presence of the piperidine-2,6-dione monomer unit can be verified by $^{13}C$ NMR spectroscopy with a signature peak at 177 ppm in the $^{13}C$ NMR spectrum (FIG. 1). The relative amount of the piperidine-2,6-dione monomer unit can be quantified by integration of the peak at 177 ppm, followed by a relative comparison to the integration of other $^{13}C$ NMR signals indicative of other monomer units. Integration analysis demonstrates that Polymer 5 comprises 7.8/90/2.1 mol % DMAEA.MCQ-acrylamide-piperidine-2,6-dione. Note that the associative monomer unit is present in such low concentrations that signature peaks of the associative monomer unit are not visible by $^{13}C$ NMR spectroscopy.

Example 6

This example, provided as a control, demonstrates the effect on the inability to be machine processed into a powder, exhibited by a low molecular weight polymer without networking via an associative monomer unit or a surfactant.

Polymer 6 (control) comprising 50/50 mol % acrylamide/sodium acrylate was synthesized in the following manner:

An 1,000 g aqueous solution at neutral pH containing 37 wt. % monomer mixture of 50/50 mol % acrylamide/sodium acrylate, azo initiator, chain transfer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1.0\times10^6$ g/mol. The resulting polymer wet gel was too soft and sticky to be processed with the aid of 1 wt. % (relative to weight of polymer gel) petroleum oil based lubricant in a cutting mill (Retsch Mill Cutter) at 1500 rpm. The resulting wet gel was manually divided small pieces on a tray and dried in an oven at 85° C. to remove the moisture and then ground to powder with an intrinsic viscosity of 5.80 dg/L and Huggins constant of 0.24 in 1 N $NaNO_3$ solution at 30° C. The weight average molecular weight was determined by size exclusion chromatography.

As is apparent from the results set forth in Table 3, low molecular weight Polymer 6, lacking temporary networking via an associative monomer unit, was incapable of being machine processed to form a powder. This was further evidenced by the procedure requiring manual division of the soft and sticky polymer.

TABLE 3

| Polymer | Intrinsic Viscosity (dg/L) | Huggins Constant | Weight Avearge MW of Surrogate (kDa) | Wet Gel Processable |
|---|---|---|---|---|
| 6 | 5.80 | 0.24 | 1,100 | No |
| 7 | 5.83 | 0.84 | 1,100 | Yes |
| 8 | 3.49 | 2.49 | 1,100 | Yes |
| 9 | 5.84 | 0.98 | 1,100 | Yes |

Example 7

This example demonstrates the effect on the ability to be machine processed into a powder, exhibited by a low molecular weight polymer comprising temporary networking via an associative monomer unit and surfactant.

Polymer 7 comprising 49.9/50/0.1 mol % acrylamide/sodium acrylate/MAPTAC-C12 derivative synthesized in the following manner:

An 1,000 g aqueous solution at neutral pH containing 37 wt. % monomer mixture of 49.9/50/0.1 mol % acrylamide/sodium acrylate/MAPTAC-C12 derivative, 0.5 wt. % of hexadecyltrimethylammonium p-toluenesulfonate (Sigma-Aldrich, St. Louis, Mo.), azo initiator, chain transfer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1.0\times10^6$ g/mol. The resulting wet gel, which maintained a taffy like consistency and was not sticky, was processed with the aid of 1 wt. % (relative to weight of polymer gel) petroleum oil based lubricant in a cutting mill (Retsch Mill Cutter) at 1500 rpm to form granules. The wet gel granules were dried in a mesh tray in an oven at 85° C. to decrease the moisture content to about 10 wt. % and then ground to powder. The resulting powder had a median particle size of 357.1 microns (the mean particle size was 420.1), as determined using a Horiba Laser Scattering Particle Size Distribution Analyzer LA-950 with the setting of refractive index of powder at 1.5000. The powder had an intrinsic viscosity of 5.83 dg/L and Huggins constant of 0.84 in 1.0 N $NaNO_3$ solution at 30° C. The powder completely dissolved as a 1 wt. % solution in synthetic tap water with stirring of cage stirrer at 400 rpm within one hour. The powder, as a 1 wt. % solution in synthetic tap water, had a viscosity of 1976 cps, as measured on a Brookfield Model DV-E Viscometer with Spindle 63 at 30 rpm. The weight average molecular weight was determined by size exclusion chromatography using surrogate, Polymer 6.

As is apparent from the results set forth in Table 3, low molecular weight Polymer 7, comprising a surfactant, was easily machine processed to form a powder. In addition, Table 4 shows that the resulting powder, comprising 1.3 wt. % surfactant, was completely soluble as a 1 wt. % solution in local tap water with stirring of cage stirrer at 400 rpm within one hour.

Example 8

This example demonstrates the effect on the ability to be machine processed into a powder, exhibited by a low molecular weight polymer comprising temporary networking via an associative monomer unit and a surfactant.

Polymer 8 comprising 89.9/10/0.1 mol % acrylamide/sodium acrylate/MAPTAC-C12 derivative synthesized in the following manner:

An 1,000 g aqueous solution at neutral pH containing 33 wt. % monomer mixture of 89.9/10/0.1 mol % acrylamide/sodium acrylate/MAPTAC-C12 derivative, 0.5 wt. % of hexadecyltrimethylammonium p-toluenesulfonate (Sigma-Aldrich, St. Louis, Mo.), azo initiator, chain transfer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1.0\times10^6$ g/mol. The resulting wet gel, which maintained a taffy like consistency and was not sticky, was processed with the aid of 1 wt. % (relative to weight of polymer gel) petroleum oil based lubricant in a cutting mill (Retsch Mill Cutter) at 1500 rpm to form granules. The wet gel granules were dried in a mesh tray in an oven at 85° C. to decrease the moisture content to about 10 wt. % and then ground to powder. The resulting powder had a median particle size of 396.2 microns (the mean particle size was 463.6), as determined using a Horiba Laser Scattering Particle Size Distribution Analyzer LA-950 with the setting of refractive index of powder at 1.5000. The powder had an intrinsic viscosity of 3.49 dg/L and Huggins constant of 2.49 in 1 N $NaNO_3$ solution at 30° C. The powder completely dissolved as a 1 wt. % solution in synthetic tap water with stirring of cage stirrer at 400 rpm within one hour. The powder, as a 1 wt. % solution in tap water, had a viscosity of 2748 cps, as measured on a Brookfield Model DV-E Viscometer with Spindle 63 at 30 rpm. The weight average molecular weight was determined by size exclusion chromatography using a surrogate polymer formed with the same synthetic procedure containing 90/10 mol % acrylamide/sodium acrylate in the absence of the MAPTAC-C12 derivative.

As is apparent from the results set forth in Table 3, low molecular weight Polymer 8, comprising a surfactant, was easily machine processed to form a powder. In addition, Table 4 shows that the resulting powder, comprising 1.3 wt. % surfactant, was completely soluble as a 1 wt. % solution in local tap water with stirring of cage stirrer at 400 rpm within one hour.

TABLE 4

| Polymer | Weight Avearge MW of Surrogate (kDa) | Surfactant in powder (wt. %) | Wet Gel Processable | Solubility | Viscosity of 1 wt. % solution in water (cps) |
|---|---|---|---|---|---|
| 7 | 1,100 | 1.3 | Yes | Good | 1976 |
| 8 | 1,100 | 1.3 | Yes | Good | 2748 |
| 9 | 1,100 | 0 | Yes | Poor | 1588 |

Example 9

This example demonstrates the effect on the ability to be machine processed into a powder, exhibited by a low molecular weight polymer comprising temporary networking via an associative monomer only (i.e., not further comprising a surfactant in the monomer phase).

Polymer 9 comprising 49.9/50/0.1 mol % acrylamide/sodium acrylate/MAPTAC-C12 derivative synthesized in the following manner:

An 1,000 g aqueous solution at neutral pH containing 37 wt. % monomer mixture of 49.9/50/0.1 mol % acrylamide/sodium acrylate/MAPTAC-C12 derivative, azo initiator, chain transfer agent, and chelant was chilled to approximately −5° C. and de-gassed with nitrogen. Polymerization was initiated with a pair of redox agents and proceeded adiabatically until the conversion of monomer reached more than 99.99% to get the targeted molecular weight of $1.0\times10^6$ g/mol. The resulting wet gel, which maintained a taffy like consistency and was not sticky, was processed with the aid of 1 wt. % (relative to weight of polymer gel) petroleum oil based lubricant in a cutting mill (Retsch Mill Cutter) at 1500 rpm to form granules. The wet gel granules were dried in a mesh tray in an oven at 85° C. to remove (i.e., to achieve a moisture content of about 10 wt. %) the moisture and then ground to powder. The resulting powder had a median particle size of 385.4 microns (the mean particle size was 446.4), as determined using a Horiba Laser Scattering Particle Size Distribution Analyzer LA-950 with the setting of refractive index of powder at 1.5000. The powder had an intrinsic viscosity of 5.84 dg/L and Huggins constant of 0.98 in 1 N $NaNO_3$ solution at 30° C. The powder polymer did not completely dissolve as a 1 wt. % solution in synthetic tap water with stirring of cage stirrer at 400 rpm within one hour. The powder, as a 1 wt. % solution in synthetic tap water, had a viscosity of 1588 cps, as measured on a Brookfield Model DV-E Viscometer with Spindle 63 at 30 rpm. The weight average molecular weight was determined by size exclusion chromatography using surrogate, Polymer 6.

As is apparent from the results set forth in Table 4, low molecular weight Polymer 9, not comprising a surfactant, was capable of being machine processed to form a powder. The resulting powder was sparingly soluble in water (i.e., did not completely dissolve as a 1 wt. % solution in local tap water with stirring of cage stirrer at 400 rpm within one hour).

Example 10

This example demonstrates the effect on paper dry strength exhibited by a sheet of paper treated with a powder comprising associative polymer strength aids(s) networked via an associative monomer unit and a surfactant.

Polymer 2 (prepared according to Example 2) and Polymer 3 (prepared according to Example 3) were dissolved in water and dosed at various concentrations into cellulose fiber slurry. The treated fibers were then added to a handsheet mold and drained through a screen to form wet fiber pads. The pads were couched from the screen, pressed, and dried to yield finished paper sheets. The sheets were tested for tensile strength and compressive strength and the results set forth in FIG. 2 and FIG. 3, respectively. In addition, the tensile strength and compressive strength results for Nalco 64114 (i.e., a glyoxylated polyacrylamide polymer), an established commercial strength agent, are provided for comparison.

Figure 2:
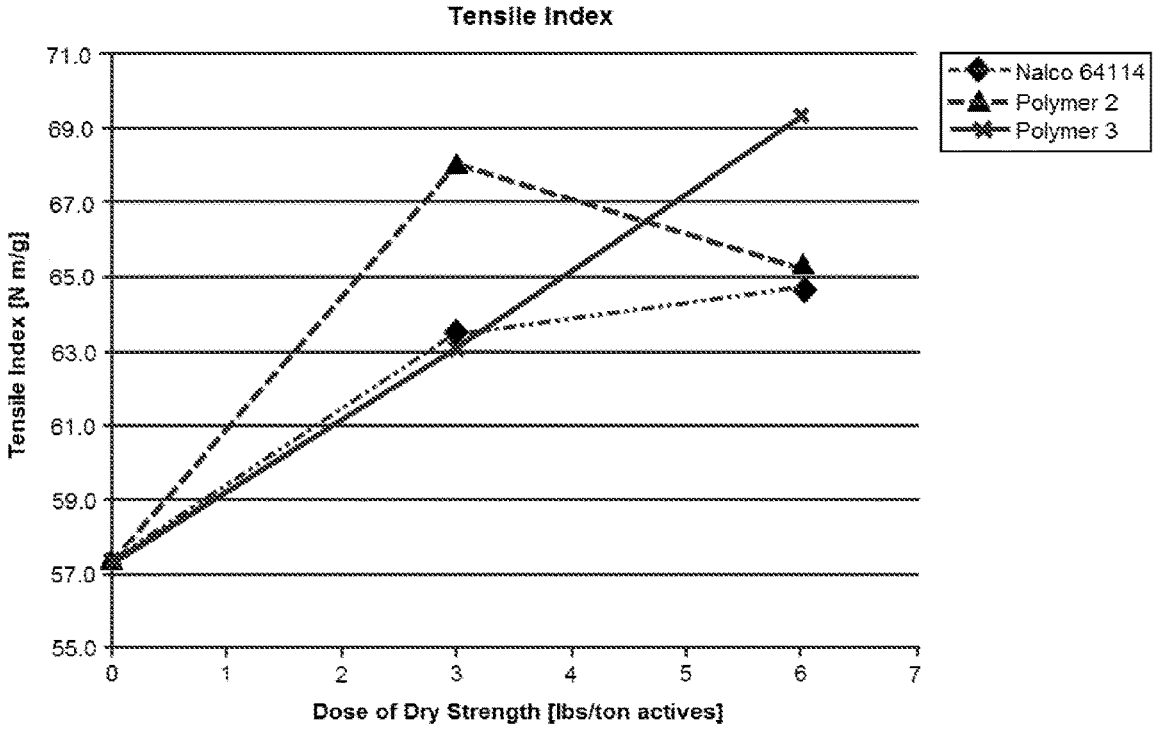
FIG. 2 graphically depicts the results of Example 10.
Figure 3:
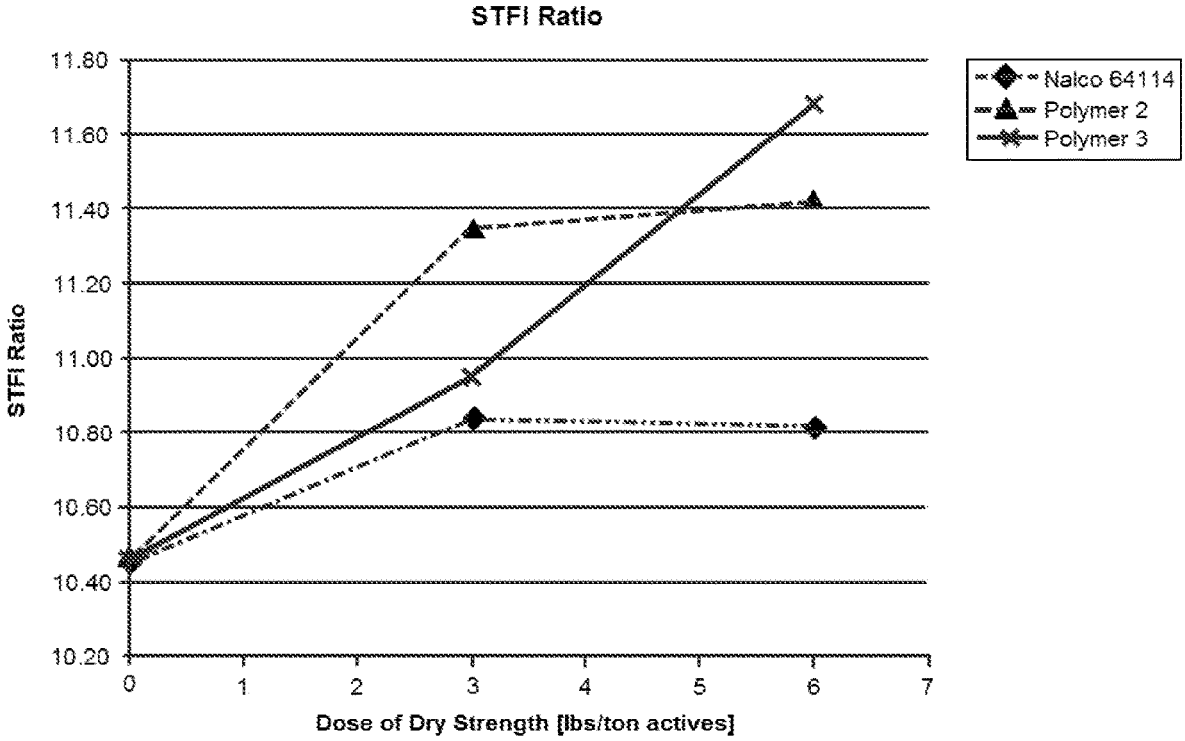
FIG. 3 graphically depicts the results of Example 10.

As demonstrated by FIG. 2 and FIG. 3, Polymer 2 and Polymer 3 exhibit satisfactory strength properties, outperforming the standard, Nalco 64114 (i.e., a glyoxylated polyacrylamide polymer) (control), in both tensile strength and compressive strength.

Example 11

This example demonstrates the effect on paper dry strength exhibited by a sheet of paper treated with a powder comprising associative polymer strength aids(s) networked via an associative monomer unit and a surfactant.

Polymer 1 (control, prepared according to Example 1) and Polymer 2 (prepared according to Example 2) were dissolved in water and dosed at various concentrations into a cellulose fiber slurry. The treated fibers were then added to a handsheet mold and drained through a screen to form a wet fiber pad. The pad was couched from the screen, pressed, and dried to yield the finished paper sheet. The sheet was tested for tensile strength and the results set forth in FIG. 4.

Figure 4:
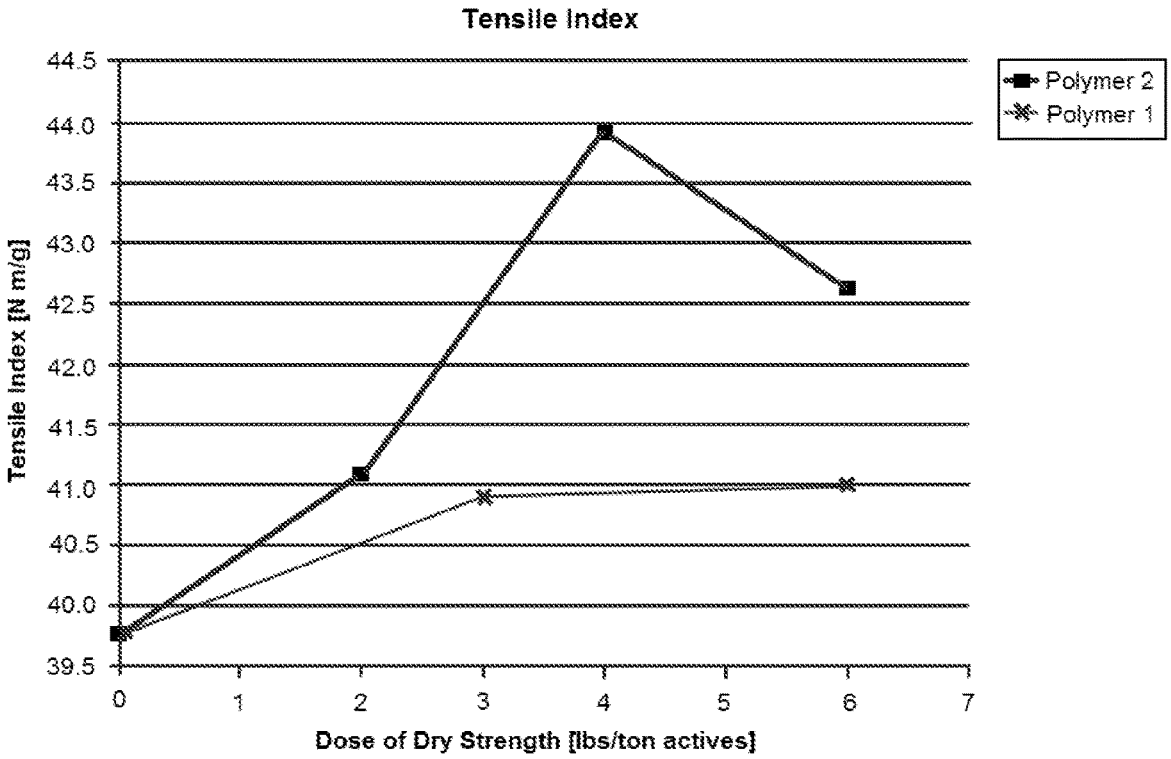
FIG. 4 graphically depicts the results of Example 11.

As demonstrated by FIG. 4, Polymer 2 exhibited improved tensile strength relative to low molecular weight Polymer 1 (control), which lacked networking via an associative monomer unit.

Example 12

This example demonstrates the effect on paper dry strength exhibited by a paper sheet produced with a lab-scale disintegrator model system using cardboard box pieces treated with a powder comprising associative polymer strength aids(s) networked via an associative monomer unit and a surfactant.

Figure 5:
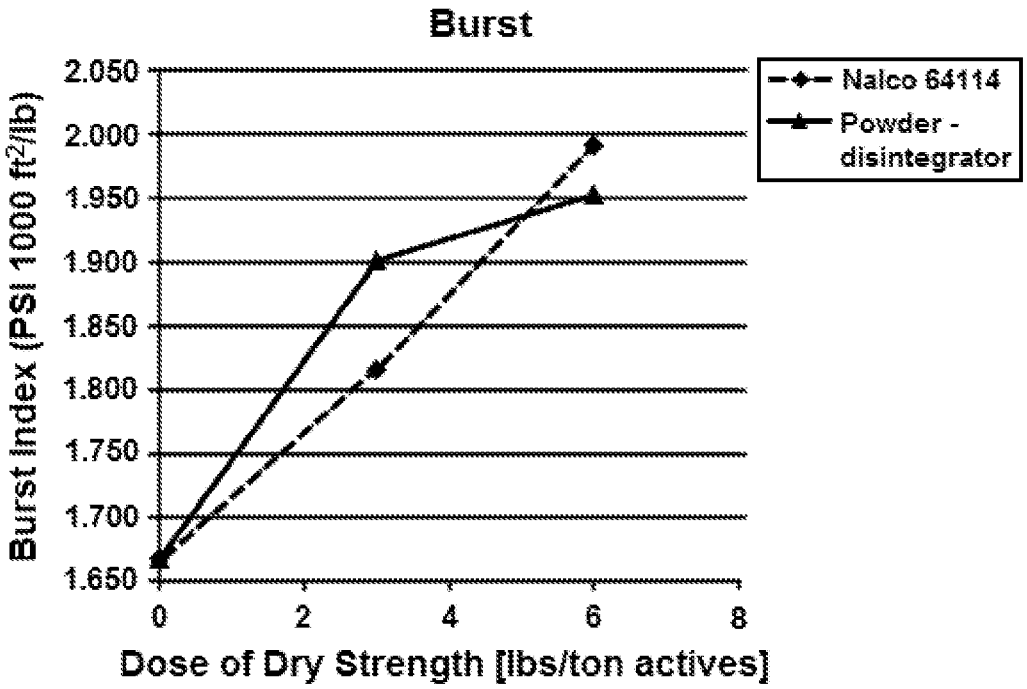
FIG. 5 graphically depicts the results of Example 12.
Figure 6:
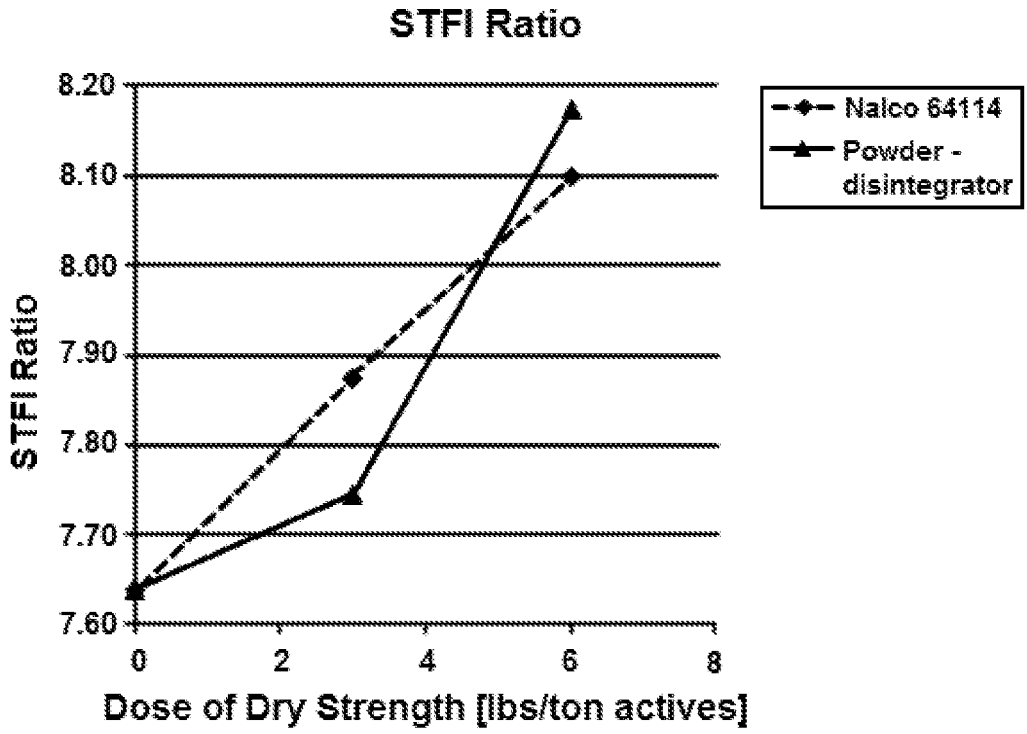
FIG. 6 graphically depicts the results of Example 12.

The powder was added at doses of 0, 3, and 6 lbs/ton to a lab-scale disintegrator containing cardboard box pieces and hot tap water. The disintegrator pulped the cardboard pieces using high shear, similar to the refiner on a paper machine. The treated fibers were then added to a handsheet mold and drained through a screen to form a wet fiber pad. The pad was couched from the screen, pressed, and dried to yield the finished paper sheet. The sheet was tested for burst and compressive strength (FIG. 5 and FIG. 6). In addition, the burst and compressive strength results for completely dissolved, solution-based Nalco 64114 (i.e., a glyoxylated polyacrylamide polymer) (control), an established commercial polymer strength aid, are provided for comparison.

As demonstrated by FIG. 5 and FIG. 6, the powder exhibits burst and compressive strengths similar to glyoxylated polyacrylamide Nalco 64114 at dosages of 3 and 6 lbs/ton.

Example 13

This example demonstrates the refractive index of a series of associative polymer strength aid solutions as measured by a RM50 refractometer (Mettler Toledo) at 25° C. and 1 atmosphere ("atm") of pressure.

A fully dissolved associative polymer strength aid solution with known concentration was obtained by mixing a weighed amount of powder and a weighed amount of water under shear with a cage stirrer at 400-800 rpm until the mixture of powder and water can easily pass through 100-mesh screen with a trace amount of insoluble gel residue (<<0.05 wt % of original powder added) left on the screen. An aliquot of the resulting filtered associative polymer strength aid solution was placed in the cell of a RM50 refractometer (Mettler Toledo), and the refractive index recorded. The procedure was repeated for varying concentrations of associative polymer strength aid solutions, and the refractive indices were plotted as a function of concentration.

Figure 7:
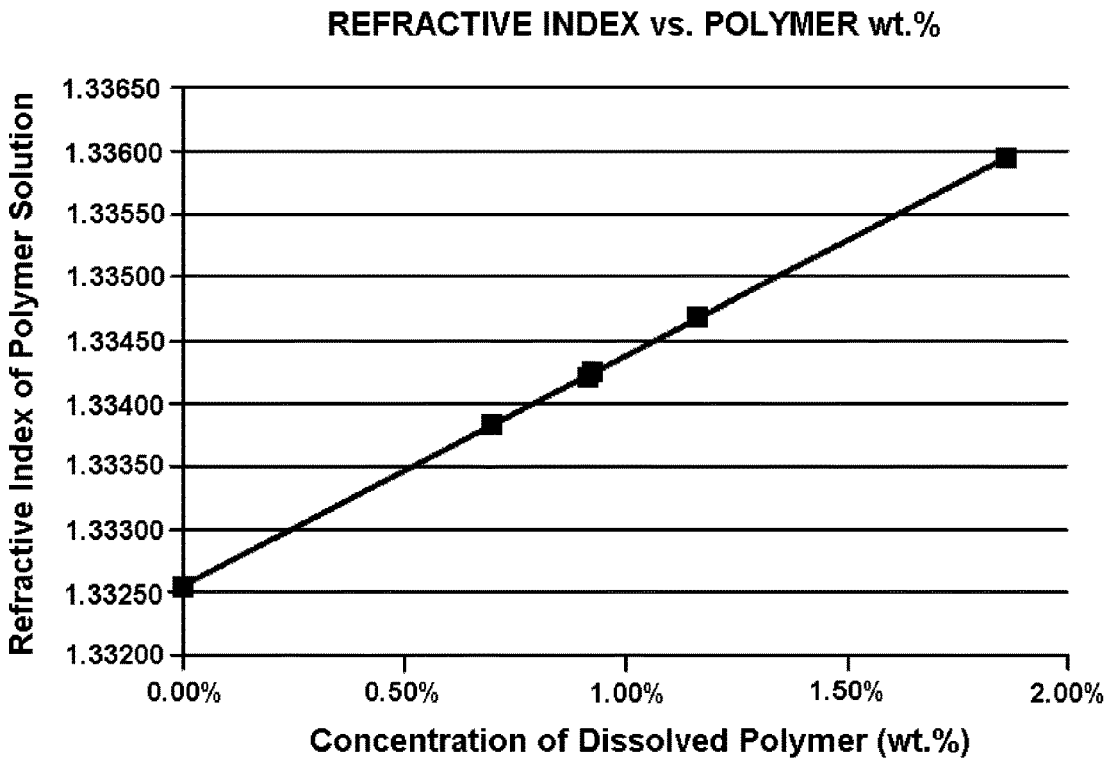
FIG. 7 graphically depicts the results of Example 13.

As demonstrated by FIG. 7, the refractive indices of the associative polymer strength aid solutions are linearly correlated with associative polymer strength aid concentration. Thus, a refractive index calibration curve can be used to estimate the concentration of an associative polymer strength aid in solution.

Example 14

This example demonstrates the mixing progression of a powder suspension (1 wt. %) as measured by the refractive index.

A powder suspension was obtained by dispersing a weighed amount of powder into a weighed amount of water (1 wt. % powder content) manually or with a powder feeder, e.g., Norchem POWDERCAT™ feeder (Norchem Industries, Mokena, Ill.). A small aliquot of the suspension was filtered through a 100-mesh screen at 1-minute intervals to remove any undissolved powder. The refractive index of the filtrate was measured using a RM50 refractometer (Mettler Toledo), and the refractive index recorded. The concentration of dissolved associative polymer strength aid in solution was determined using calibration curve as outlined in Example 13 and FIG. 7. The refractive indices (or associative polymer strength aid concentrations) were plotted as a function of time to determine the mixing progression of the powder suspension.

As demonstrated by FIG. 8, the mixing curve for a 1 wt. % powder suspension plateaus at a refractive index of about 1.33425 at about 15 minutes of mixing. Thus, the 1 wt. % powder suspension can be considered by this example to be a suspension (or slurry) up until about 15 minutes of mixing, and a solution once the plateau is reached.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of incorporating a low molecular weight polymer strength aid into a papermaking process, comprising treating a paper sheet precursor with a powder, wherein the powder comprises a polymer strength aid, wherein the polymer strength aid has a weight average molecular weight of from about 10 kDa to about 2,000 kDa, wherein the polymer strength aid comprises one or more associative monomer units and at least one of the one or more associative monomer units comprises a monomer of Formula II:

II

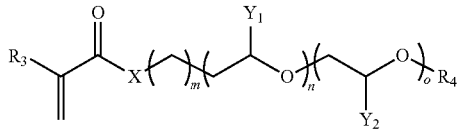

wherein $R_3$ is H or $C_1$-$C_{10}$ alkyl, X is O or NH, n is an integer from 1 to 100, o is an integer from 0 to 100, m is at least 5, each $Y_1$ and $Y_2$ are independently H or $C_1$-$C_4$ alkyl, and $R_4$ is H or a hydrophobic group.

2. The method of claim 1, wherein the powder is added to the paper sheet precursor upstream of a wet end of a paper machine.

3. The method of claim 2, wherein the powder is added to a stock prep section of the paper machine.

4. The method of claim 1, wherein the powder has an average particle size of about 1 micron to about 10,000 microns.

5. The method of claim 1, wherein the powder has a water content of from about 0.1 wt. % to about 20 wt. % prior to treating the paper sheet precursor.

6. The method of claim 1, wherein the powder further comprises one or more surfactant(s).

7. The method of claim 1, wherein the powder comprises a polymer strength aid and one or more surfactant(s) that are associatively networked.

8. The method of claim 7, wherein the polymer strength aid has one or more monomer unit(s) that are structurally similar to the surfactant(s).

9. The method of claim 1, wherein the polymer strength aid has a weight average molecular weight of from about 500 kDa to about 2,000 kDa.

10. The method of claim 1, wherein the powder has an intrinsic viscosity of from about 0.05 dL/g to about 7 dL/g.

11. The method of claim 1, wherein the powder has a Huggins constant of from about 0.3 to about 10.

12. The method of claim 1, further comprising adding a solvent to the powder to form a wetted powder before treating the paper sheet precursor.

13. The method of claim 12, wherein the wetted powder is added to the paper sheet precursor before the wetted powder reaches complete dissolution, as measured by refractive index at 25° C. and 1 atmosphere ("atm") of pressure.

14. The method of claim 12, wherein the wetted powder reaches complete dissolution, as measured by refractive index at 25° C. and 1 atmosphere ("atm"), to form a powder solution in an addition conduit during addition to the paper sheet precursor.

15. The method of claim 12, wherein the solvent is water.

16. The method of claim 12, wherein the wetted powder has a powder content of from about 0.1 wt. % to about 10 wt. % prior to treating the paper sheet precursor.

* * * * *